United States Patent [19]

Kashio

[11] 4,306,482

[45] Dec. 22, 1981

[54] SYSTEM FOR GENERATING SAMPLE TONES ON AN ELECTRONIC MUSICAL INSTRUMENT

[75] Inventor: Toshio Kashio, Tokyo, Japan

[73] Assignee: Casio Computer Co., Ltd., Tokyo, Japan

[21] Appl. No.: 114,571

[22] Filed: Jan. 23, 1980

Related U.S. Application Data

[63] Continuation of Ser. No. 950,512, Oct. 11, 1978.

[30] Foreign Application Priority Data

Oct. 15, 1977 [JP] Japan ..... 52-123695

[51] Int. Cl.[3] ..... G10F 1/00

[52] U.S. Cl. ..... 84/1.03; 84/1.24; 84/1.19

[58] Field of Search ..... 84/1.01, 1.03, 1.19, 84/1.24

[56] References Cited

U.S. PATENT DOCUMENTS 3,515,792 6/1970 Deutsch ..... 84/1.03

3,823,390 7/1974 Tomisawa et al. ..... 84/1.01

3,854,365 12/1974 Tomisawa et al. ..... 84/1.01

4,129,055 12/1978 Whittington et al. ..... 84/1.03

*Primary Examiner*—R. L. Moses

*Assistant Examiner*—Forester W. Isen

*Attorney, Agent, or Firm*—Frishauf, Holtz, Goodman & Woodward

[57] ABSTRACT

In an electronic musical instrument which is arranged to produce musical tones belonging to the selected one of many different types of musical instruments and having a number of player-operable selection keys respectively corresponding to the number of types of musical instrument sounds desired, the improvement wherein means is provided for generating a sample tone belonging to that type of musical instrument specified by one of the above-mentioned selection keys at a prescribed pitch and period simply by depressing only once a particular selection key, without taking the trouble of successively depressing individual performance keys, thereby facilitating the selection of a desired type of musical instrument by the player.

5 Claims, 38 Drawing Figures

FIG. 20A

| OCTAVE | SCALE | B | C | C# | D | D# | E |
|---|---|---|---|---|---|---|---|
| | CORRECTION VALUE $\alpha = T_X/T_{fb} - 64$ | 63 | 55 | 49 | 42 | 36 | 31 |
| 1 | $T_{X1} = T_{fb1}(64+\alpha)$ $\mu S$ | 32512 | 30464 | 28928 | 27136 | 25600 | 24320 |
| | $F_{X1} = 1/T_{X1}$ Hz | 30.757 | 32.826 | 34.569 | 36.851 | 39.063 | 41.118 |
| | REAL FREQUENCY Hz | 30.868 | 32.703 | 34.647 | 36.708 | 38.890 | 41.203 |
| 2 | $T_{X2} = T_{fb2}(64+\alpha)$ $\mu S$ | 16256 | 15232 | 14464 | 13568 | 12800 | 12160 |
| | $F_{X2} = 1/T_{X2}$ Hz | 61.516 | 65.651 | 69.137 | 73.703 | 78.125 | 82.237 |
| | REAL FREQUENCY Hz | 61.735 | 65.406 | 69.295 | 73.416 | 77.781 | 82.406 |
| 3 | $T_{X3} = T_{fb3}(64+\alpha)$ $\mu S$ | 8128 | 7616 | 7232 | 6784 | 6400 | 6080 |
| | $F_{X3} = 1/T_{X3}$ Hz | 123.03 | 131.30 | 138.27 | 147.41 | 156.25 | 164.47 |
| | REAL FREQUENCY Hz | 123.47 | 130.81 | 138.59 | 146.83 | 155.56 | 164.81 |
| 4 | $T_{X4} = T_{fb4}(64+\alpha)$ $\mu S$ | 4064 | 3808 | 3616 | 3392 | 3200 | 3040 |
| | $F_{X4} = 1/T_{X4}$ Hz | 246.06 | 262.61 | 276.55 | 294.81 | 312.50 | 328.95 |
| | REAL FREQUENCY Hz | 246.94 | 261.63 | 277.18 | 293.66 | 311.13 | 329.63 |
| 5 | $T_{X5} = T_{fb5}(64+\alpha)$ $\mu S$ | 2032 | 1904 | 1808 | 1696 | 1600 | 1520 |
| | $F_{X5} = 1/T_{X5}$ Hz | 492.13 | 525.21 | 553.62 | 589.62 | 625 | 657.90 |
| | REAL FREQUENCY Hz | 493.88 | 523.25 | 554.37 | 587.33 | 622.25 | 659.26 |
| 6 OR 7 | $T_{X6} = T_{fb6}(64+\alpha)$ $\mu S$ | 1016 | 952 | 904 | 848 | 800 | 760 |
| | $F_{X6} = 1/T_{X6}$ Hz | 984.25 | 1050.42 | 1106.25 | 1179.25 | 1250 | 1315.79 |
| | REAL FREQUENCY Hz | 987.77 | 1046.5 | 1108.7 | 1174.7 | 1244.5 | 1318.5 |

FIG. 20B

| OCTAVE | SCALE | F | F# | G | G# | A | A# |
|---|---|---|---|---|---|---|---|
| | CORRECTION VALUE $\alpha = T_X/T_{fb} - 64$ | 25 | 21 | 16 | 11 | 7 | 3 |
| 1 | $T_{X1} = T_{fb1}(64+\alpha)$ $\mu S$ | 22784 | 21760 | 20480 | 19200 | 18176 | 17152 |
| | $F_{X1} = 1/T_{X1}$ Hz | 43.890 | 45.956 | 48.828 | 52.083 | 55.018 | 58.302 |
| | REAL FREQUENCY Hz | 43.653 | 46.249 | 48.999 | 51.913 | 55.000 | 58.270 |
| 2 | $T_{X2} = T_{fb2}(64+\alpha)$ $\mu S$ | 11392 | 10880 | 10240 | 9600 | 9088 | 8576 |
| | $F_{X2} = 1/T_{X2}$ Hz | 87.781 | 91.912 | 97.656 | 104.167 | 110.035 | 116.604 |
| | REAL FREQUENCY Hz | 87.307 | 92.498 | 97.998 | 103.83 | 110.00 | 116.54 |
| 3 | $T_{X3} = T_{fb3}(64+\alpha)$ $\mu S$ | 5696 | 5440 | 5120 | 4800 | 4544 | 4288 |
| | $F_{X3} = 1/T_{X3}$ Hz | 175.56 | 183.82 | 195.31 | 208.33 | 220.07 | 233.21 |
| | REAL FREQUENCY Hz | 174.61 | 185.00 | 196.00 | 207.65 | 220.00 | 233.08 |
| 4 | $T_{X4} = T_{fb4}(64+\alpha)$ $\mu S$ | 2848 | 2720 | 2560 | 2400 | 2270 | 2144 |
| | $F_{X4} = 1/T_{X4}$ Hz | 351.12 | 367.65 | 390.63 | 416.67 | 440.14 | 466.42 |
| | REAL FREQUENCY Hz | 349.23 | 369.99 | 392.00 | 415.30 | 440.00 | 466.16 |
| 5 | $T_{X5} = T_{fb5}(64+\alpha)$ $\mu S$ | 1424 | 1360 | 1280 | 1200 | 1136 | 1072 |
| | $F_{X5} = 1/T_{X5}$ Hz | 702.25 | 735.29 | 781.25 | 833.33 | 880.28 | 932.84 |
| | REAL FREQUENCY Hz | 698.46 | 739.99 | 783.99 | 830.61 | 880.00 | 932.33 |
| 6 OR 7 | $T_{X6} = T_{fb6}(64+\alpha)$ $\mu S$ | 712 | 680 | 640 | 600 | 568 | 536 |
| | $F_{X6} = 1/T_{X6}$ Hz | 1404.49 | 1470.59 | 1562.5 | 1666.67 | 1760.56 | 1865.67 |
| | REAL FREQUENCY Hz | 1396.9 | 1480.0 | 1568.0 | 1661.2 | 1760.0 | 1864.7 |

SYSTEM FOR GENERATING SAMPLE TONES ON AN ELECTRONIC MUSICAL INSTRUMENT

This is a continuation of application Ser. No. 950,512 filed Oct. 11, 1978.

BACKGROUND OF THE INVENTION

In an electronic musical instrument designed to generate musical tones belonging to the selected one of many different types of musical instruments, this invention relates to a system for enabling a player, by operating a key only once to produce a sample tones associated with that type of musical instrument which is specified by one of a plurality of selection switches.

Some electronic musical instruments like an electronic organ or synthesizer are the type which is designed to generate by itself musical tones associated with that type of musical instruments such as cembalo, piano, flute, oboe, clarinet, etc. which is specified by a selection switch. With an electronic musical instrument which is designed to produce tones approximating those of natural musical instruments and represent a small number of types thereof, a player can remember musical tones peculiar to said natural musical instrument and play a piece by musical tones belonging to the selected one of said few types. Such a small scale electronic musical instrument can freely create a tone color desired by a player by operation of any of particularly provided switches such as the draw bar, tablet, etc.

In contrast, a large scale electronic musical instrument produces not only tones approximating those of natural musical instruments, but also tones of many other types of musical instruments by operation of a key switch for selecting any desired type of musical instrument. With such a large scale electronic musical instrument which generates many tones having a tone color peculiar thereto, a player has to select up a desired type of musical instrument before playing a piece. If, in this case, the player has to ascertain that type of musical instrument which he desires to play by listening to sample tones produced by successively depressing some performance keys by himself for trial, then the selecting operation will be very much troublesome.

SUMMARY OF THE INVENTION

This invention has been accomplished in view of the above-mentioned circumstances, and is intended to provide a system which enables a sample tone to be generated at a specified pitch and period on an electronic musical instrument of the above-mentioned arrangement simply by operating of a key only once for selecting that type of musical instrument which the player desires to play, without causing him to take the trouble of listening to the tones of some performances keys which he depresses for trial.

To this end, the system of this invention for producing a sample tone on an electronic musical instrument comprises locking means for allowing only the selected one of many types of musical instruments to be played for a specified period; means for designating any desired type of musical instrument; control means for selectively playing that type of musical instrument which has been specified by said designating means; and means for generating a sample tone associated with the selected type of musical instrument at a prescribed pitch and period simply by operating only once a musical instrument type selection key.

With the previously described large scale electronic musical instrument, the sample tone-generating system of this invention enables a player to easily select that type of musical instrument which he desires to play, simply by listening to a sample tone of a specified pitch and period associated with the selected type, which is produced by operating a selection key only once, without taking the trouble of successively depressing some individual performance keys by himself.

BRIEF DESCRIPTION OF THE DRAWINGS

This invention can be more fully understood from the following detailed description when taken in conjunction with the accompanying drawings, in which:

FIGS. 8A-1, 8A-2, 8B-1, 8B-2, 8C-1, 8C-2, 8D-1, 8D-2, 8E-1, 8E-2, 8E-3, 8F-1, 8F-2, 8F-3 and 8G indicate the concrete circuit arrangements of the various sections of FIGS. 1A to 1C;

FIGS. 20A and 20B are an array of pitch clock pulse frequencies used in FIGS. 8D-1, 8D-2.

DETAILED EXPLANATION OF THE PREFERRED EMBODIMENTS

Figures 1, 8A:
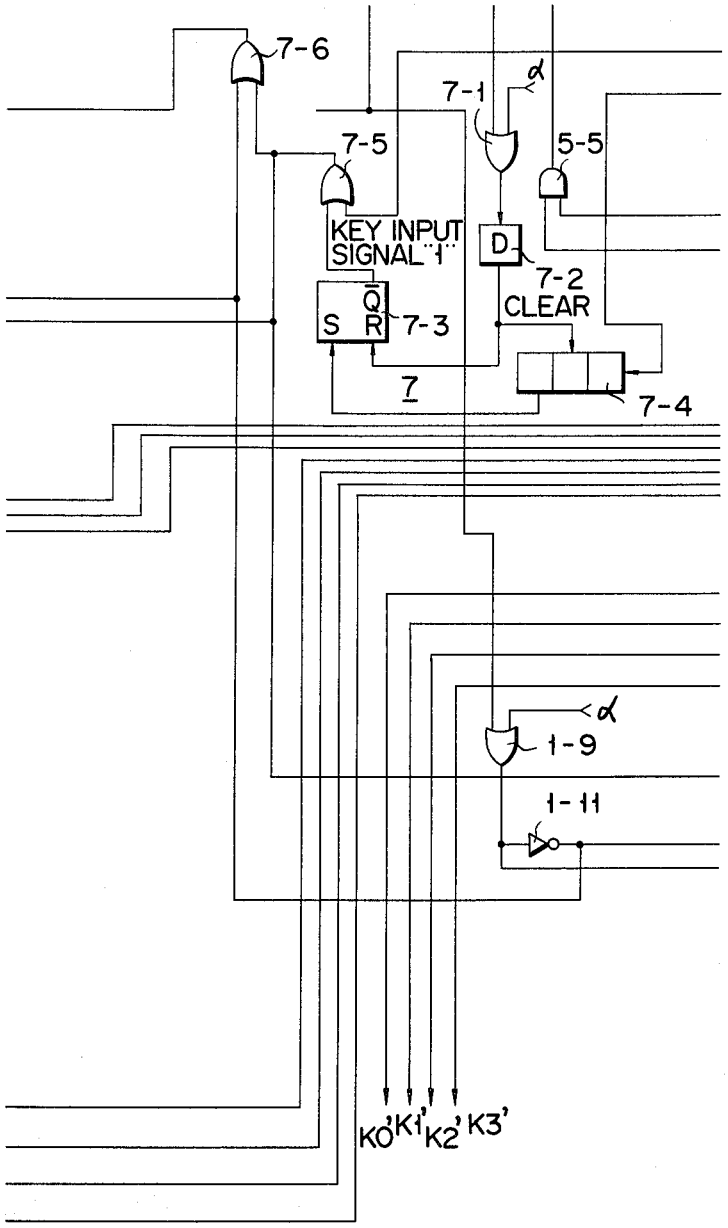
Figures 2, 8A:
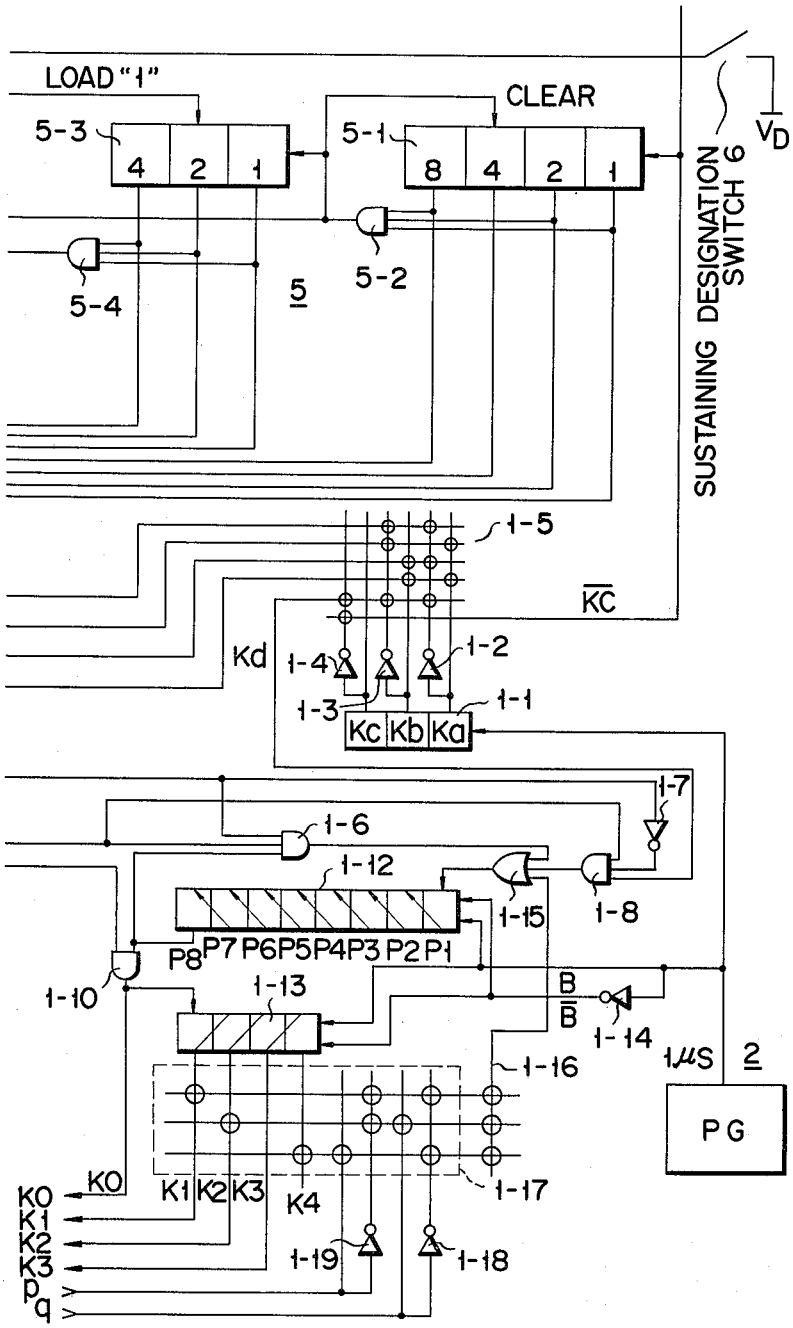

There will now be described by reference to the accompanying drawings a sample tone-generating system embodying this invention used with an electronic musical instrument. FIG. 1 schematically shows the circuit arrangement of an entire electronic musical instrument. A referential numeral 1 denotes a control signal-generating circuit for producing the later described control signals for controlling the operation of the various sections of the whole electronic musical instrument according to a referential clock signal issued from a clock pulse generator 2 (in this embodiment, the clock pulse has a period of 1 μs and a frequency of 1000 KHz). A referential numeral 3 denotes a group of performance keys. In this embodiment, it is assumed that the keyboard of the electronic musical instrument is formed of 84 performance keys. The performance keys are jointly connected at one end and normally supplied with a potential $V_D$ having a prescribed level and at the other end are individually connected to a performance key input detection circuit 4 including means for issuing a timing signal used in the successive scanning of the performance keys. The key input detection circuit 4 sends forth the timing signal in synchronization with the counting operation of a scale-octave counter 5 (which provides data on 12 scale and data on 7 octaves). The key input detection circuit 4 further includes a key input circuit for ensuring the supply of one-shot key input signals from the respective performance keys when some of them are depressed at the same time particularly to produce a chord. An output signal from the scaleoctave counter 5 denoting its last count is conducted to a key nonoperation control circuit 7 which is supplied with an operation signal delivered from a sustenance instruction switch 6 and the aforesaid timing signal of the performance keys sent forth from the key input detection circuit 4. The key nonoperation control circuit 7 is designed to detect that the performance keys are not operated longer than a prescribed length of time after an electronic musical instrument is set ready for a performance. A key operation detection signal (reversed from a key nonoperation detection signal) supplied from said key nonoperation control circuit 7 and a new key operation detection signal issued from the key input detection circuit 4 are supplied to the control signal-generating circuit 1 and the later described control unit 8 as synchronization control signals for the performance keys.

A referential numeral 9 is an octave-specifying data memory of 24 bits comprising 3 parallel-connected shift registers each formed of 8 serially-arranged bits. A referential numeral 10 is an octave bit memory of 40 bits comprising 5 parallel-connected shift registers each formed of 8 serially-arranged bits and designed to generate an a referential clock pulse of an octave. A referential numeral 11 is a pitch clock pulse number control memory (hereinafter referred to as "an Fa memory") comprising one shift register formed of 8 serially-arranged bits. A referential numeral 12 is a scale-designating data memory of 32 bits comprising 4 parallel-connected shift registers, each formed of 8 serially-arranged bits. A referential numeral 13 is an address memory of 48 bits comprising 6 parallel-connected shift registers each formed of 8 serially-arranged bits and designed to store address steps, that is, steps constituting one cycle of a tone. A referential numeral 14 is a period control memory (hereinafter referred to as "an Fb memory") comprising one shift register formed of 8 serially-arranged bits and designed to ensure a phase synchronization between the cycle of a tone and a period resulting from the latter described instruction to change the period. A referential numeral 15 is an envelope memory of 32 bits comprising 4 parallel-connected shift registers each formed of 8 serially-arranged bits and designed to store successive changes in the value of a tone volume envelope in the form of digits. A referential numeral 16 is a synchronization memory (hereinafter referred to as "an Fc memory") comprising one shift register formed of 8 serially-arranged bits and designed to effect synchronization between a clock pulse signal for a tone volume envelope and a tone cycle. A referential numeral 17 is an operation state memory (hereinafter referred to as "an Fd memory") designed selectively to store data denoting operation or data indicating nonoperation. A referential numeral 18 is a memory comprising one shift register formed of 8 serially-arranged bits and designed selectively to store data showing that the tone volume envelope is attacked or data indicating that said envelope is released. With all those memories 13, 14, 15, 16, 17, 18 shifting is successively carried forward, each time a signal having a period of 1 μs is received. When 8 signals are received, that is, when a period of 8 μs is brought to an end, the shifting completes one cycle. Each of said memories have memory sections corresponding memory sections thereof comprising 8 line memories K0, K1, K2, K3, K4, K5, K6, K7 (FIGS. 15, 16, 17), each line memory being formed of 8 lines. Therefore, it is possible to store 8 forms at maximum of the scale-designating data, octave-designating data, tone waveform and tone volume envelope in the respective line memories K0, K1, K2, K3, K4, K5, K6, K7. Therefore, where, for example, 8 performance keys at maximum are depressed at the same time, signals resulting from their operation can all be supplied to the electronic musical instrument, with the line memories K0, K1, K2, K3, K4, K5, K6, K7 constituted by the memories 9, 10, 11, 12, 13, 14, 15, 16, 17, 18 successively made to handle the respective signals produced by operation of said 8 performance keys.

Figure 1A:
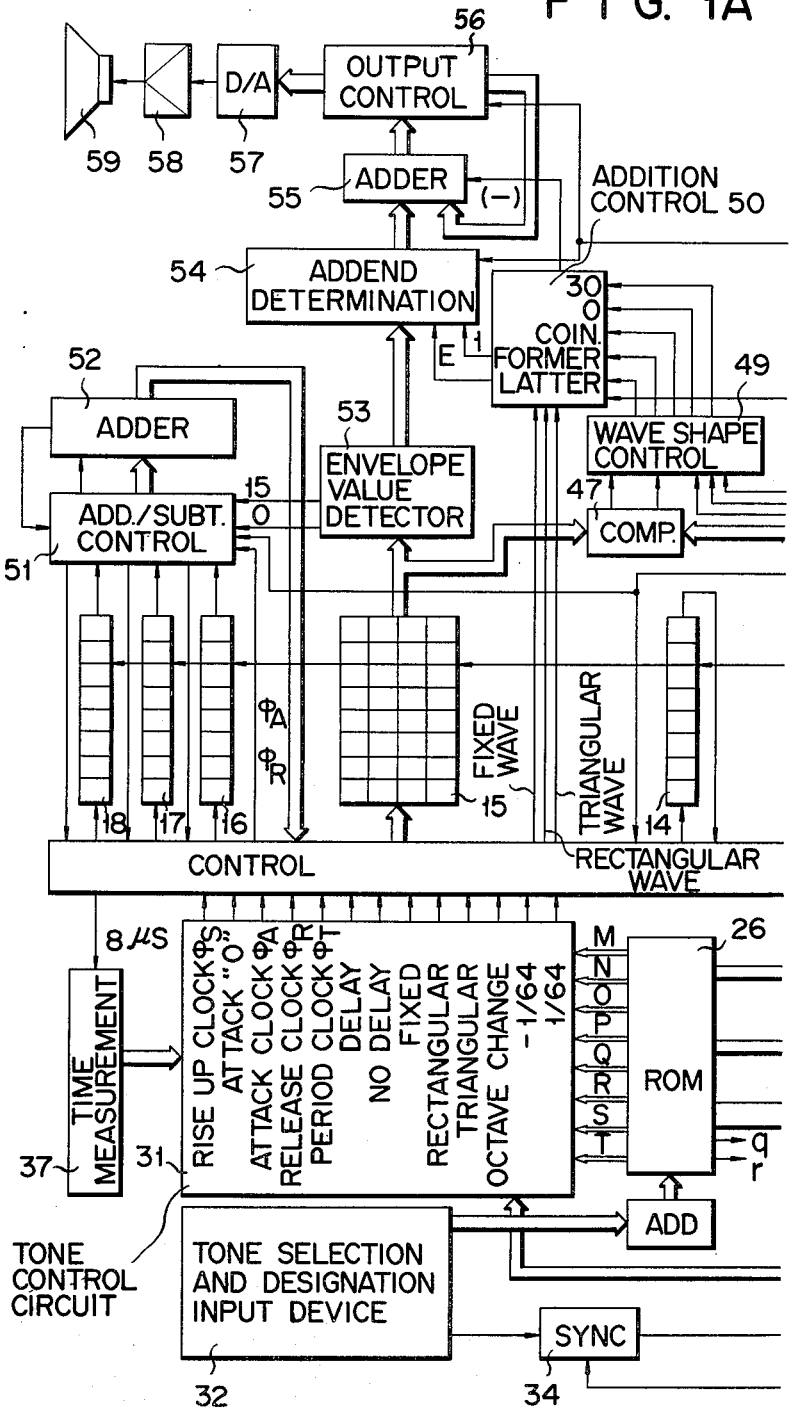
FIGS. 1A, 1B and 1C schematically show the circuit arrangement of an electronic musical instrument provided with a sample tone-generating system of this invention.
Figure 1B:
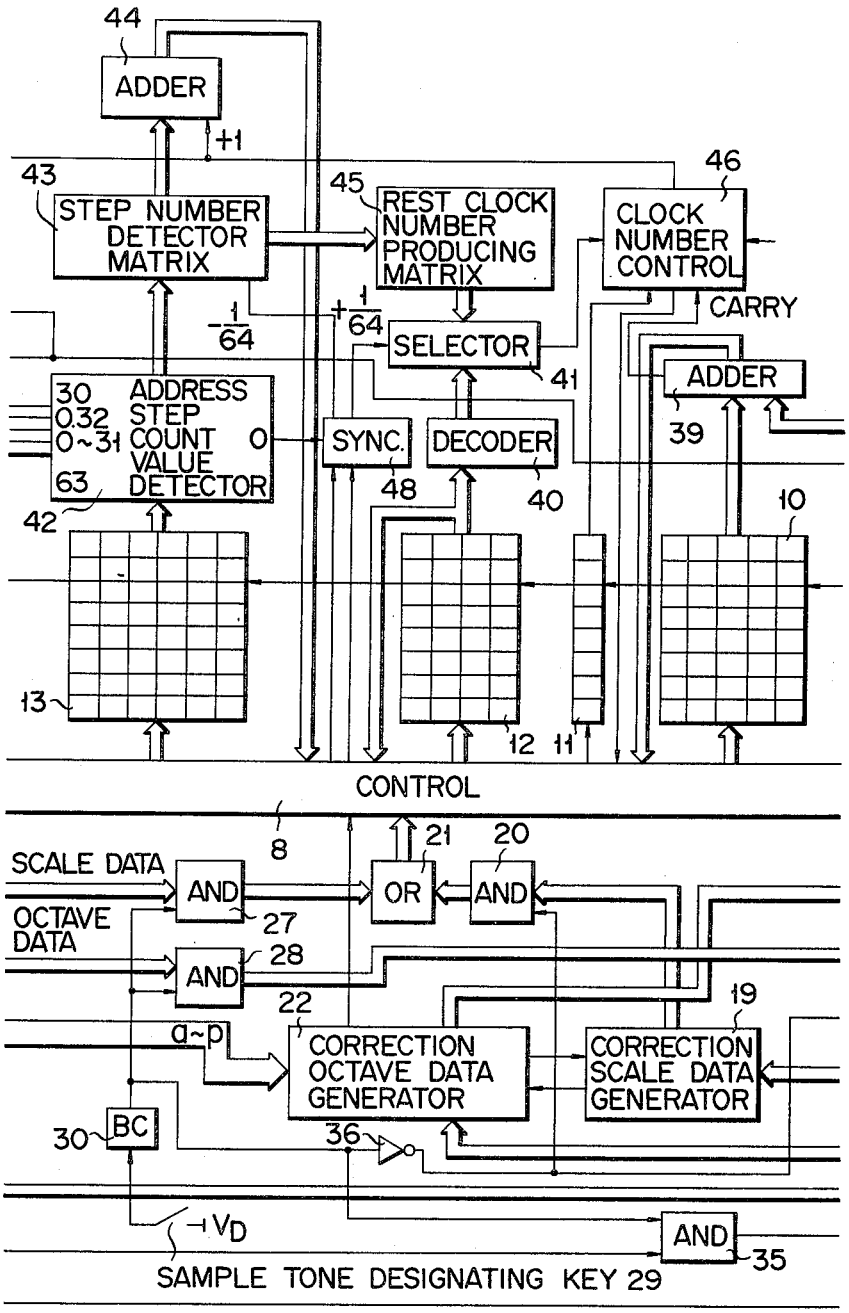
Figure 1C:
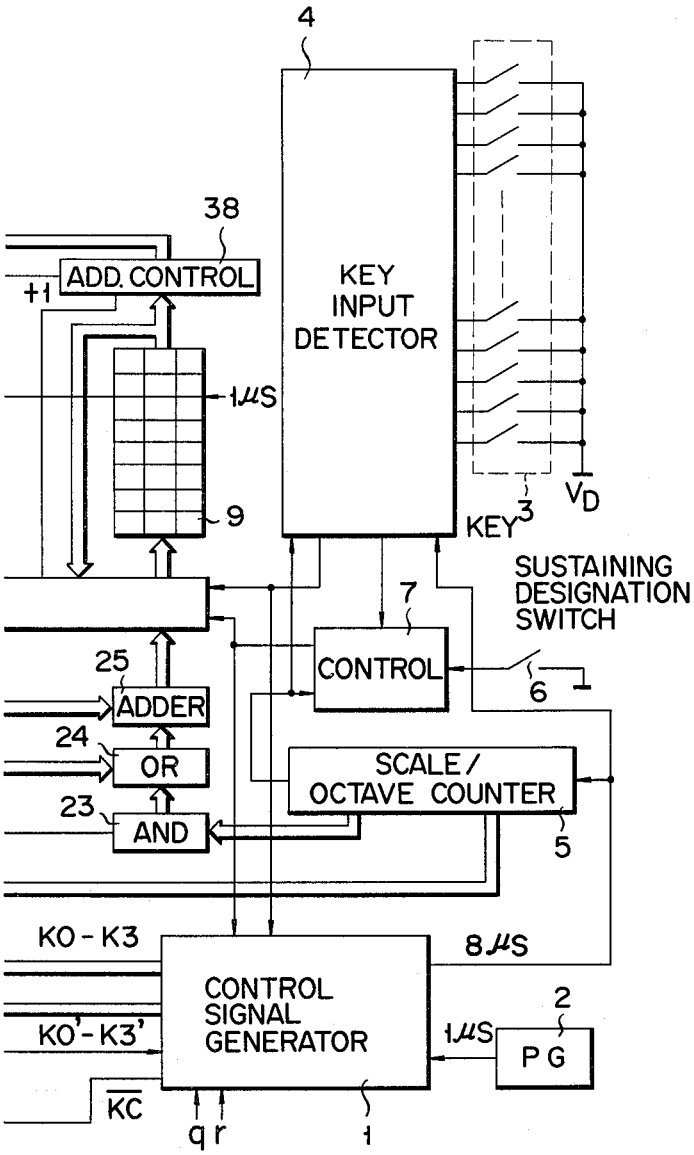
Figure 2:
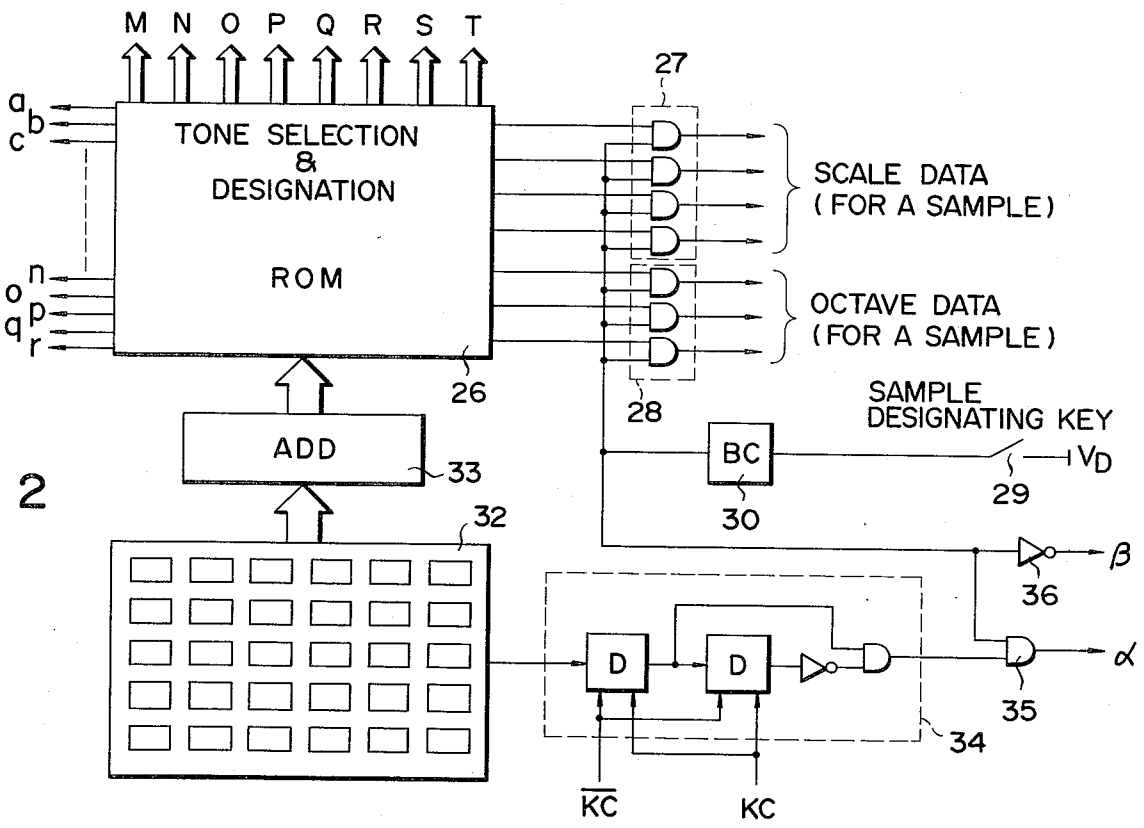
FIG. 2 indicates the musical instrument type-selecting section of FIG. 1.

Scale data obtained from the scale-octave counter 5 is conducted through a correction scale data-generating circuit 19 to an AND circuit 20, one input terminal of which is supplied with a signal for suppressing the generation of the later described sample tones, said scale data is also supplied to the scale-designating data memory 12 in the form of 4-bit parallel data through an OR circuit 21. Octave data is sent forth to an adder 25 together with correction octave data delivered from a correction octave data-generating circuit 22 through an AND circuit 23 whose data operation is controlled by the aforesaid sample tone generation-suppressing signal and an OR circuit 24. 3-bit parallel data delivered from the adder 25 is carried to the octave-specifying data memory 9. The correction scale data-generating circuit 19 and correction octave data-generating circuit 22 are controlled by a combination of multiperformance-specifying signals a to p read out of a musical instrument typeselecting ROM (read-only-memory) 26. Where no instruction is given for the multi-performance, where an instruction is issued for the performance of a duet, and where an instruction is given for the performance of a quartet, the above-mentioned circuits 19, 26 are set for +2, +3, +4 octaves respectively, as compared with the normal octave (referred to as "a 1 octave"). Particularly where the +3 octave is specified, +7 is added to the scale data already produced in the correction scale data-generating circuit 19 to change the normal scale and octave. Signals q, r read out of the ROM 26 used to select a particular type of musical instrument are applied to denote the case where no instruction is given for the multi-performance, the case where an instruction is issued for the performance of a duet, and the case where an instruction is sent forth for the performance of a quartet. Namely, the signal q represents an instruction for a duet. The signal r denotes an instruction for a quartet. Generation of neither q signal nor r signal means that no instruction is given for the multi-performance. The q, r signals are supplied to the control signal-generating circuit 1. Scale data representing a particular pitch and octave data are read out of the ROM 26 used to select a particular type of musical instrument. The scale data is supplied to the OR circuit 21 in the form of 4 parallel-arranged bits through an AND circuit 27. The octave data is conducted to the OR circuit 24 in the form of 3 parallel-arranged bits through an AND circuit 28. The AND circuits 27, 28 are supplied with an instruction for the generation of sample tones when a count outout of [1] is sent forth from a binary counter 30 whose counting operation is reversed, each time a sample tone generation-specifying switch 29 is operated. Therefore, only where the switch 29 is thrown in to instruct the generation of sample tones, then scale data and octave data are produced from the AND circuits 27, 28. The later described tone control signals M, N, O, P, Q, R, S, T are read out of the musical instrument type-selecting ROM 26 to a tone control circuit 31. As shown in FIG. 2, the ROM 26 is accessed by an address signal decoded by an address decoder 33 in response to the operation of a musical instrument type-selecting key included in a musical instrument type-selection input device 32, thereby effecting the issue of a particular one selected from among the tone control signals M to T and multi-performance selecting signals a to p. The musical instrument type selection input device 32 comprises a large number of, for example, touch switches arranged in a matrix array to select a desired one from among a plurality of types of musical instruments by means of the corresponding one of a plurality of selection keys. These selection keys are designed to represent the respective different types of musical instruments. The operated selection key of said input device 32 causes the corresponding address of the ROM 26 to be specified by the address decoder 33. Read out of the ROM 26 are the later described tone control signals M to T, multi-performance-selecting signals a to p, multi-performance instruction signals q, r scale data and octave data in conformity to the operated selection keys of the input device 32. When one of the selection keys is operated, a one-shot type synchronization circuit 34 issues a signal a denoting the result of operating said selection key upon receipt of the later described signal $\overline{Kc'}$. When the sample tone generation-instructing signal is issued, said signal a is conducted to the control signal-generating circuit 1 through an AND circuit 35. A signal suppressing the generation of sample tones which is supplied to the AND circuits 20, 23 is constituted by a signal reversed by an inverter 36 from a count output of [0] from the binary counter 30.

The correction octave data-generating circuit 22 is supplied with a timing signal from the control signal-generating circuit 1 to specify any of the later described line memories K0, K1, K2, K3. The timing signal is issued from the output terminal of the correction octave data-generating circuit 22 to the control circuit 8 according to the specified combined form of octaves, thereby controlling the supply of an input signal to the memories 9, 10, 11, 12, 13, 15, 16, 17. A signal q or r instructing a duet or quartet which is read out of the musical instrument type-selecting ROM 26 is conducted to the control signal generating circuit 1. Where an instruction is given for the performance of a duet, the issue of a timing signal for the reading of the signal q or r is so controlled as to specify two of the line memories corresponding to the memories 9–18 for a signal performance key. In the case of a quartet, the issue of a timing signal is so controlled as to specify four of said line memories. The operation of the tone control circuit 31 is defined by any selected combination of a plurality of tone control signals such as envelope attack time-instructing signals $MI_1$ to $MIV_1$, $MI_2$ to $MIV_2$, release time-instructing signals $NI_1$ to $NIV_1$, $NI_2$ to $NIV_2$, period-instructing signals $OI_1$ to $OIV_1$, $OI_2$ to $OIV_2$, rise difference detection-instructing signals PI to PIV, waveform-instructing signals $QI_1$ to $QIV_1$, $QI_2$ to $QIV_2$, $QI_3$ to $QIV_3$, vibrato-instructing signals RI to RIV, octave change-instructing signals SI to SIV, all being issued with respect to tones I, II, III, IV. The tone control circuit 31 is supplied with time-setting signals issued from a time-measuring circuit 37 for counting signals of an 8-$\mu$s period, and generates clock pulses having various periods. The tone control circuit 31 produces a rise clock signal $\phi S$ for determining a rise time difference; a nonattack signal [0] suppressing the designation of an attack; an attack clock signal $\phi A$ for determining an attack time; a release clock signal $\phi R$ for defining a release time; a period clock signal $\phi T$ for deciding a period; a delay instruction detection signal in case of a multi-performance; a waveform-instructing signal for selecting any of the fixed or floating waveform, rectangular waveform, sawtooth waveform and triangular waveform all used to difine the waveform of a tone; an octave change-instructing signal; and a signal instructing −1/64 or +1/64 to effect a change in the vibrato. All the above listed signals are supplied to the control circuit 8. An octave-specifying data delivered from the adder 25 is stored in the octave-specifying data-memory 9 in the form shifting through the corresponding line memories. An octave-instructing data of 3 bits sent forth from the rearmost line memory is decoded in an addition control circuit 38 in the form corresponding to any of the first to the seventh octaves. The decoded octave-instructing data is conducted to an adder 39, as an instruction for specifying an added value which varies with the respective octaves. Namely, said octave-instructing data is supplied as an instruction for making an addition of +1 for the first octave, +2 for the second octave, +4 for the third octave, +8 for the fourth octave, +16 for the fifth octave, and O for the sixth and seventh octaves. The adder 39 sums up added values for the octaves which are stored in the mmeory sections of the octave bit memory 10 and the memory sections of the octave-specifying data memory 9 in one cycle of operation (in a time of 8 $\mu$ s). A signal denoting said sum is stored in the foremost memory section on the input side of the octave bit memory 10 in the shifting form. At this time, a carry signal associated with the above-mentioned sum is issued. An output signal from the addition control signal is supplied to the adder 39 so as to provide a larger added value for a higher serial position of a specified octave. Accordingly, the period in which a carry signal is sent forth from the adder 39 becomes shorter, according as the specified octave has a higher serial position. As the result, there is produced a signal denoting the frequency of a clock pulse used as a reference for an octave represented by the selected one of the octave-specifying data stored in the octave-specifiying memory 9. The addition control circuit 38 includes an octave shift-up circuit for making a shift-up of +1 (to provide two octaves) with respect to data on the normal 1 octave stored in the octave-specifying data memory 9.

Scale-specifying data stored in the scale-specifying data memory 12 is stored in the shifting form in the foremost memory section on the input side of said scale-specifying data memory 12. An output signal of 4 bits is read out of the rearmost memory section to a scale decoder 40. The 4-bit output signal decoded by said decoder 40 is sent forth to the later described scale clock pulse-selecting circuit 41 through any of 12 output lines corresponding to the 12 scales.

The respective memory sections of the address memory 13 store a counted number of address steps included in one cycle of a tone. With the present embodiment, one cycle of a tone is taken to include 64 steps. The step number of 0 to 63 is expressed by the 10-scale system (in the case of the binary system by 6 bits of "000 000" to "111 111"). A parallel 6-bit signal denoting a step number which is successively issued from the rearmost memory section of the address memory 13 is conducted to an adder 44 through an address step number detection circuit 42 and step number detection matrix circuit 43. The adder 44 sums up the later described pitch clock pulse frequency signals corresponding to pitch data stored in the scale specifying-data memory 12 and octave-specifying data memory 9. A signal denoting said sum is stored in the foremost memory section of the address memory 13 in the shifting form. The pitch clock pulse frequency signal is formed according to the frequency of a carry signal delivered from the adder 39, that is, a signal denoting the octave reference clock pulse frequency. The pitch clock pulse frequency signal is formed by stopping the addition by the adder 44 of the octave reference clock pulse frequency signals and causing the adjacent scale frequencies to bear a ratio of $\sqrt[12]{2}$. Accordingly, it is possible to cary the period (64 steps) of one cycle of a tone with the specified octave data, and pitch data based on scale data. The address step number detection matrix circuit 42 generates a clock pulse for every 1 step, every 2 steps, every 4 steps, every 8 steps, every 16 steps and every 32 steps included in one tone cycle. The respective output clock pulses are combined, as later described, by the stop clock pulse number-generating matrix circuit 45 so as to cause the scale frequencies to bear the ratio of $\sqrt[12]{2}$, and delivered to the 12 output lines corresponding to the 12 scales. One of the 12 output lines of the stop clock pulse-generating matrix circuit 45 is selected by the scale clock pulse-selecting circuit 41 according to a specified scale delivered from the scale decoder 40. An output signal from said selected output line is supplied to a clock pulse number control circuit 46. This clock pulse number control circuit 46 stops under control of the Fa memory 11 the supply of a carry signal issued from the adder 39, that is, an octave reference clock pulse, thereby providing the pitch clock pulse frequency signal which is to be supplied to the adder 44.

The address step number detection matrix circuit 42 detects from the respective memory sections of the address memory 13 a number 8 0] allotted to the foremost address step, a number of [30] allotted to an intermediate address step, a number 8 0] allotted to the foremost address step or a number of [32] allotted to an intermediate address step, numbers of [0] to [31] allotted to the address steps constituting substantially the first half section of one cycle of a tone and a number of [63] allotted to the last address steps. The address step number detection matrix circuit 42 further supplies the 4 intermediate bit output signals of the 6 parallel bit output signals to a comparator 47. A signal showing a number of [0] allotted to the foremost address step is carried to a synchronization circuit 48. At this time, a −1/64 specifying signal issued from the tone control circuit 31 is supplied to the address step number detection matrix circuit 42. A +1/64 specifying signal delivered from said tone control circuit 31 is sent forth to the scale clock pulse-selecting circuit 41. These −1/64 and +1/64 specifying signals are intended to provide the so-called vibrato effect to minutely vary signal frequencies by subtracting 1 from the normal frequencies of the 64 address steps constituting one cycle of a tone or adding 1 to said normal frequencies. A signal denoting a number of 8 0] or [30] allotted to a particular address step which is issued from the step number detection matrix circuit 42, a signal showing a number [30] allotted to a particular address step and signals indicating numbers of [0] to [31] allotted to particular address steps are supplied to a waveform control circuit 49. A signal denoting a number of [63] allotted to the last address steps is delivered to the later described addition-subtraction control circuit 51. The signal showing the number of [63] allotted to the last address step is also supplied to the control unit 8 as a control signal for the Fb memory 14 in order to ensure synchronization between a period clock pulse-specifying signal sent forth from the tone control circuit 31 and one cycle of a tone.

Figure 3:
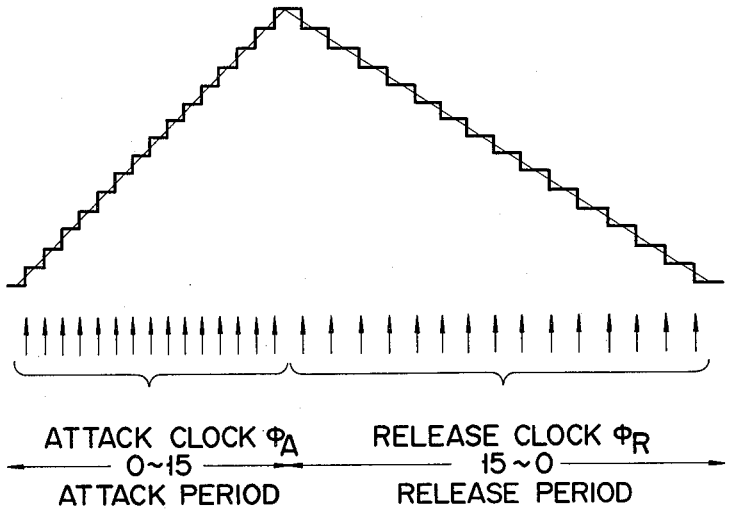
FIG. 3 illustrates an envelope associated with FIGS. 1A to 1C.

The adder 52 adds an attack clock pulse $\phi$A having a period specified by the tone control circuit 31 or a release clock pulse signal $\phi$R which has been received from the addition-subtraction control circuit 51. An output signal from the adder 52 is stored in the foremost line memory of the envelope memory 15 in the form shifting therethrough. At this time, number [0] to [15 ] ([0000] to [1111] as expressed by the binary code) are stored in said foresmost memory of the envelope memory section 15. The numbers stored in the foremost memory section of the envelope meomory 15 are read out of the rearmost section thereof through the envelope value detection circuit 53 to the later described addend value determining circuit 54. With the present embodiment, a tone volume envelope is formed, as illustrated in FIG. 3, of an attack state in which addition is successively made from a number of [0] to that of 15 upon receipt of an attack clock pulse $\phi$A, and a release state in which subtraction is successively made from a number of [15] to a number of [0] upon receipt of a release clock pulse $\phi$R. The result of the above-mentioned addition or subtraction is stored in the memory sections of the envelope memory 15. Where the addition-subtraction control circuit 51 is supplied with a signal showing a maximum attack number of [15] detected by the envelope value detection circuit 53, then an instruction for subtraction is issued to the adder 52, and a signal showing a number of [1] is stored in the Fe memory 18, thereby causing the tone volume envelope to be set at the release state. Under this condition, subtraction is successively carried out from the maximum envelope number of [15 ] upon receipt of the release clock pulse signal $\phi R$, until a number of [0] is detected by the envelope value detection circuit 53. The Fc memory 16 is controlled by an output signal from the address step number detection circuit 42 which shows a number of [63] in order to ensure synchronization between a timing signal for addition or subtraction in the adder 46 of the attack clock pulse $\phi A$ of the tone volume envelope or the release clock pulse $\phi R$ thereof and one cycle of a tone. The Fd memory 17 is supplied with a signal denoting a number of [1] to match the operating memory section of the envelope memory 15. The Fd memory 17 is controlled, as later described, particularly by a delay-instructing signal delivered from the tone control circuit 31 and rise clock pulse $\phi S$.

Figure 4A:
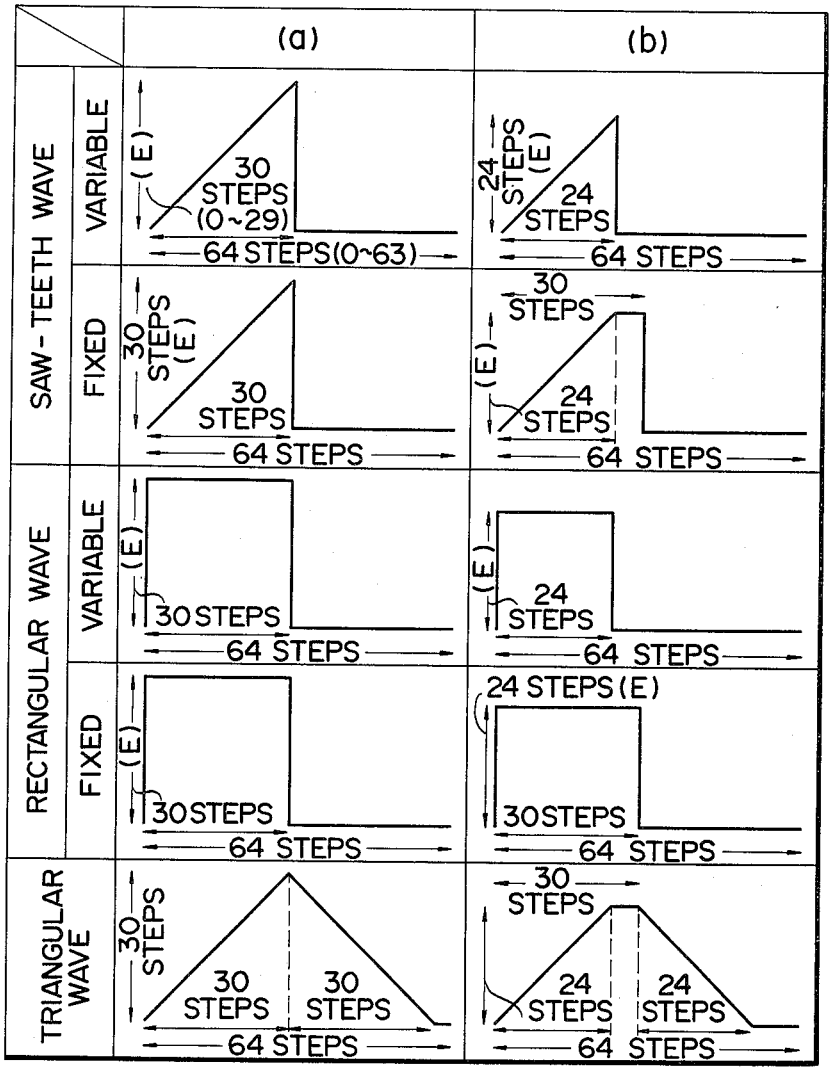
FIGS. 4A and 4B show the waveforms of various tones.
Figure 4B:
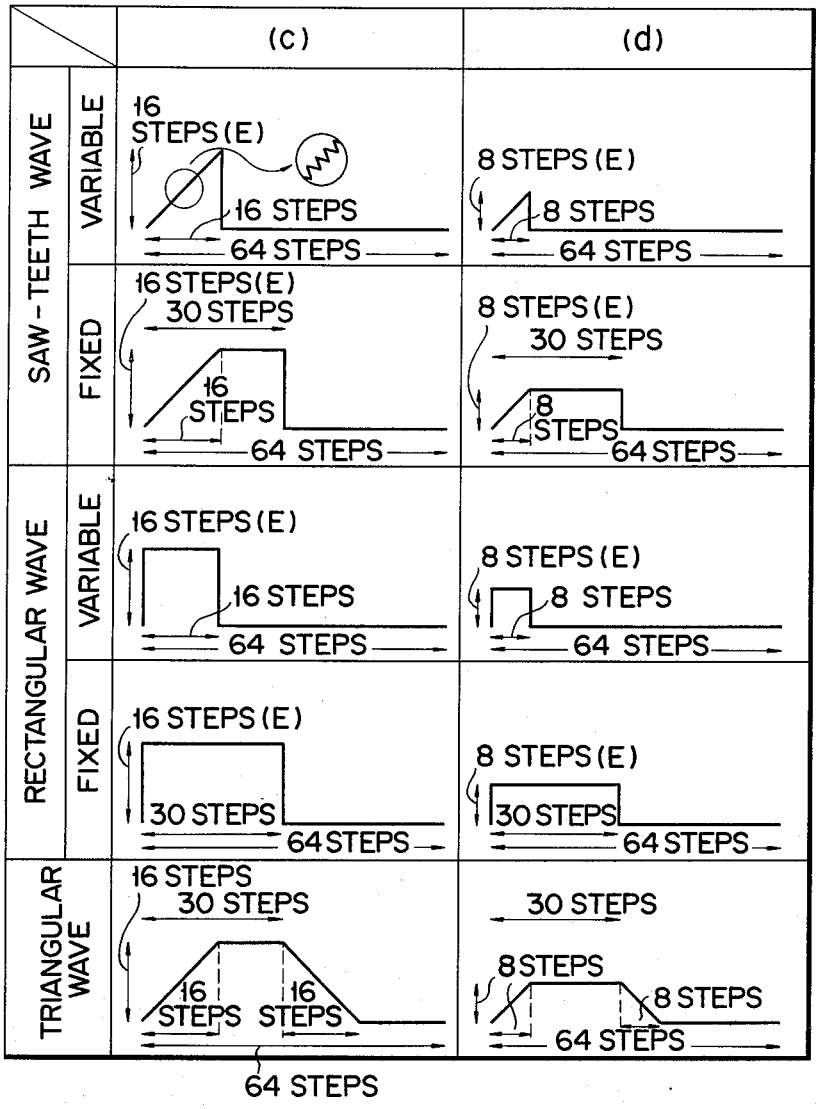

An output signal from the rearmost memory section of the envelope memory 15 is also supplied to the comparator 47, which makes a comparison between the binary codes of the respective intermediate 4 bits of an output signal from the address memory 13 and the respective 4 bits of an output signal from the envelope memory 15. The comparator 47 generates according to the result of comparison a signal denoting a complete binary code coincidence between both groups of 4-bit signals or between the former or latter half bit signals of said groups. These coincidence signals are conducted to the waveform control circuit 49, which in turn sends forth a signal showing an address step number of [30], a signal showing an address step number of [0], a signal denoting a binary code coincidence between the above-mentioned two groups of 4-bit signals, and a signal indicating a binary code coincidence between the former or latter half section of said two 4-bit signal groups. All those detection signals are conducted to the addition control circuit 50, which is also supplied with a fixation instruction (to be described below) to specify tone waveforms, rectangular wave-specifying instruction and triangular wave-specifying instruction, all delivered from the tone control circuit 31. According to the present embodiment, tone waveforms comprise, as illustrated in FIG. 4, three kinds: the sawtooth waveform, rectangular waveform and triangular waveform. An instruction is sometimes given to specify the floating or fixed type (fixation instruction) of both sawtooth and rectangular waveforms. The floating waveform is herein defined to mean the type in which an address step number is not fixed when the waveform falls, namely, the width of an amplitude pulse varies. The fixed waveform is herein defined to denote the type in which an address step number is fixed (at [30] in this case), namely, the type in which the width by an amplitude pulse is fixed, and the apical portion is cut according to a tone volume control value read out of the envelope memory 15. The triangular waveform is always fixed. The addition control circuit 50 comprises a matrix circuit by which a fixation instruction, floatation instruction (in the absence of said fixation instruction), rectangular wave-specifying instruction, triangular wave-specifying instruction and sawtooth wave-specifying instruction (in the absence of the rectangular wave-specifying instruction and triangular wave-specifying instruction) are suitably combined with the aforesaid detection signals supplied from the waveform control circuit 49. An E-specifying instruction and a +1-specifying instruction are issued from the output terminal of said matrix circuit to the addend value-determining circuit 54. A subtraction instruction is delivered from said matrix circuit to the adder 55 acting as a counter for counting a number allotted to an output waveform. A 7th octave-specifying instruction stored in the octave-specifying data memory 9 is conducted through the addition control circuit 38 to the waveform control circuit 49 and addition control circuit 50. The addend value-determining circuit 54 supplies to the adder 55 an envelope number stored in the envelope memory 15 which corresponds to an instruction given from the addition control circuit 50 according to a tone waveform and a signal denoting a pitch clock pulse frequency in synchronization with these signals. As seen from FIG. 4, therefore, a tone waveform represented by a signal generated from the adder 55 which is controlled for each line memory indicates a relatively wide variation, according as a tone volume progressively increases as (a)→(c)→(b)→(a) in the case of the attack state of the envelope. Conversely in the case of the release state thereof, a tone waveform shows a relatively small variation, according as a tone volume gradually decreases as (a)→(b)→(c)→(d). These changes in the tone waveform arise in the respectively line memories.

An output signal from the adder 55 is fed back thereto as a value of addition through an output control circuit 56 in synchronization with a pitch clock pulse frequency signal. An output signal from the output control circuit 56 is issued as a pitch tone from a loud-speaker 59 through a digital-analog converter 57 and amplifier 58.

An attack-specifying instruction M, release-specifying instruction N and period-specifying instruction O, all of the 4-bit type, are read out of the musical instrument type-selecting ROM 26. These instruction signals M, N, O, cause output signals $I_1$ to $IV_1$, $I_2$ to $IV_2$ (FIG. 5) to be sent forth from a decoder (not shown) included in the tone control circuit 31. Output signals $I_1$ to $IV_1$ based on the attack instruction M are supplied to one of the input terminals of each of AND gates 31-1 to 31-4. Output signals $I_2$ to $IV_2$ based on the attack instruction M are conducted to one of the input terminals of each of AND gates 31-5 to 31-8. Output signals $I_1$ to $IV_1$ based on the release instruction N are sent forth to one of the input terminals of each of AND gates 31-10 to 31-13. Output signals $I_2$ to $IV_2$ based on the release instruction N are carried to one of the input terminals of each of AND gates 31-14 to 31-17. Output signals $I_1$ to $IV_2$ based on the period-specifying instruction O are delivered to one of the input terminals of each of AND gates 31-18 to 31-21. Output signals $I_2$ to $IV_2$ based the period-specifying instruction are transmitted to one of the input terminals of AND gates 31-22 to 31-25. The other input terminal of each of the AND gates 31-1, 31-5, 31-10, 31-14, 31-18, 31-22 is supplied with a control signal $K_0'$ issued from the control signal-generating circuit 1. The other input terminal of each of the AND gates 31-2, 31-6, 31-11, 31-15, 31-19, 31-23 is supplied with a control signal $K_1'$ obtained from said control signal-generating circuit 1. The other input terminal of each of the AND gates 31-3, 31-7, 31-12, 31-16, 31-20, 31-24 receives a control signal $K_2'$ from said control signal-generating circuit 1. The other input terminal of the AND gates 31-4, 31-8, 31-13, 31-17, 31-21, 31-25 receives a control signal $K_3'$ from said control signal-generating circuit 1. The AND gates 31-1 to 31-4 are connected to an OR gate 31-26. The AND gates 31-5 to 31-8 are connected to an OR gate 31-27. Where the OR gates 31-26, 31-27 are jointly operated to produce an output signal, a prescribed attack clock pulse $\phi A$ delivered from the time-measuring circuit 37 is drawn off through an attack decoder (not shown). The AND gates 31-10 to 31-13 are connected to an OR gate 31-28. The AND gates 31-14 to 31-17 are connected to an OR gate 31-29. Where the OR gates 31-28 31-29 are jointly operated to produce an output signal, then a clock pulse $\phi R$ sent forth from the time-measuring circuit 37 is drawn off through a release decoder (not shown). The AND gates 31-18 to 31-21 are connected to an OR gate 31-30. The AND gates 31-22 to 31-25 are connected to an OR gate 31-31. Where the OR gates 31-30, 31-31 are jointly operated to generate an output signal, then a period clock pulse $\phi T$ delivered from the time-measuring circuit 37 is issued through a period decoder (not shown). The control signals $K_0'$, $K_1'$, $K_2'$, $K_3'$ respectively correspond to the line memories k0(k4), K1(k5), k2(k6), k3(k7). Therefore, the different contents of the attack-specifying instruction, release-specifying instruction and period-specifying instruction can be stored in the line memories corresponding to said contents in accordance with the manner in which these instruction signals are stored in the musical instrument type-selecting ROM 26.

Figure 6:
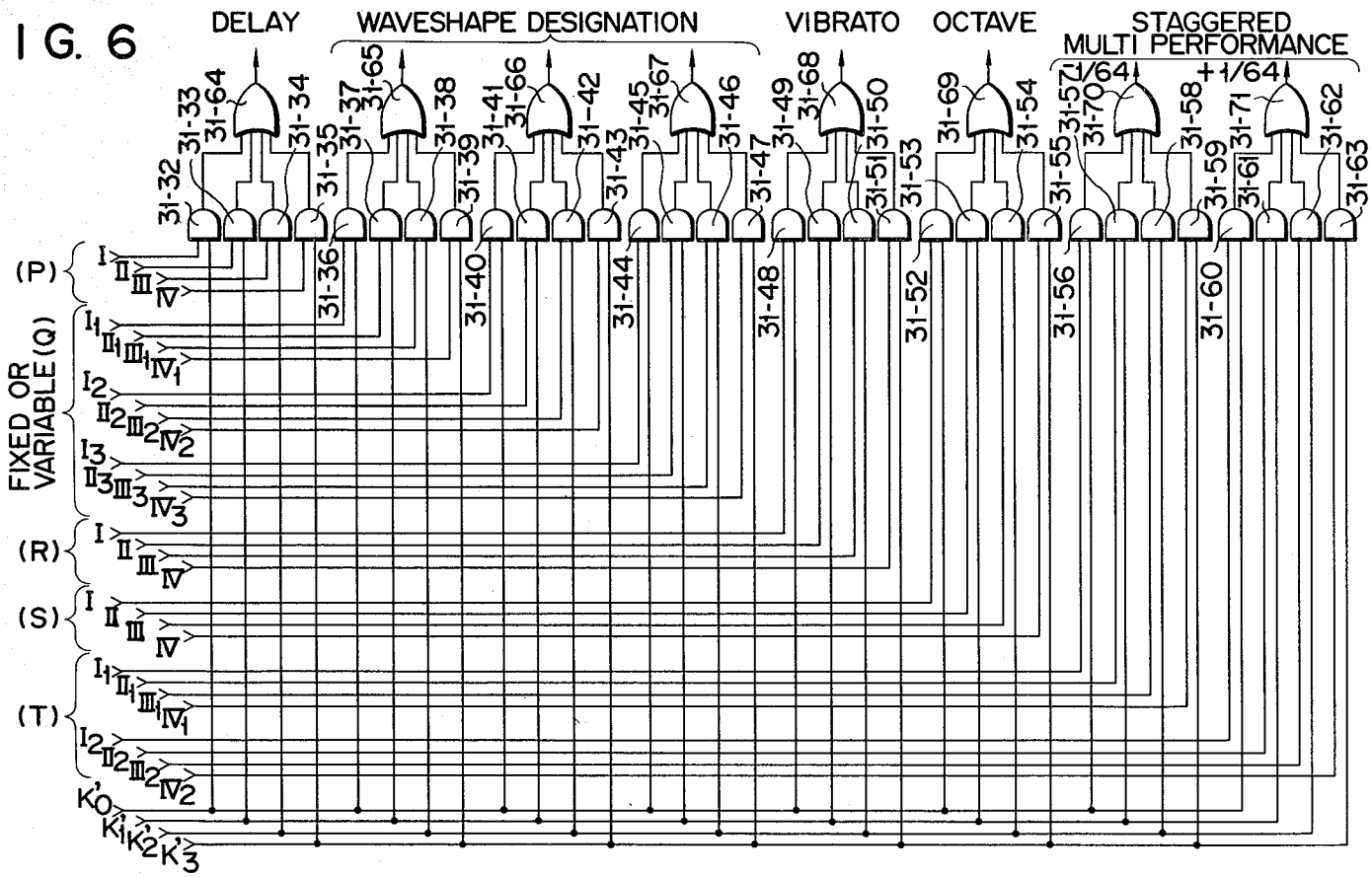

Referring to FIG. 6, a rise difference detection-specifying instruction P, waveform-specifying instruction Q, vibrato-specifying instruction R, octave change-specifying instruction S and multi-performance minute difference detection-specifying instruction T are issued through a decoder (not shown). Output signals I to IV based on the rise difference detection-specifying instruction P are supplied to one of the input terminals of each of AND gates 31-32 to 31-35. With respect to output signals based on the waveform-specifying instruction Q, output signals $I_1$ to $IV_2$ instructing a distinction between the fixed and floating types of waveform are supplied to one of the input terminals of each of AND gates 31-36 to 31-39. Output signals $I_2$ to $IV_2$ specifying a triangular waveform are delivered to one of the input terminals of each of AND gates 31-40 to 31-43. Output signals $I_3$ to $IV_3$ specifying a sawtooth or rectangular wave are conducted to one of the input terminals of each of AND circuits 31-44 to 31-47. Output signals based on the vibrato-specifying instruction R are sent forth to one of the input terminals of each of AND gates 31-48 to 31-51. Output signals I to IV based on the octave change-specifying instruction S are carried to one of the input terminals of each of AND circuits 31-52 to 31-55. Output signals $I_1$ to $IV_1$ based on the multi-performance minute difference detection-specifying instruction T are delivered to one of the input terminals of each of AND gates 31-56 to 31-59. Output signals $I_2$ to $IV_2$ based on said instruction T are transmitted to one of the input terminals of each of AND gates 31-60 to 31-63. A control signal $K_0'$ is conducted to the other input terminals of each of the AND gates 31-32, 31-36, 31-40, 31-44, 31-48, 31-52, 31-56, 31-60. A control signal $K_1'$ is supplied to the other input terminal of each of the AND gates 31-33, 31-37, 31-41, 31-45, 31-49, 31-53, 31-57, 31-61. A control signal $K_2'$ is delivered to the other input terminal of each of the AND gates 31-34, 31-38, 31-42, 31-46, 31-50, 31-54, 31-58, 31-62. A control signal $K_3'$ is sent forth to the other input terminal of each of the AND gates 31-35, 31-39, 31-43, 31-47, 31-51, 31-55, 31-63. Output signals from the AND gates 31-32 to 31-35 are issued through an OR gate 31-64 to act as a rise difference (delay time t) specifying instruction. Output signals from the AND gates 31-36 to 31-39 are drawn off through an OR gate 31-65 to act as a signal instructing a distinction between the fixed and floating types of waveform. Output signals from the AND gates 31-40 to 31-43 are sent forth through an OR gate 31-66 to act as signals specifying any of the standard waveforms (triangular, rectangular and sawtooth waveforms). Output signals from the AND gates 31-44 to 31- 47 are issued from an OR gate 31-67 to serve the same purpose. Output signals from the AND gates 31-48 to 31-51 are delivered through an OR gate 31-68 to act as signals instructing the vibrato of $-1/64$. Output signals from the AND gates 31-52 to 31-55 are generated through an OR gate 31-69 to act as signals instructing an octave change. Output signals from the AND gates 31-56 to 31-59 are produced through an OR gate 31-70 to act as signals instructing multi-performance minute difference of $-1/64$. Output signals from the AND gates 31-60 to 31-63 are issued through an OR gate 31-71 to act as signals instructing multi-performance minute differnce of $+1/64$. Output signals from the above-mentioned AND gates 31-32 to 31-63 are issued in sunchronization with the control signals $K_0'$, $K_1'$, $K_2'$, $K_3'$ in accordance with the various instruction signals supplied to the musical instrument type-selecting ROM 26 in matrix array. Four control signals $K_0'$, $K_1'$, $K_2'$, $K_3'$, control the operation of seven line memories k0 to k7.

Figure 7:
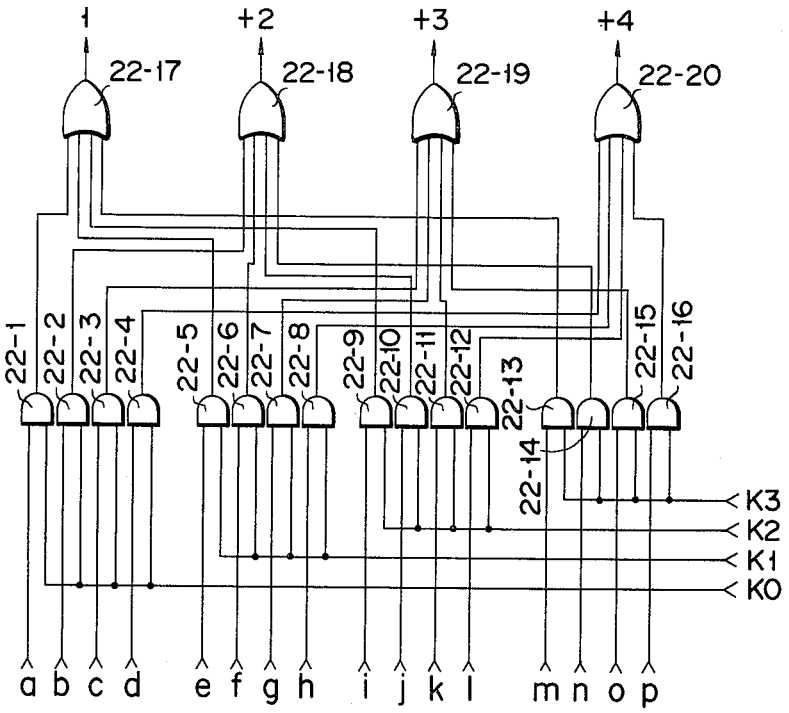

FIG. 7 shows a correction octave data-specifying instruction generator which produces an instruction for the multi- performance by combination of octaves in response to multi-performance-specifying signals a to b read out of the musical instrument type selecting ROM 26. Signals instructing the issue of the multi-performance-specifying signals a to p are respectively supplied to one of the input terminals of each of AND gates 22-1 to 22-16. Control signals $K_0'$, $K_1'$, $K_2'$, $K_3'$ delivered from the control signal-generating circuit 1 are supplied to four groups of AND gates 22-1 to 22-4, 22-5 to 22-8, 22-9 to 22-12, 22-13 to 22-16. Output signals from the AND gates 22-1, 22-5, 22-9, 22-13 are sent forth to an OR gate 22-17. Output signals from the AND gates 22-2, 22-6, 22-10, 22-14 are supplied to an OR gate 22-18. Output signals from the AND gates 22-3, 22-7, 22-11, 22-15 are conducted to an OR gate 22-19. Output signals from the AND gates 22-4, 22-8, 22-12, 22-16 are issued to an OR gate 22-20. An instruction specifying the normal 1 octave is issued from the OR gate 22-17; an instruction specifying the +2 octaves from the OR gate 22-18; and an instruction specifying the +4 octaves from the OR gate 22-20.

The musical instrument type-selecting ROM 26 can store signals denoting scores of types of tones in accordance with a number of keys provided for an electronic musical instrument. Namely, the present electronic musical instrument can generate 4 types of tones regarding the attack; 4 types of tones regarding the release; 4 types of tones regarding the period; two types of tones regarding the provision of a rise difference and the absence there of; two types of tones regarding the fixed and floating patterns of waveforms; three types of tones corresponding to the three standard waveforms; two types of tones regarding the generation of the vibrato and the absence thereof; two types of tones regarding the octave change and absence thereof; two types of tones regarding the issue of a signal instructing a multi-performance minute difference of $+1/64$ and the nonissue thereof; two types of tones regarding the issue of a signal instructing a multi-performance minute of $-1/64$ and the nonissue thereof; and four types of tones regarding the designation of the +1, +2, +3, +4 octaves corresponding to the nonoperation of a multi-performance, the performance of a duet, and the performance of a quartet. The above-mentioned types of tones can be further increased in number by combinations thereof. The prescribed ones of the above-listed types of tones are stored in the musical instrument type-selecting ROM 26 in the form of a program, and selectively generated by operation of the associated keys.

Where, before a performance, a sample tone generation-specifying key or binary counter 30 is set for operation and a particular key included in the musical instrument type selection input device 32 is depressed, then the resultant signal is supplied to the control signal-generating circuit 1 through the one-shot type synchronization circuit 34. At this time, the address decoder 33 specifies that address of the musical instrument type-selecting ROM 26 which corresponds to the aforesaid depressed particular key. Accordingly, the selected one of the tone control instructions M to T and the selected one of the multi-performance-specifying instructions a to p are read out of the ROM 26. Further, data on the prescribed scale and data on the selected octave are also read out through the corresponding AND circuits 27, 28. The data on the scale and octave is supplied to the octave memory 9 and scale memory 12 respectively through the corresponding OR circuits 21, 24 in synchronization with a key-on signal. Tones representing a particular pitch data are controlled in accordance with the tone control instructions M to T and multi-performance-specifying instructions a to p read out of the ROM 26, thereby producing sample tones. The generation of sample tones is carried out, each time a particular key is selectively operated.

For commencement of a normal performance, the sample tone generation-specifying key 29 is released, and consequently the AND circuits 27, 28 remain closed, preventing signals denoting scale data and octave data from being generated. During the performance, therefore, sample tones are not produced even when a musical instrument-type selecting key is depressed. However, control is effected by the tone control instructions M to T and multi-performance-specifying instructions a to p. If, therefore a particular key included in the musical instrument type selection input device 32 is selectively operated during the performance, then tones now being generated can be changed into those belonging to another type of musical instrument.

Figures 1, 8B:
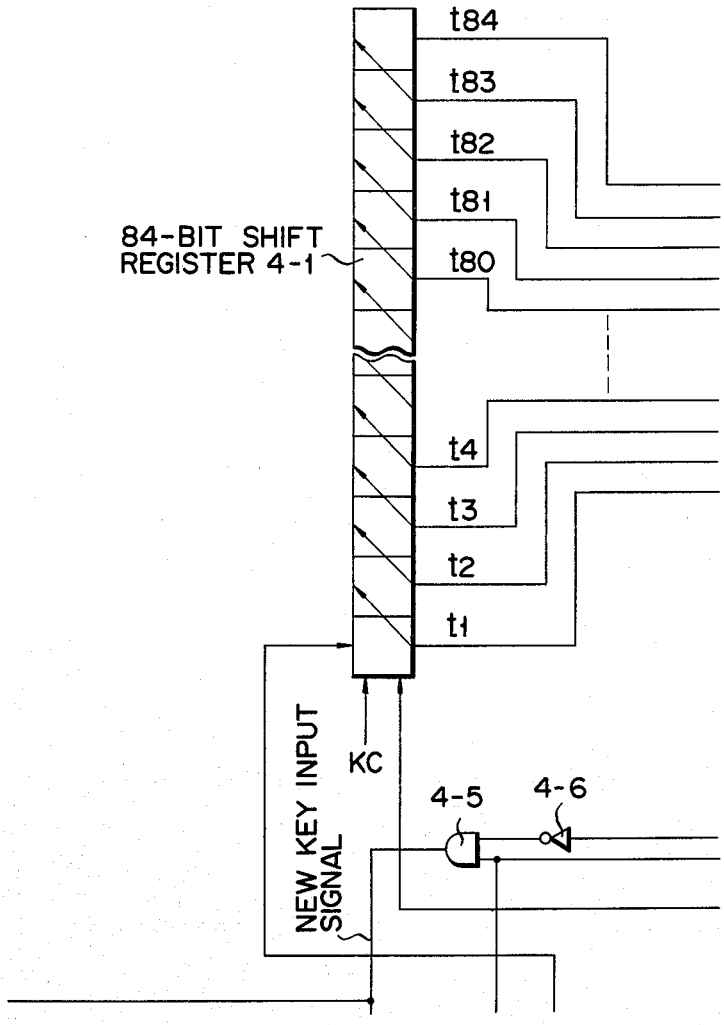
Figures 2, 8B:
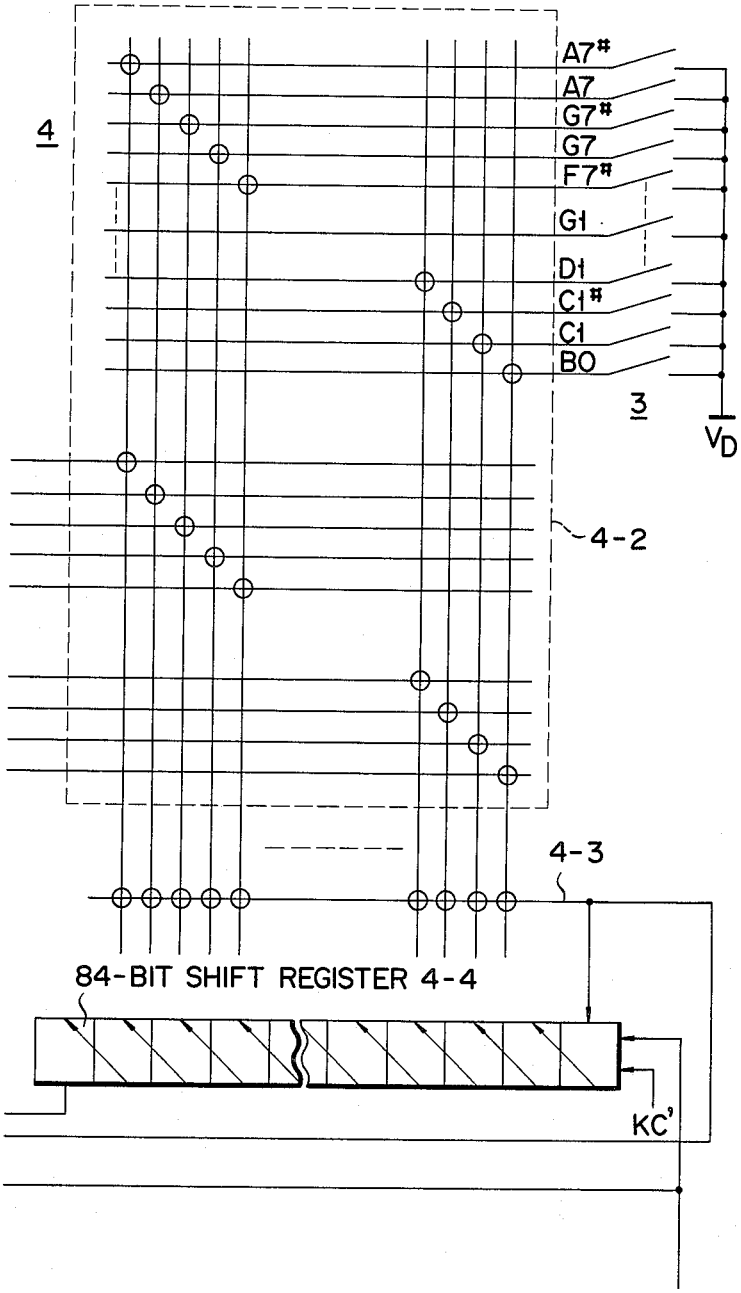
Figure 9:
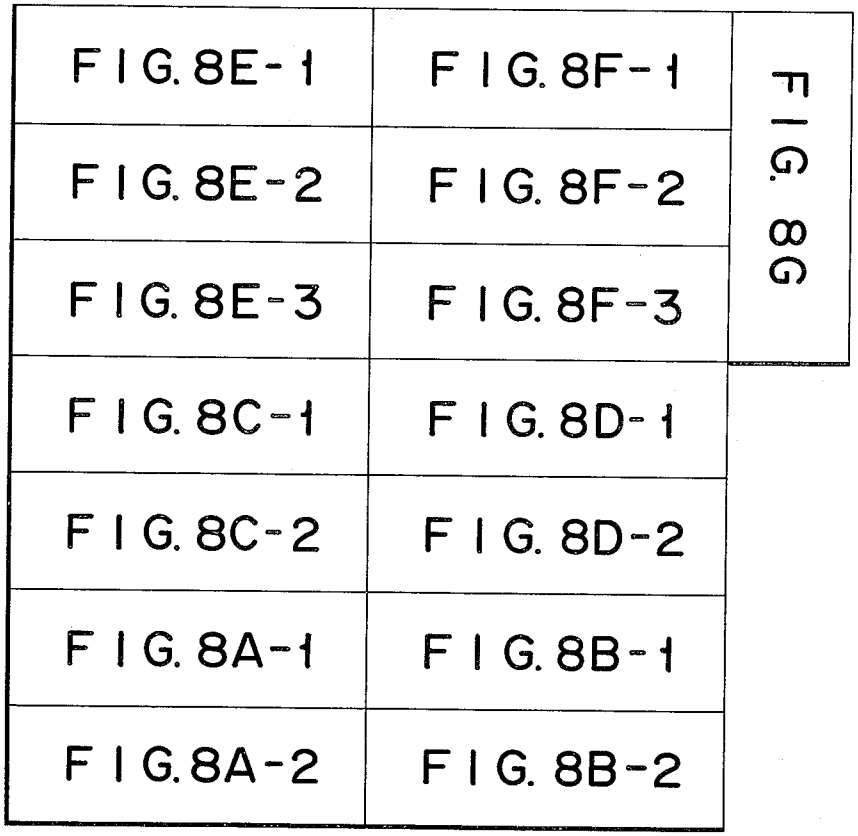
FIG. 9 sets forth the pattern in which the various portions of the electronic musical instrument of FIGS. 1A to 1C represented by FIGS. 8A-1, 8A-2, 8B-1, 8B-2, 8C-1, 8C-2, 8D-1, 8D-2, 8E-1, 8E-2, 8E-3, 8F-1, 8F-2, 8F-3 and 8F are connected.
Figure 10:
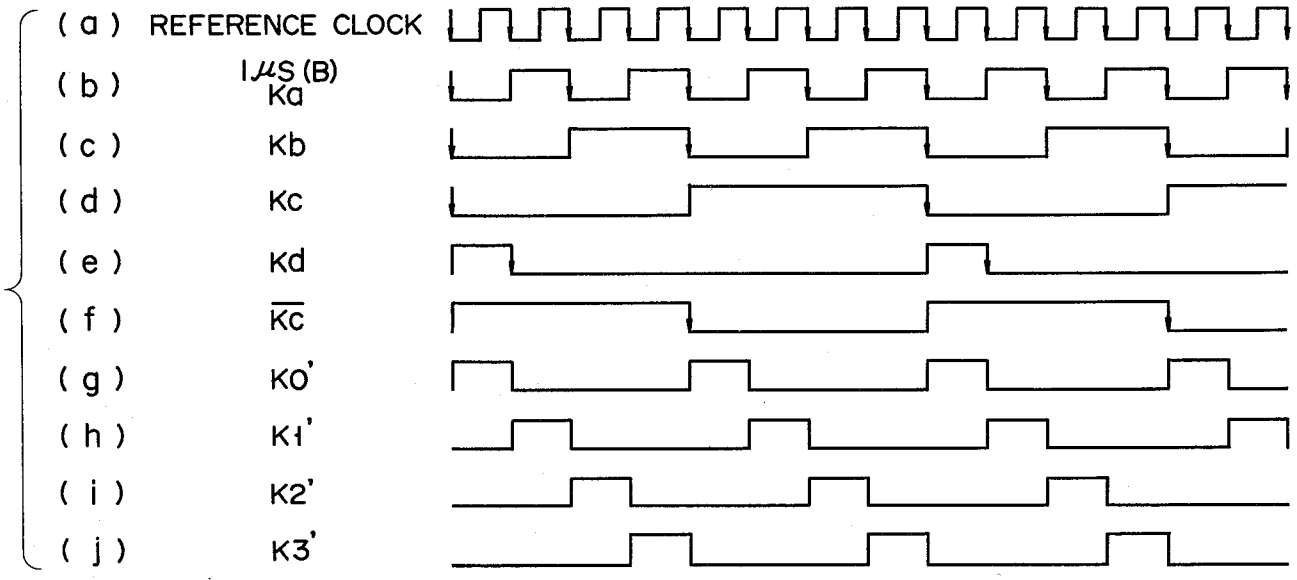
FIG. 10 is a time chart constituting the base on which various control signals shown in FIGS. 8A-1, 8A-2, are formed.

There will now be described the embodiment of FIG. 1 by reference to the concrete circuit arrangements of the various sections thereof shown in FIGS. 8A-1, 8A-2, 8B-1, 8B-2, . . . 8G. These sections are connected as illustrated in FIG. 9. Referring to FIGS. 8A-1, 8A-2, referential clock pulses B [FIG. 10(*a*)] each having a period of 1 microsecond which are issued from a pulse generator 2 are counted by a 3-bit binary counter 1-1. A control clock pulse Ka having a period of 2 microseconds, a control clock pulse Kb having a period of 4 microseconds, and a control clock pulse Kc having a period of 8 microseconds are issued from the respective bit positions as shown in FIG. 10 (*b*), (*c*), (*d*). The control clock pulses Ka, Kb, Kc and control clock pulses $\overline{Ka}$, $\overline{Kb}$, $\overline{Kc}$ passing through the corresponding inverters 1-2, 1-3, 1-4 are conducted to an AND matrix array circuit 1-5. Read out of said AND matrix array circuit 1-5 are a control pulse Kd [FIG. 10(*e*)], a control clock pulse $\overline{Kc}$ [FIG. 10(*f*)] and control clock pulses $K_0'$, $K_1'$, $K_2'$, $K_3'$ [(*g*) to (*j*) in FIG. 10].

Figure 11:
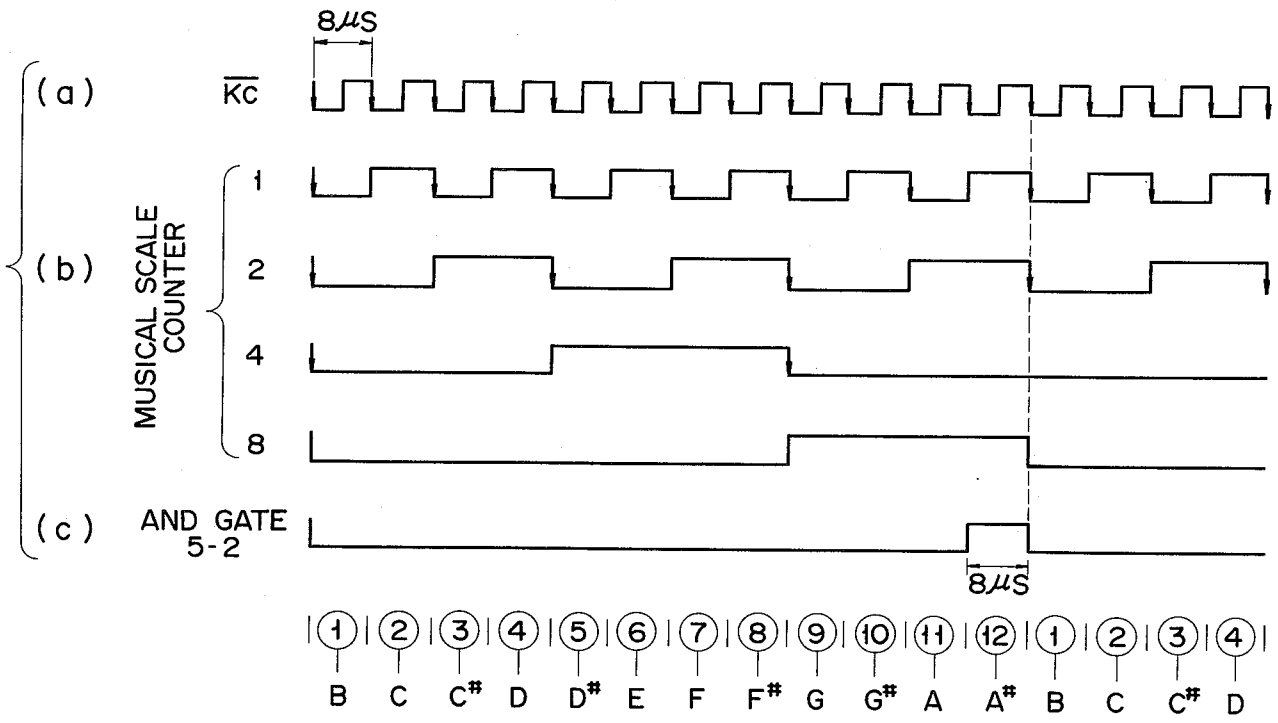
FIG. 11 is a time chart of a signal operated in a scale counter shown in FIG. 8A-2.

A 4-bit 12-scale binary tone scale counter 5-1 counts a number of the control clock pulses $\overline{Kc}$ issued. 12 control clock pulses $\overline{Kc}$ counted by the 4-bit 12-scale binary tone scale counter 5-1 denote, as shown in FIG. 11 (*b*), the 12 tone scales given in Table 1 below.

TABLE 1

| | Name of tone scale | Tone scale counter (5-1) 1 | 2 | 4 | 8 |
|---|---|---|---|---|---|
| 1 | B | 0 | 0 | 0 | 0 |
| 2 | C | 1 | 0 | 0 | 0 |
| 3 | C# | 0 | 1 | 0 | 0 |
| 4 | D | 1 | 1 | 0 | 0 |
| 5 | D# | 0 | 0 | 1 | 0 |
| 6 | E | 1 | 0 | 1 | 0 |
| 7 | F | 0 | 1 | 1 | 0 |
| 8 | F# | 1 | 1 | 1 | 0 |
| 9 | G | 0 | 0 | 0 | 1 |
| 10 | G# | 1 | 0 | 0 | 1 |
| 11 | A | 0 | 1 | 0 | 1 |
| 12 | A# | 1 | 1 | 0 | 1 |

Output bits having 1, 2, 8 weights respectively are conducted to an AND gate 5-2. A fall signal [FIG. 11(*c*)] delivered from the AND gate 5-2 clears the tone scale counter 5-1, and is supplied to an octave counter 5-3 as a count advance signal. This octave counter 5-3 is a 3-bit 7-scale binary counter. Output signals from the respective bit positions are transmitted to an AND gate 5-4. An output signal [FIG. 12(*c*)] from the AND gate 5-4 is delivered to the octave counter 5-3 as an instruction for the loading of a number of [1]. Output signals [FIG. 12(*b*)] from the respective bit positions of the octave counter 5-4 denote 7 octave data given in Table 2 below.

TABLE 2

| | Name of octaves | Octave counter (5-3) 1 | 2 | 4 |
|---|---|---|---|---|
| 1 | 1st octave | 1 | 0 | 0 |
| 2 | 2nd octave | 0 | 1 | 0 |
| 3 | 3rd octave | 1 | 1 | 0 |
| 4 | 4th octave | 0 | 0 | 1 |
| 5 | 5th octave | 1 | 0 | 1 |
| 6 | 6th octave | 0 | 1 | 1 |
| 7 | 7th octave | 1 | 1 | 1 |

Figure 12:
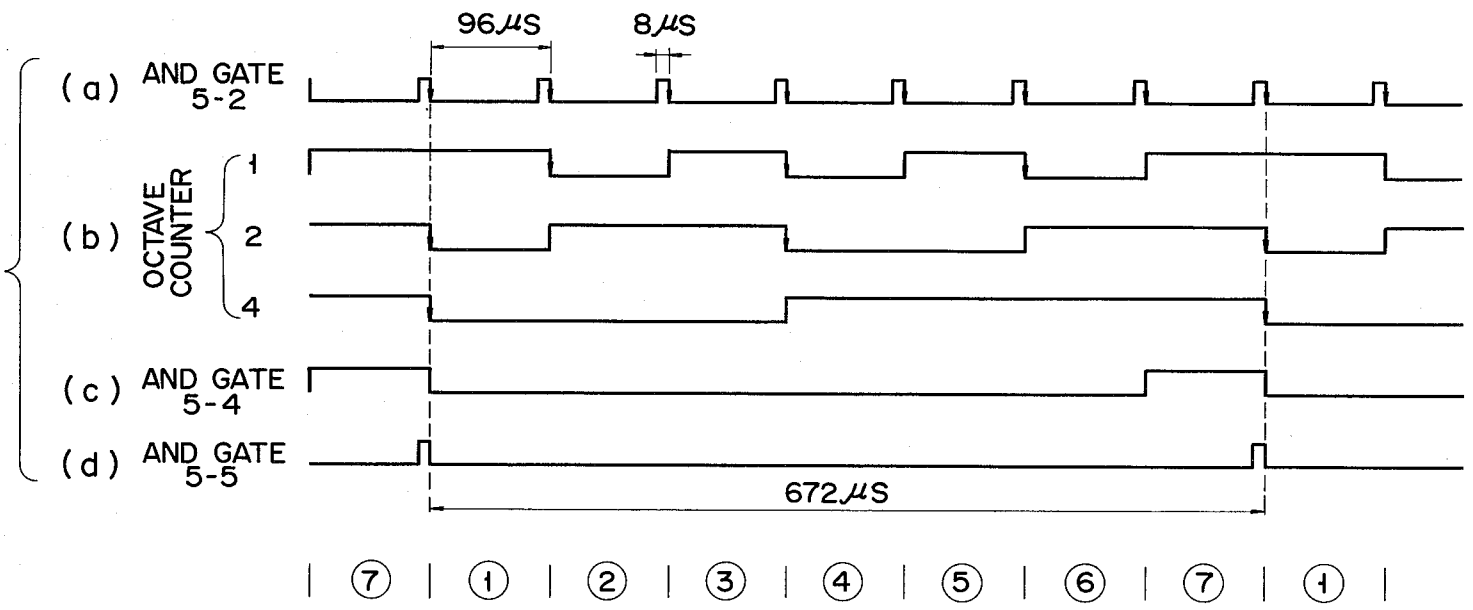
FIG. 12 is a time chart of a signal operated in an octave counter of FIG. 8A-1.
Figure 13:
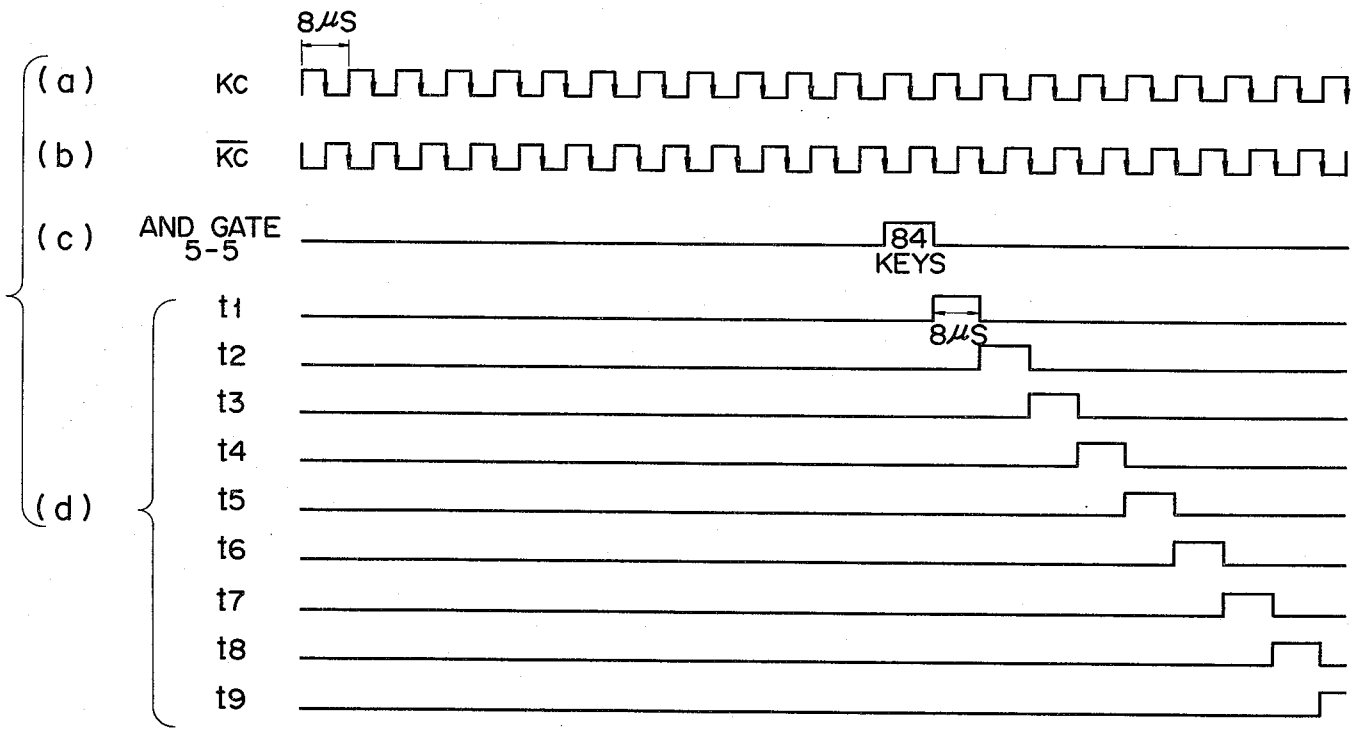
FIG. 13 is a time chart of the circuits of FIGS. 8B-1, 8B-2 for detecting the supply of input signals from the performance keys.

Output signals from the AND gate 5-4 and output signals from the AND gate 5-2 are carried to an AND gate 5-5, from which there are issued output signals [FIG. 12(*d*)] corresponding to the tone scale, and the final count [84] made by the octave counters 5-1, 5-3. Output signals from the AND gate 55 constitute input signals [FIG. 13(*c*)] to an 84-bit shift register 4-1 included in an input detection circuit 4 [FIG. 8(B)]. The input signals are shifted in synchronization with a read-out pulse signal Kc [FIG. 13(*a*)] and a write-in pulse signal $\overline{Kc}$ [FIG. 13(*b*)]. As the result, timing signals $t_1$ to $t_{84}$ [FIG. 13(*d*)] are generated for selective scanning of the performance keys. The performance key group 3 of FIGS. 8B-1 8B-2 comprises 84 performance keys and pitch keys corresponding to the 7 octaves of the 84 keys $B_0$, $C_1$, . . . $A_7$, $A_{7\#}$. Tone signals corresponding to the respective performance keys are selectively drawn out of an AND gate matrix array circuit 4-2 which is successively scanned by the timing signals $t_1$ to $t_{84}$ read out of the shift register 4-1. Table 3 below indicates relationship between the timing signals $t_1$ to $t_{84}$, scale names of performance keys, data counted by the scale counter 5-1 and data counted by the octave counter 5-3.

TABLE 3

| 1st Octave | | | | | | | | | 2nd Octave | | | | | | | | |
|---|---|---|---|---|---|---|---|---|---|---|---|---|---|---|---|---|---|
| | Scale | Scale counter | | | | Octave counter | | | | Scale | Scale counter | | | | Octave counter | | |
| Timing | name | 1 | 2 | 4 | 8 | 1 | 2 | 4 | Timing | name | 1 | 2 | 4 | 8 | 1 | 2 | 4 |
| t1 | B0 | 0 | 0 | 0 | 0 | | | | t13 | B1 | 0 | 0 | 0 | 0 | | | |
| t2 | C1 | 1 | 0 | 0 | 0 | | | | t14 | C2 | 1 | 0 | 0 | 0 | | | |
| t3 | C1# | 0 | 1 | 0 | 0 | | | | t15 | C2# | 0 | 1 | 0 | 0 | | | |
| t4 | D1 | 1 | 1 | 0 | 0 | | | | t16 | D2 | 1 | 1 | 0 | 0 | | | |
| t5 | D1# | 0 | 0 | 1 | 0 | | | | t17 | D2# | 0 | 0 | 1 | 0 | | | |
| t6 | E1 | 1 | 0 | 1 | 0 | | | | t18 | E2 | 1 | 0 | 1 | 0 | | | |
| t7 | F1 | 0 | 1 | 1 | 0 | 1 | 0 | 0 | t19 | F2 | 0 | 1 | 1 | 0 | 0 | 1 | 0 |
| t8 | F1# | 1 | 1 | 1 | 0 | | | | t20 | F2# | 1 | 1 | 1 | 0 | | | |
| t9 | G1 | 0 | 0 | 0 | 1 | | | | t21 | G2 | 0 | 0 | 0 | 1 | | | |
| t10 | G1# | 1 | 0 | 0 | 1 | | | | t22 | G2# | 1 | 0 | 0 | 1 | | | |
| t11 | A1 | 0 | 1 | 0 | 1 | | | | t23 | A2 | 0 | 1 | 0 | 1 | | | |
| t12 | A1# | 1 | 1 | 0 | 1 | | | | t24 | A2# | 1 | 1 | 0 | 1 | | | |

| 3rd Octave | | | | | | | | | 4th Octave | | | | | | | | |
|---|---|---|---|---|---|---|---|---|---|---|---|---|---|---|---|---|---|
| | Scale | Scale counter | | | | Octave counter | | | | Scale | Scale counter | | | | Octave counter | | |
| Timing | name | 1 | 2 | 4 | 8 | 1 | 2 | 4 | Timing | name | 1 | 2 | 4 | 8 | 1 | 2 | 4 |
| t25 | B2 | 0 | 0 | 0 | 0 | | | | t37 | B3 | 0 | 0 | 0 | 0 | | | |
| t26 | C3 | 1 | 0 | 0 | 0 | | | | t38 | C4 | 1 | 0 | 0 | 0 | | | |
| t27 | C3# | 0 | 1 | 0 | 0 | | | | t39 | C4# | 0 | 1 | 0 | 0 | | | |
| t28 | D3 | 1 | 1 | 0 | 0 | | | | t40 | D4 | 1 | 1 | 0 | 0 | | | |
| t29 | D3# | 0 | 0 | 1 | 0 | | | | t41 | D4# | 0 | 0 | 1 | 0 | | | |
| t30 | E3 | 1 | 0 | 1 | 0 | | | | t42 | E4 | 1 | 0 | 1 | 0 | | | |
| t31 | F3 | 0 | 1 | 1 | 0 | 1 | 1 | 0 | t43 | F4 | 0 | 1 | 1 | 0 | 0 | 0 | 1 |
| t32 | F3# | 1 | 1 | 1 | 0 | | | | t44 | F4# | 1 | 1 | 1 | 0 | | | |
| t33 | G3 | 0 | 0 | 0 | 1 | | | | t45 | G4 | 0 | 0 | 0 | 1 | | | |
| t34 | G3# | 1 | 0 | 0 | 1 | | | | t46 | G4# | 1 | 0 | 0 | 1 | | | |
| t35 | A3 | 0 | 1 | 0 | 1 | | | | t47 | A4 | 0 | 1 | 0 | 1 | | | |
| t36 | A3# | 1 | 1 | 0 | 1 | | | | t48 | A4# | 1 | 1 | 0 | 1 | | | |

| 5th Octave | | | | | | | | | 6th Octave | | | | | | | | |
|---|---|---|---|---|---|---|---|---|---|---|---|---|---|---|---|---|---|
| | Scale | Scale counter | | | | Octave counter | | | | Scale | Scale counter | | | | Octave counter | | |
| Timing | name | 1 | 2 | 4 | 8 | 1 | 2 | 4 | Timing | name | 1 | 2 | 4 | 8 | 1 | 2 | 4 |
| t49 | B4 | 0 | 0 | 0 | 0 | | | | t61 | B5 | 0 | 0 | 0 | 0 | | | |
| t50 | C5 | 1 | 0 | 0 | 0 | | | | t62 | C6 | 1 | 0 | 0 | 0 | | | |
| t51 | C5# | 0 | 1 | 0 | 0 | | | | t63 | C6# | 0 | 1 | 0 | 0 | | | |
| t52 | D5 | 1 | 1 | 0 | 0 | | | | t64 | D6 | 1 | 1 | 0 | 0 | | | |
| t53 | D5# | 0 | 0 | 1 | 0 | | | | t65 | 6# | 0 | 0 | 1 | 0 | | | |
| t54 | E5 | 1 | 0 | 1 | 0 | 1 | 0 | 1 | t66 | E6 | 1 | 0 | 1 | 0 | 0 | 1 | 1 |
| t55 | F5 | 0 | 1 | 1 | 0 | | | | t67 | F6 | 0 | 1 | 1 | 0 | | | |
| t56 | F5# | 1 | 1 | 1 | 0 | | | | t68 | F6# | 1 | 1 | 1 | 0 | | | |
| t57 | G5 | 0 | 0 | 0 | 1 | | | | t69 | G6 | 0 | 0 | 0 | 1 | | | |
| t58 | G5# | 1 | 0 | 0 | 1 | | | | t70 | G6# | 1 | 0 | 0 | 1 | | | |
| t59 | A5 | 0 | 1 | 0 | 1 | | | | t71 | A6 | 0 | D6#0 | 1 | | | | |
| t60 | A5# | 1 | 1 | 0 | 1 | | | | t72 | A6# | 1 | 1 | 0 | 1 | | | |

| 7th Octave | | | | | | | | |
|---|---|---|---|---|---|---|---|---|
| | Scale | Scale counter | | | | Octave counter | | |
| Timing | name | 1 | 2 | 4 | 8 | 1 | 2 | 4 |
| t73 | B6 | 0 | 0 | 0 | 0 | | | |
| t74 | C7 | 1 | 0 | 0 | 0 | | | |
| t75 | C7# | 0 | 1 | 0 | 0 | | | |
| t76 | D7 | 1 | 1 | 0 | 0 | | | |
| t77 | D7# | 0 | 0 | 1 | 0 | | | |
| t78 | E7 | 1 | 0 | 1 | 0 | 1 | 1 | 1 |
| t79 | F7 | 0 | 1 | 1 | 0 | | | |
| t80 | F7# | 1 | 1 | 1 | 0 | | | |
| t81 | G7 | 0 | 0 | 0 | 1 | | | |
| t82 | G7# | 1 | 0 | 0 | 1 | | | |
| t83 | A7 | 0 | 1 | 0 | 1 | | | |
| t84 | A7# | 1 | 1 | 0 | 1 | | | |

Output signals from the AND gate matrix circuit 4-2 are shifted through the OR gate output line 4-3 in synchronization with the write-in clock pulse $\overline{Kc}$, and supplied to the input terminal of an 84-bit shift register 4-4 and also to one of the input terminals of an AND gate 4-5. The other input terminal of this AND gate 4-5 is supplied with a signal reversed by an inverter 4-6 from an output signal from said shift register 4-4. Accordingly, the AND gate 4-5 issues a new one-shot signal having a period of 8 microseconds, each time a performance key is operated. Therefore, the present electronic musical instrument has a construction adapted to produce a chord by depressing a plurality of performance keys at the same time or depressing said performance keys at a close time interval. The one-shot signal corresponding to the timing in which a performance key is operated is issued, as seen from Table 4, only during the first operation cycle related to the depression of a performance key.

TABLE 4

Figure 14:
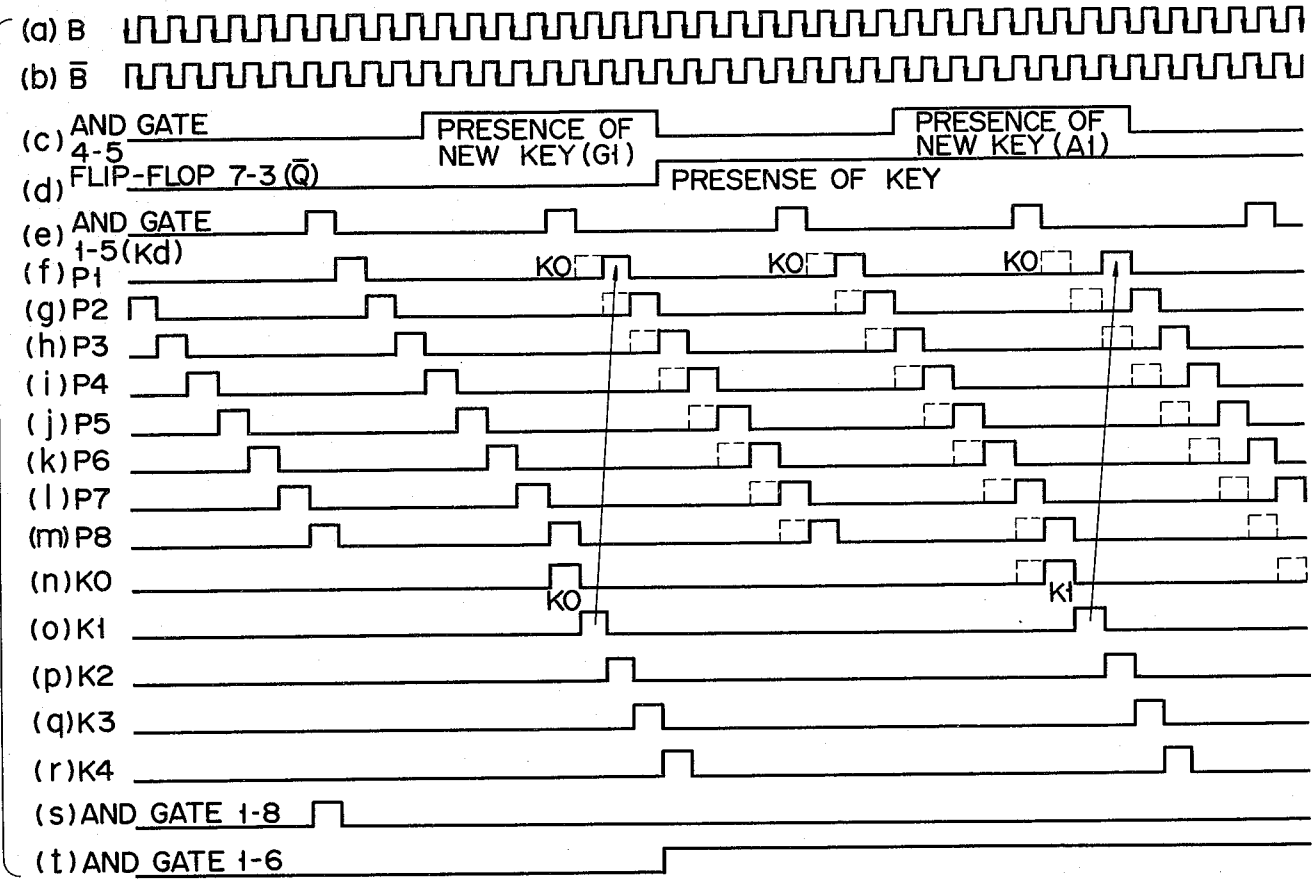
FIG. 14 is a time chart of key inputs to the control signal-forming circuits of FIGS. 8A-1, 8A-2.
Figure 15:
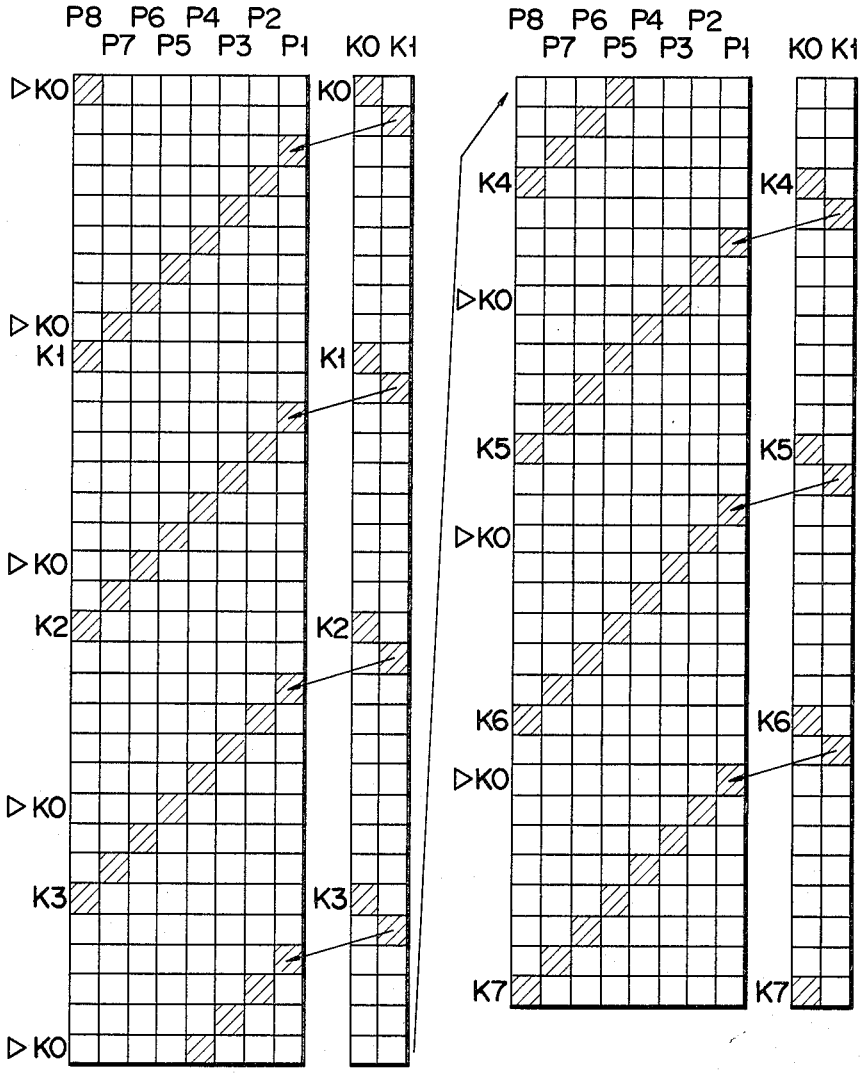
FIG. 15 visually sets forth the manner in which control signals are stored in the line memories used with the various control signal-forming circuit of FIGS. 8A-1, 8A-2.
Figure 16:
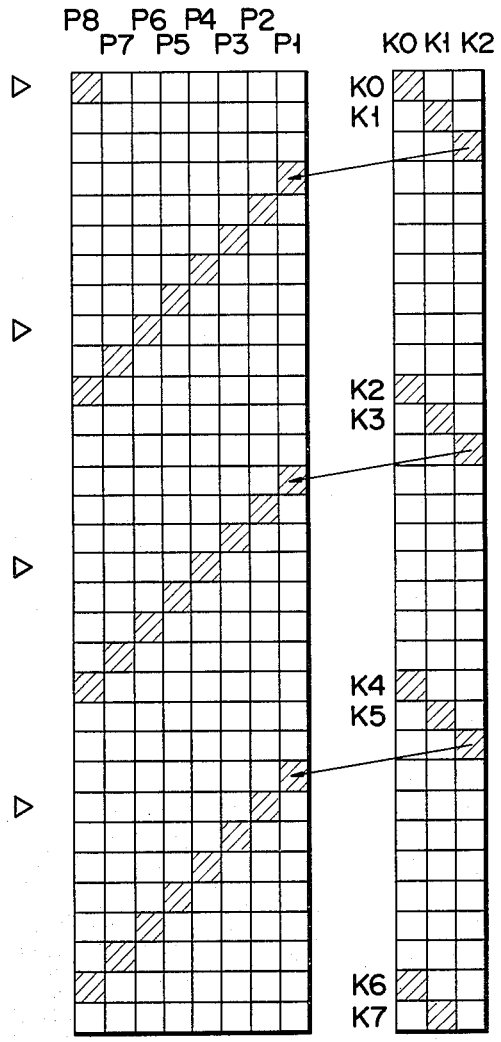
FIG. 16 visually presents the manner in which control signals are stored in the line memories used with the various control signal-forming circuits of FIGS. 8A-1, 8A-2 when a duet is played.
Figure 17:
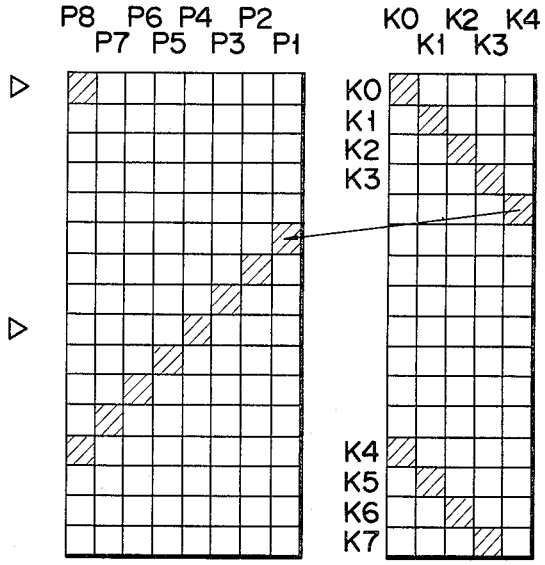
FIG. 17 visually indicates the manner in which control signals are stored in the line memories used with the various control signal-forming circuit of FIG. 8A-1 when a quartet is played.

| Key operation timing | 1st cycle | | | the form shifting through said shift register 1-12 and AND gate 1-6 and OR gate 1-15. Where a second signal [FIG. 14(*c*)] denoting the depression of a performance key is issued, the timing signal for the supply of the control signal $K_1'$ is sent forth from the AND gate 1-10 and specifies the timing in which an input signal is supplied to the line memory $k_1$. At this time the shift register 1-12 is also supplied with a signal denoting the timing in which a control signal $K_2'$ specifying the line memory $k_2$ is to be supplied. Thus, maximum 8 line memories $k_0$ to $k_7$ can be specified in succession. The mode of said specifying operation is illustrated in FIG. 15, showing the case where 8 performance keys are depressed in succession. In the case of a duet, two control signals $K_0$, $K_1$ are issued to specify any of four groups each consisting of two line memories as $k_0$–$k_1$, $k_2$–$k_3$, $k_4$–$k_5$, $k_6$–$k_7$, with respect to one performance key (FIG. 16). In the case of a quartet, four control signals $K_0$, $K_1$, $K_2$, $K_3$ are generated to specify either of two groups each consisting of four line memories as $k_0$ to $k_3$, $k_4$ to $k_7$ (FIG. 17).

Referring to FIGS. 8A-1, 8A-2, a control signal $K_0$ issued from the AND gate 1-10 is supplied to one of the input gates of each of the AND gates 22-1 to 22-4. A control signal $K_1$ sent forth from the first bit stage of the shift register 1-12 is conducted to one of the input terminals of each of the AND gates 22-5 to 22-8. A control signal $K_2$ is delivered to one of the input terminals of each of the AND gates 22-9 to 22-12. A control signal $K_3$ is transmitted to one of the input terminals of each of the AND gates 22-13 to 22-16.

Figures 1, 8C:
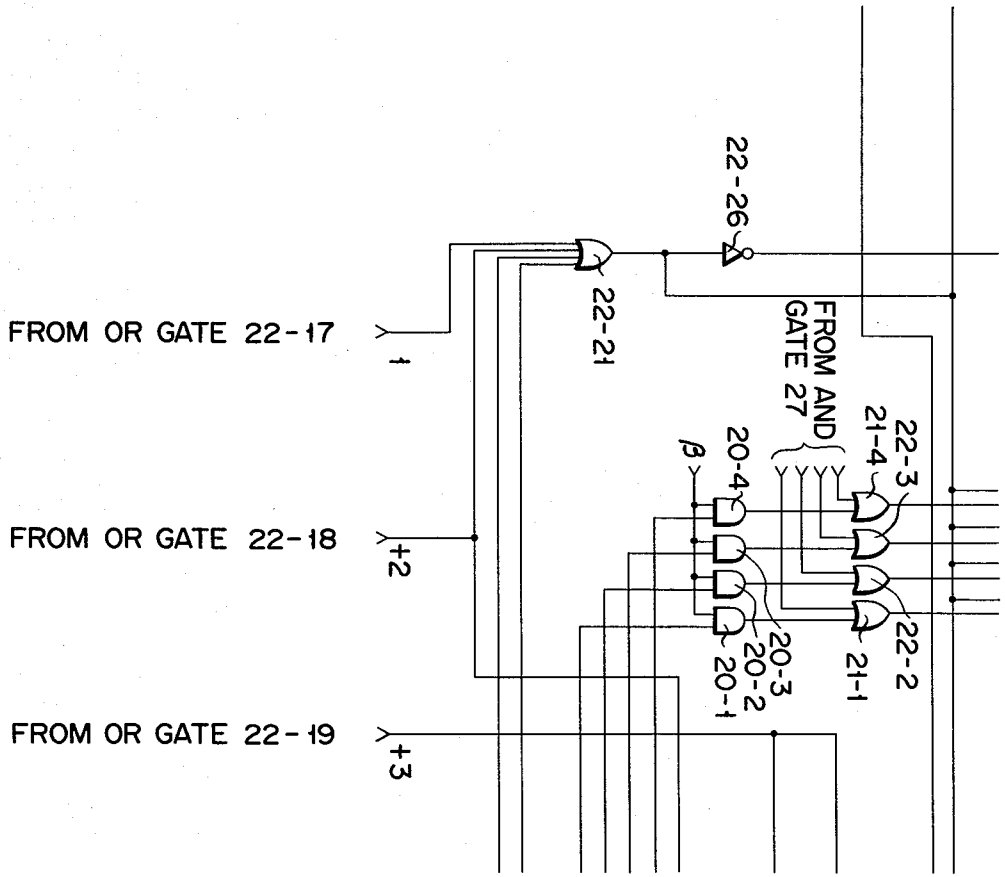
Figures 2, 8C:
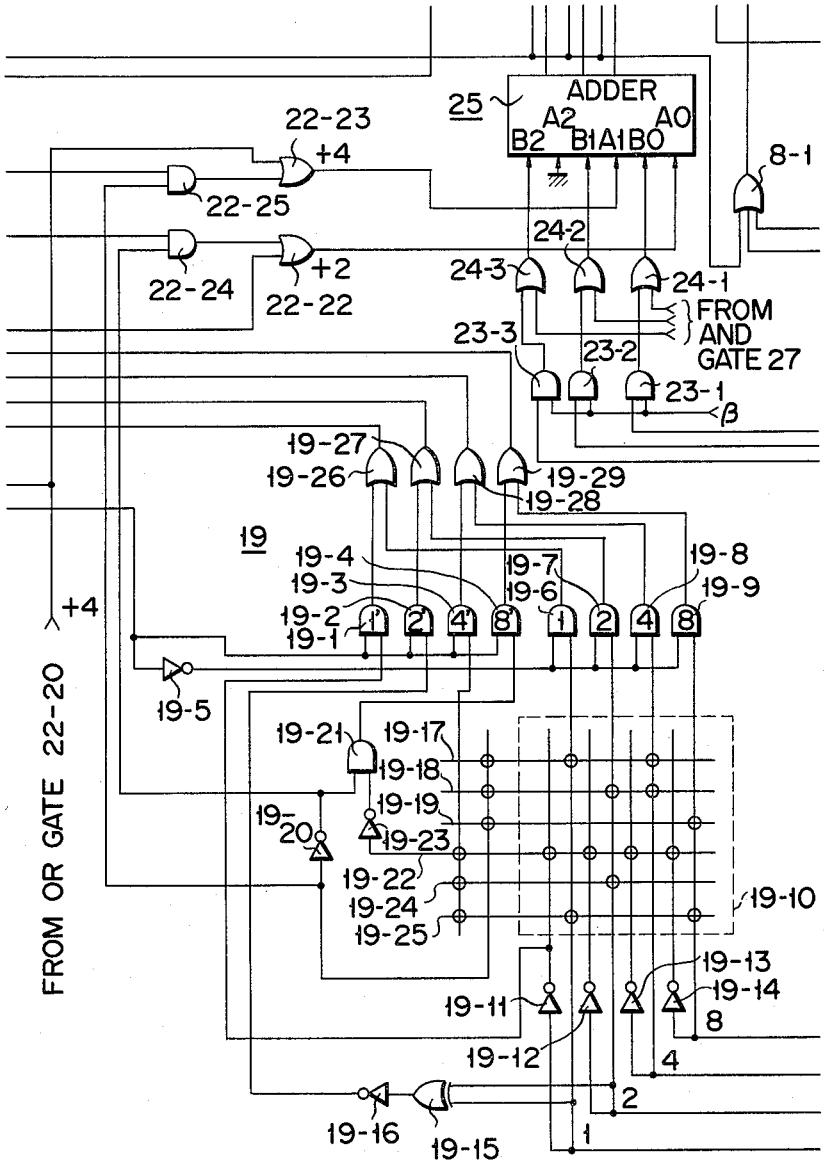

Referring to FIG. 7, instructions specifying the octave [1] (normal octave), octave [+2], octave [+3] and octave [+4] are given forth from the OR gates 22-17, 22-18, 22-19, 22-20 respectively. All these instructions are delivered to an OR gate 22-21 (FIGS. 8C-1, 8C-2). An output signal from the OR gate 22-18 is supplied to the OR gate 22-22. An output signal from the OR gate 22-19 is sent forth to the OR gates 22-22, 22-23 through the corresponding AND gates 22-24, 22-25. An output signal from the OR gate 22-19 is further conducted to one of the input terminals of each of the AND gates 19-1, 19-4 included in the correction scale data-generating circuit 19, and also to the AND gates 19-6 to 19-9 through the inverter 19-5. Scale data issued from the scale counter 5-1 of FIGS. 8A-1, 8A-2 is transmitted through the inverters 19-11, 19-12, 19-13, 19-14 to the matrix circuit 19-10 having an AND function which is included in the corrected scale data-generating circuit 19 (FIGS. 8A-1, 8A-2). Said scale data is also supplied to the other input terminal of each of the AND gates 19-6 to 19-9 after passing through said matrix circuit 19-10. Two output bit signals from the scale counter 5-1 which have weights of 1 and 2 respectively are delivered to an exclusive OR gate 19-15. An output signal therefrom is inverted by an inverter 19-16 and then carried to the other input terminal of the AND gate 19-2. An output signal from the inverter 19-11 is transmitted to the other input terminal of the AND gate 19-1. The AND gate output lines 19-17, 19-18, 19-19 of the matrix circuit 19-10 are connected in the form of logic OR. The resultant signal is supplied to the AND gate 22-25 as an instruction specifying the +4 octave. Said resultant signal is inverted by the inverter 19-20. The inverted signal is conducted to one of the input terminals of each of the AND gates 22-14, 19-21. The other input terminal of the AND gate 19-21 is supplied with a signal inverted by an inverter 19-23 from a signal conducted to the AND gate output line 19-22. An output signal from the AND gate 19-21 is delivered to the other input terminal of the AND gate 19-4. The other input terminal of the AND gate 19-3 is supplied with a signal resulting from the OR connection of the AND gate output lines 19-22, 19-24, 19-25 of the matrix circuit 19. The correction scale data-generating circuit 19 carries out the +7 (3 times) correction of the normal scale data supplied from the scale counter 51 when an instruction is issued for the +3 multiplication from the OR gate 22-19. Said correction scale data-generating circuit 19 is so designed as to effect binary code conversion as indicated in Table 5 below.

TABLE 5

| Scale counter | | | | Scale counter +7 (3 times) | | | | |
|---|---|---|---|---|---|---|---|---|
| 1 | 2 | 4 | 8 | 1' | 2' | 4' | 8' | Octave +4 |
| 0 | 0 | 0 | 0 | 1 | 1 | 1 | 0 | |
| 1 | 0 | 0 | 0 | 0 | 0 | 0 | 1 | |
| 0 | 1 | 0 | 0 | 1 | 0 | 0 | 1 | |
| 1 | 1 | 0 | 0 | 0 | 1 | 0 | 1 | |
| 0 | 0 | 1 | 0 | 1 | 1 | 0 | 1 | |
| 1 | 0 | 1 | 0 | 0 | 0 | 1 | 1 | |
| 0 | 1 | 1 | 0 | 1 | 0 | 1 | 1 | |
| 1 | 1 | 1 | 0 | 0 | 1 | 1 | 1 | |
| 0 | 0 | 0 | 1 | 1 | 1 | 1 | 1 | |
| 1 | 0 | 0 | 1 | 0 | 0 | 0 | 0 | 1 |
| 0 | 1 | 0 | 1 | 1 | 0 | 0 | 0 | 1 |

Figures 1, 8D:
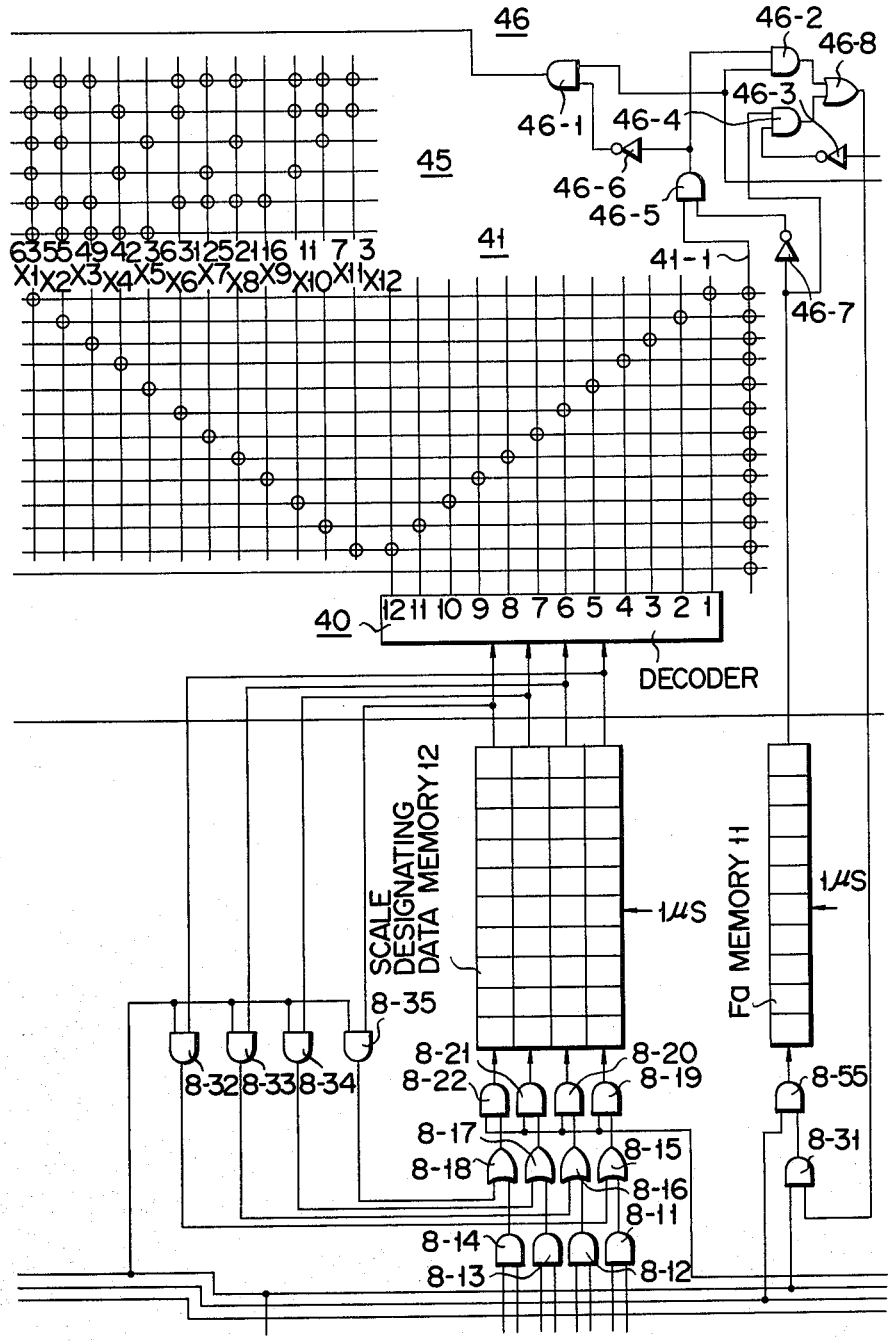
Figures 2, 8D:
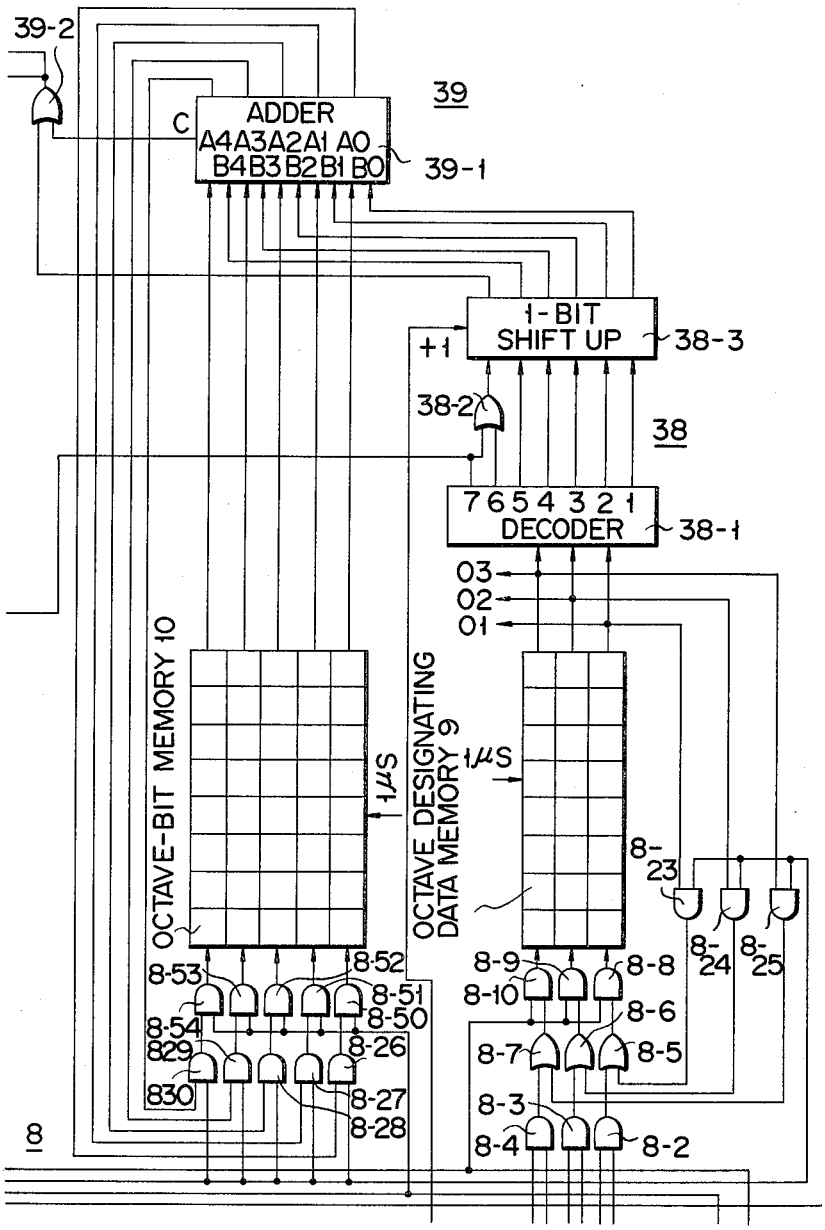
Figures 1, 8E:
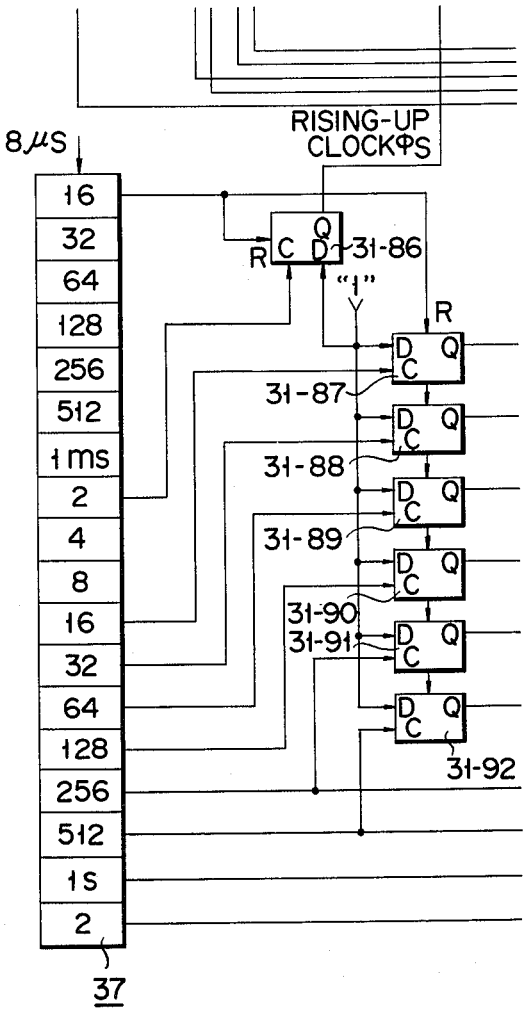
Figures 2, 8E:
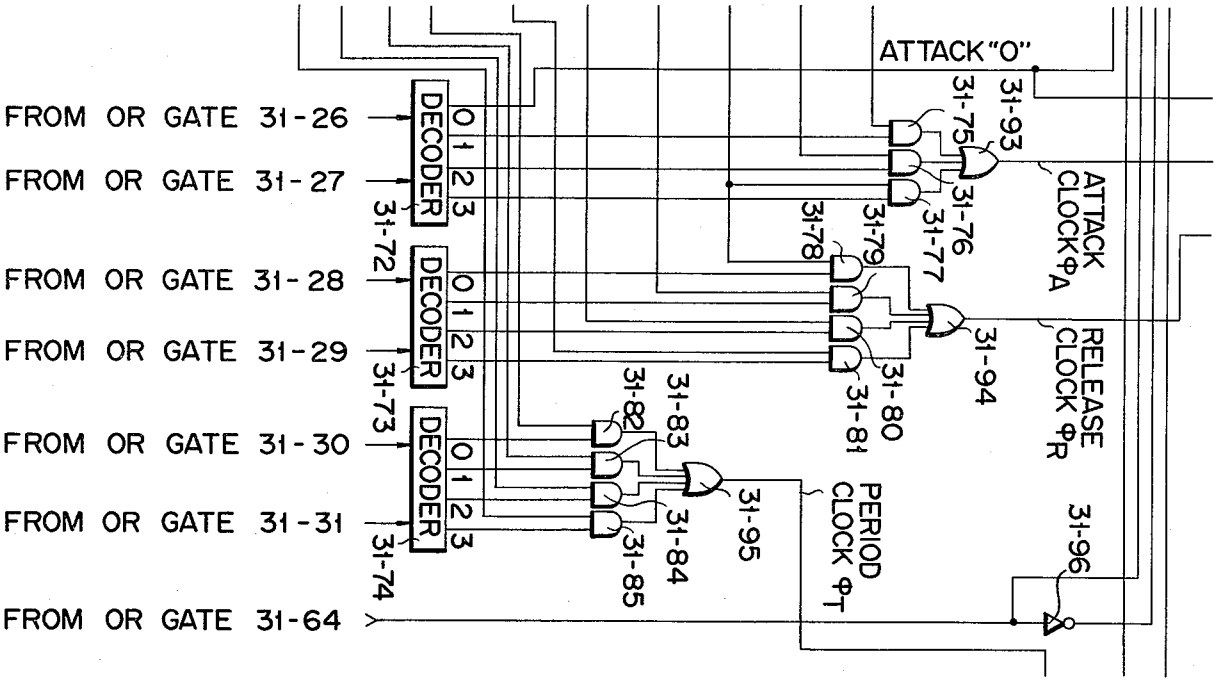
Figures 3, 8E:
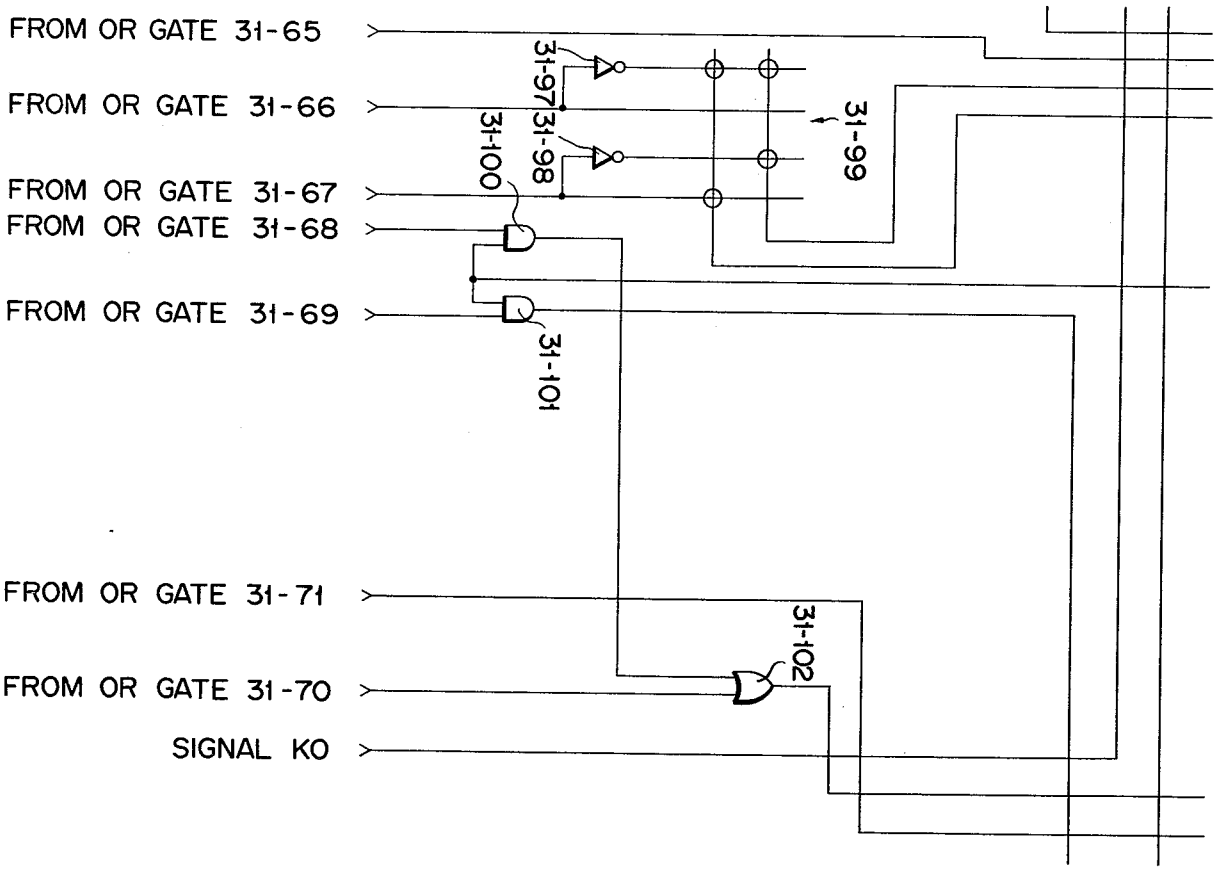
Figures 1, 8F:
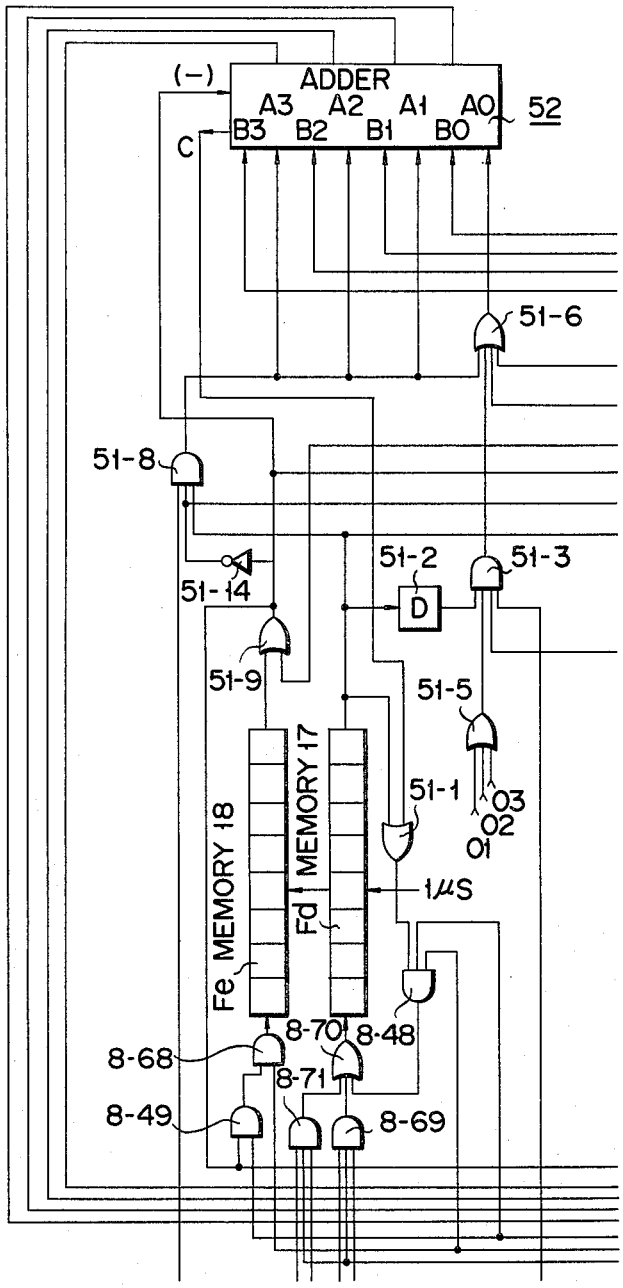
Figures 2, 8F:
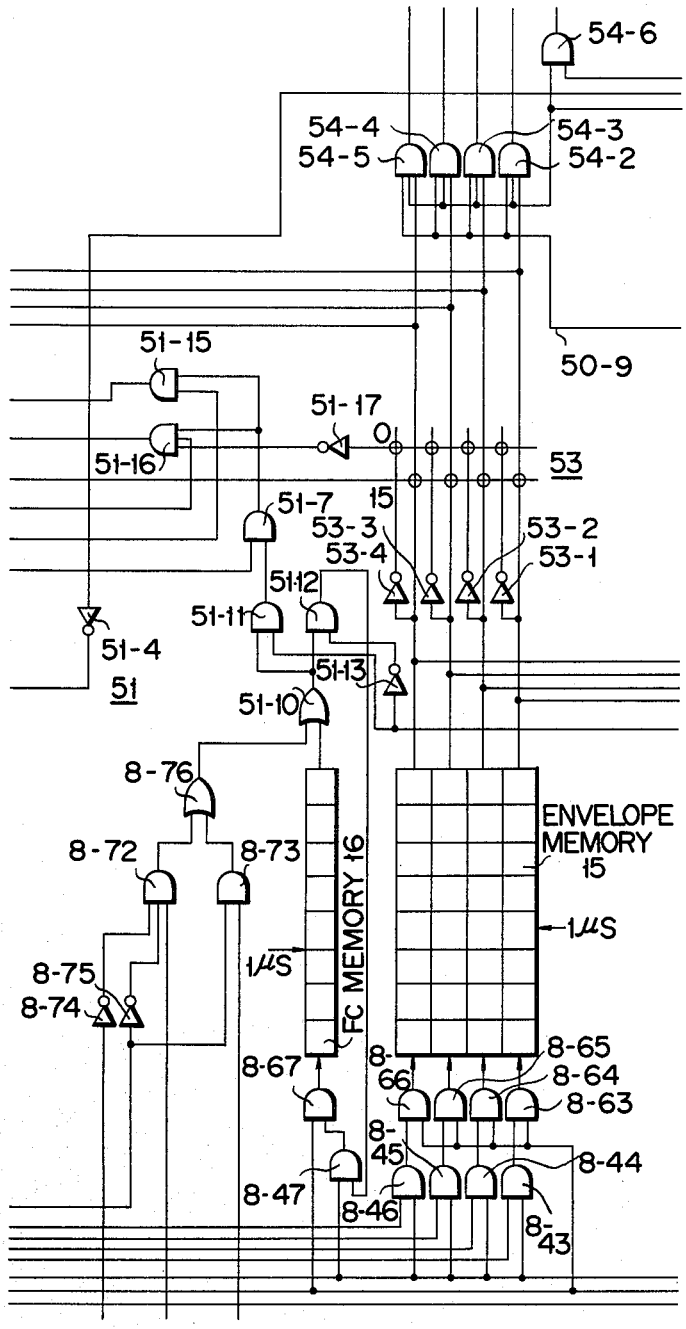
Figures 3, 8F:
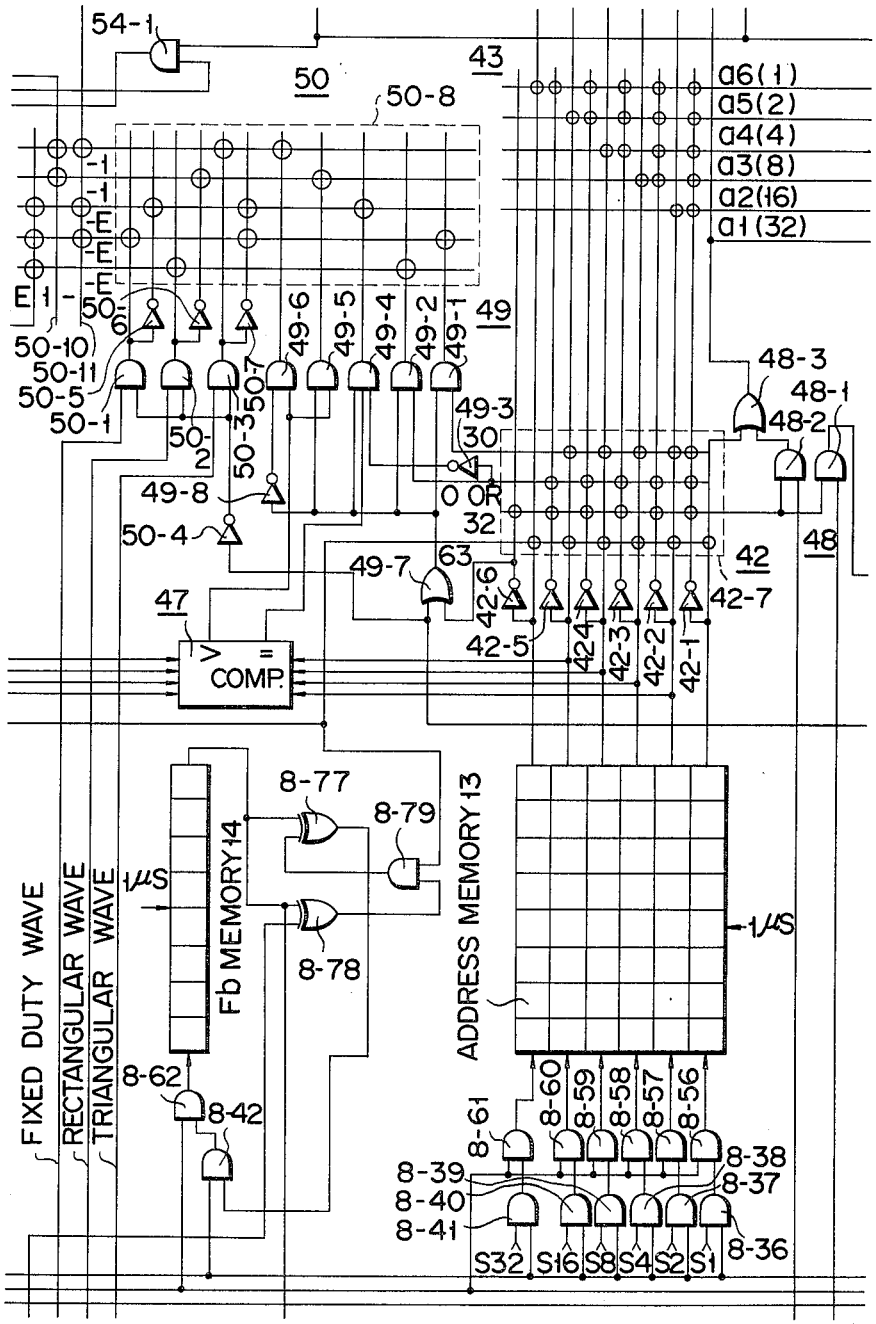
Figure 18:
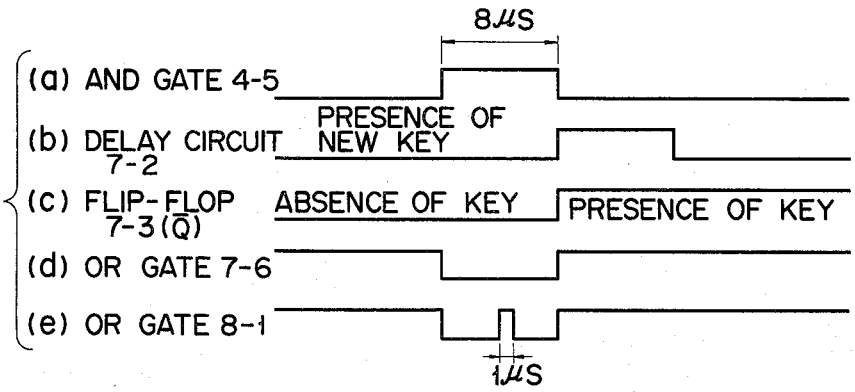
FIG. 18 is a time chart of input signals supplied from the performance keys of FIGS. 8A-1, 8A-2.

After all, in accordance with the contents of a [+3] instruction issued from the OR gate 22-19, normal scale data delivered from the AND gates 19-6, 19-7, 19-8, 19-9 or corrected scale data supplied from the AND gates 19-1, 19-2, 19-3, 19-4 is selectively conducted to OR gates 19-26, 19-27, 19-28, 19-29. Output octave data from the octave counter 5-3 (FIGS. 8A-1, 8A-2) and output signals from the OR gates 22-22, 22-23 are supplied to the adder 25 through the AND gates 23-1 to 23-3 which are supplied with an output signal $\beta$ from the inverter 36 when a sample tone generation-instructing key 29 (FIG. 2) is not operated, and also through the OR gates 24-1 to 24-3 supplied with octave data from the AND gate 28 (FIG. 2). The adder 25 gives an octave-specifying instruction. This instruction is sent forth to the octave-specifying data memory 9 as 3-parallel-bit data through the AND gates 8-2, 8-3, 8-4 OR gates 8-5, 8-6, 8-7 and AND gates 8-8, 8-9, 8-10, all shown in FIGS. 8D-1, 8D-2, in synchronization with an output signal from the OR gate 22-21 (FIGS. 8C-1, 8C-2). Scale-specifying data delivered from the OR gates 19-26, 19-27, 19-28, 19-29 of FIGS. 8C-1, 8C-2 passes through the AND gates 20-1 to 20-3 which are supplied with an output signal $\beta$ from the inverter 36 when a sample tone generation-instructing key 29 (FIG. 2) is not operated, and also through the OR gates 24-1 to 24-3 supplied with octave data from the AND gate 28 (FIG. 2). The adder 25 gives an octave-specifying instruction. This instruction is sent forth to the octave-specifying data memory 9 as 3-parallel-bit data through the AND gates 8-2, 8-3, 8-4, OR gates 8-5, 8-6, 8-7 and AND gates 8-8, 8-9, 8-10, all shown in FIGS. 8D-1, 8D-2, in synchronization with an output signal from the OR gate 22-21 (FIGS. 8C-1, 8C-2). Scale-specifying data delivered from the OR gates 19-26, 19-27, 19-28, 19-29 of FIGS. 8C-1, 8C-2 passes through the AND gates 20-1 to 20-3 which are supplied with an output signal $\beta$ from the inverter 36 when the sample tone generation-instructing key 29 (FIG. 2) is not operated, through the OR gates 21-1 to 21-3 of FIG. 2 supplied with scale data from the AND gate 27, and further through the AND gates 8-11, 8-12, 8-13, 8-14, OR gates 8-15, 8-16, 8-17, 8-18 and AND gates 8-19, 8-20, 8-21, 8-22, all shown in FIGS. 8D-1, 8D-2. Said scale-specifying data is supplied to the scale-specifying data memory 12 as a 4-parallel-bit data. An output signal from the OR gate 22-21 of FIGS. 8C-1, 8C-2 is also transmitted to the OR gate 8-1. A signal inverted by the inverter 20-26 from an output signal from the OR gate 22-21 is supplied as a gate operation-suppressing signal to one of the input terminals of each of the AND gates 8-23 to 8-35 (FIGS. 8D-1, 8D-2) and the AND gates 8-36 to 8-49 (FIGS. 8F-1, 8F-2). An output signal from the OR gate 7-6 (FIGS. 8A-1, 8A-2) is delivered as a gate control signal to one of the input terminals of each of the AND gates 8-48 to 8-53 (FIG. 8D-1), AND gates 8-54 to 8-66 (FIGS. 8F-1, 8F-2) and the AND gate 8-48. Where the sustenance-instructing switch 6 remains inoperative, and the flip-flop circuit 7-3 is set (to suppress the generation of a performance key signal), as shown in FIG. 18, and under this condition, a signal [FIG. 18(*a*)] denoting the depression of a performance key is produced from the AND gate 4-5, then the aforesaid output signal from the OR gate 7-6 prevents during said interval (8 microseconds) the generation of an output signal from the AND gates 8-48 to 8-53 (FIGS. 8D-1, 8D-2), and AND gates 8-54 to 8-66 (FIGS. 8F-1, 8F-2), thereby clearing all the contents of the memories 10, 11, 13, 15, 16, 17. The OR gate 8-1 is supplied with a control signal $K_0$ issued from the OR gate 22-21 (FIGS. 8C-1, 8C-2) in response to a signal [FIG. 18(*e*)] denoting the depression of a performance key. During the period of 1 microsecond in which said control signal $K_0$ is issued, the AND gates 8-8 to 8-10, 8-19, to 8-22 remain open, thereby enabling new octave-specifying data to be written in the octave-specifying date memory 9 and new scale-specifying data to be stored in the line memory $K_D$ of the scale-specifying data memory 12. Since, at this tine, a signal inverted by the inverter 22-26 from an output signal delivered from the OR gate 22-21 is supplied as a gate operation-suppressing signal to the AND gates 8-23 to 8-25, 8-32 to 8-35, the previously stored contents of the line memory $k_0$ are cleared. Where, however, the sustenance-specifying switch 6 (FIGS. 8A-1, 8A-2) is operated, the contents of the respective memories are not cleared. In contract, where the flip-flop circuit 7-3 of FIGS. 8A-1, 8A-2 is reset to allow the generation of a signal denoting the depression of a performance key, and, for example, the ninth performance key is depressed, then the line memory $k_0$ of the octave-specifying data memory 9 and the line memory $k_0$ of the scale-specifying data memory 12 are respectively supplied with the octave-specifying data and scale-specifying data corresponding to the ninth performance key. Accordingly, data previously stored in said line memories $k_0$ is cleared. As mentioned above, the following line memories $k_1$, $k_2$ . . . of both octave-specifying data memory 9 and scale-specifying data memory 12 are supplied with fresh data corresponding to a new performance key, each time it is depressed.

There will now be described by reference to FIGS. 8D-1, 8D-2, 8E-1, 8E-2, 8F-1, 8F-2 the generation of a pitch clock pulse having a prescribed frequency. This pitch clock pulse having a prescribed frequency is produced in accordance with the octave-specifying data stored in the octave-specifying data memory 9 and the scale-specifying data stored in the scale-specifying data memory 12. 3-bit octave-specifying data is decoded by the decoder 38-1, each time said data is drawn off from the last memory section of the octave-specifying data memory 9. 7 decoded signals 1, 2, 3, 4, 5, 6, and 7 are generated in conformity to the serial order of the 7 octaves. Decoded signals representing the 1st to the 5th octaves are directly supplied to a 1 bit shiftup circuit 38-3 (FIGS. 8D-1, 8D-2), and decoded signals denoting the 6th and 7th octaves are conducted to said circuit 38-3 through an OR gate 38-2. The 1 bit shiftup circuit 38-3 is operated only upon receipt of an octave change-specifying instruction. Normally, shifting does not take place in said circuit 38-3. Accordingly, output signals representing the respective octaves which are delivered from the decoder 38-1 are supplied to an adder 39-1 through said circuit 38-3 to be added to the contents of the corresponding memory section of the octave bit memory 10 (FIGS. 8D-1, 8D-2). Namely, the contents of the last memory section of the octave bit memory 10 is added from each cycle (8 micro-seconds) to numbers of addition indicated in Table 6 below which correspond to signals decoded by the decoder 38-1. The result of said addition is stored in the foremost memory section of the octave bit memory 10 in the form shifting through said memory 10 and the AND gates 8-26 to 8-30, 8-48 to 8-52.

TABLE 6

| Octave | Number of addition | Carry | Period TfB | | Frequency 1/Tfb | |
|---|---|---|---|---|---|---|
| 1 | +1 | per 32 cycles | 256μs | Tfb1 | 3906.25 | Hz |
| 2 | +2 | per 16 cycles | 128μs | Tfb2 | 7812.5 | Hz |
| 3 | +4 | per 8 cycles | 64μs | Tfb3 | 15625 | Hz |
| 4 | +8 | per 4 cycles | 32μs | Tfb4 | 31250 | Hz |
| 5 | +16 | per 2 cycles | 16μs | Tfb5 | 62500 | Hz |
| 6 | 0 | per 1 cycle | 8μs | Tfb6 | 125000 | Hz |
| 7 | 0 | per 1 cycle | 8μs | Tfb7 | 125000 | Hz |

A carry signal sent forth from the adder 38-1 varies with a specified octave. As seen from Table 6 above, a carry signal is issued per 32 cycles, 16 cycles, 8 cycles, 4 cycles, and 2 cycles in conformity to the serial order of the 1st to 5th octaves. Data expressed in terms of the period $T_{fb}$ and frequency are also given in Table 6. As seen therefrom, decoded output signals from the decoder 38-1 which correspond to the 6th and 7th octaves are supplied to the OR gate 38-2, and also directly to an OR gate 39-2 together with a carry signal issued per 8 microseconds (1 cycle) without being conducted through an adder 39-1. An output signal from the OR gate 39-2 constitutes the aforesaid octave referential clock pulse having a prescribed frequency. The respective bit signals of the scale-specifying data read out of the last line memory of the scale-specifying data memory 12 are conducted to a scale decoder 40 (FIGS. 8D-1, 8D-2), which gives forth a signal corresponding to one of the 12 scales. The respective output lines of the decoder 40 are connected to a scale clock pulse-selecting circuit 41.

Signals having a referential clock pulse frequency of an octave which are respectively related to carry signals issued through the OR gate 38-2 are transmitted to one of the input terminals of an AND gate 46-4 through AND gates 46-1, 46-2 and inverter 46-3. An addition of +1 is made in an adder 44, each time a signal having an octave referential clock pulse frequency is sent forth from the AND gate 46-1.

Figure 19:
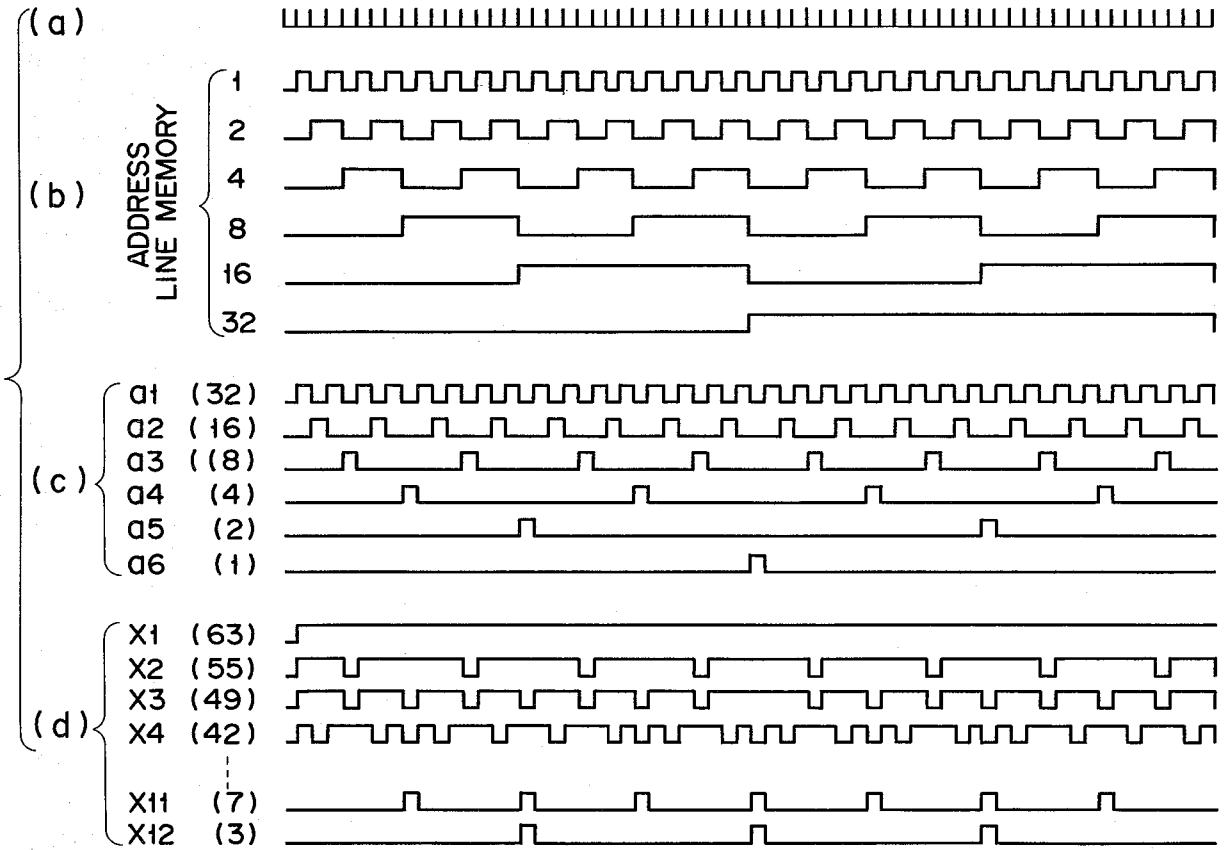
FIG. 19 is a time chart associated with the control of a number of stop clock pulses used in FIGS. 8D-1, 8D-2.

The address memory 13 of FIGS. 8F-1, 8F-2 comprises 8 line memories, each of which can store 64 address steps in the 6-bit form. Each memory section stores a number of address steps included in one cycle having a tone waveform shown in FIG. 4. A 6-bit output signal from the last memory section of the address memory 13 is supplied directly, or through inverters 42-1 to 42-6, to an AND gate matrix circuit 42-7 of an address step counter 42 and a current step number detection matrix circuit 43. This matrix circuit 43 has 6 output lines a1 to a6 and functions as an AND gate. The 6 output lines a1 to a6 are connected to a matrix circuit 45 (FIGS. 8D-1, 8D-2) for generating a signal denoting a number of clock pulses whose supply should be stopped. This matrix circuit 45 determines how may of the signals having a referential clock pulse frequency of an octave which are sent forth from the AND gate 38-2 for each scale specified by the scale decoder 40 have to be prevented from being supplied. Namely, the operation of the AND gate 46-1 is so controlled as to generate a signal whose frequency corresponds to a scale specified while the 64 address steps of any one of the memory sections of the address memory 13 are counted and stored. There will now be described the fundamental principle on which there is based the operation of the current step number detection matrix circuit 43, and the matrix circuit 45 for determining a number of clock pulses whose supply should be stopped. The current step number detection matrix circuit 43 of FIGS. 8F-1, 8F-2 is so designed that while 64 steps being stored in any one of the line memories of the address memory 13 are fully counted, the output line a1 is supplied with 32 clock pulses; the output line a2 with 16 clock pulses; the output line a3 with 8 clock pulses; the output line a4 with 4 clock pulses; the output line a5 with 2 clock pulses; and the output line a6 with 1 clock pulse. FIG. 19 illustrates the waveforms of clock pulses, showing the manner in which the fundamental principle is operated. With respect to only one memory section of the address memory 13, let it be assumed that clock pulses of FIG. 19(*a*) are counted and 6-bit output signals from the address memory 13 are counted and stored as shown in FIG. 19(*b*). Then the output lines a1 to a6 of the current step number detection matrix circuit 43 are supplied with clock pulses having such numbers as are shown in FIG. 19(*c*). A combination of the output lines a1 to a6 of the current step number detection circuit 43 enables the stopped clock number-determining matrix circuit 45 to define a number of clock pulses whose supply should be suppressed for each scale. Now let it be assumed that a clock pulse issued from the clock pulse generator 2 has a reference frequency fB of 1000 KHz. Then the clock pulse has a period expressed as follows:

$$T_{fB}=1/fB=1/1000\ \text{KHz}=1\ \mu s$$

Therefore, $$fa=fB/8\ \mu s=1000\ \text{KHz}/8\ \mu s=125\ \text{KHz}$$

$$Tfa=1/fa=1/125\ \text{KHz}=8\ \mu s$$

where:

fa=frequency of one shift circulation in the address memory 13

Tfa=period of fa

With n (64 steps) taken to denote a number of steps included in one cycle of a tone waveform, the following equation results:

$$Tx=Tfb\ (n+\alpha)=Tfb\ (64+\alpha)$$

$$\alpha=(Tx/Tfb)-64$$

where:

Tfb=period of a signal having a referential clock pulse of an octave (output signal from the OR gate 39-2)

Tx=period of each scale $\alpha$=correction value (number of stopped clock pulses)

$\therefore$ Fx=frequency of each scale=1/Tx

With each octave a ratio between the frequencies of the respective scales has a value of $12\sqrt{2}$. Therefore, it serves the purpose to determine a value of correction for each octave. Eventually, a number of stopped clock pulses (a value $\alpha$ of correction) for each scale has a value given in FIG. 20. It is advised to provide an OR-functioning matrix circuit in accordance with data given in FIG. 20 in order to supply the 12 output lines X1 to X12 of the stopped clock pulse numbergenerating matrix circuit 12 with a signal denoting a number of stopped clock pulses [FIG. 19(*d*)]. Characters $F_{x1}$ to $F_{x6}$ shown in FIG. 20 denote scale frequencies associated with the circuit arrangement embodying this invention. The term "actual frequency" indicated in FIG. 20 means an actually occurring scale frequency. Namely, the scale clock pulse-selecting circuit 41 picks up one of the output lines X1 to X12 in accordance with the contents of an output signal from the scale decoder 40. Thus a signal denoting a number of stopped clock pulses is supplied to the OR output line 41-1 (FIGS. 8D-1, 8D-2). A signal denoting a number of stopped clock pulses for each scale is supplied as a gate operation-suppressing signal to the AND gate 46-1 through the AND gates 46-5 and inverter 46-6. An output signal from the last memory section of the $F_a$ memory 11 for controlling a number of pitch clock pulses is conducted to the AND gate 46-5 through the inverter 46-7. An output signal from the $F_a$ memory 11 is also directly delivered to the AND gate 46-4. Output signals from the AND gates 46-2 to 46-4 are sent forth as control signals to the foremost memory section of the $F_a$ memory 11 through the OR gate 6-8, and AND gates 8-31, 8-53. A signal denoting the detection of a count [0] which is issued from the last memory section of the address memory 13 is supplied to one of the input terminals of each of the AND gates 48-1, 48-2. Vibrato signals instructing +1/64, −1/64 are respectively supplied to the other input terminals of said AND gates 48-1, 48-2. An output signal from the AND gate 48-1 is delivered to the OR output line 41-1 of the scale clock pulse-selecting circuit 41 (FIGS. 8D-1, 8D-2). An output signal from the AND gate 48-2 is carried to the output line al of the step number detection matrix circuit 43 through the OR gate 48-3. Where an address step number [1] is detected, the AND gate 48-1 is unconditionally supplied with a frequency higher by one clock pulse than the normal scale frequency slightly to accelerate the scale frequency. Where said address step number [0] is detected, the AND gate 48-2 is unconditionally supplied with a frequency low by one clock pulse than the normal scale frequency slightly to delay the scale frequency. As the result, the vibrato effect is realized. An addition of +1 is made in the adder 44 to an output pitch clock pulse frequency signal from the AND gate 46-1. The pitch clock pulse frequency signal thus added is supplied to the corresponding memory section of the address memory 13. Output signals S1, S2, S4, S8, S16, S32 from the adder 44 are stored in the foremost memory section of the address memory 13 in the form shifting through said memory 13 and AND gates 8-36 to 8-41, 8-56 to 8-61. This shifting of stored data is carried out for the respective memory sections of each memory.

An output signal from the matrix circuit 42-7 of the address step counter 42 (FIGS. 8F-1, 8F-2) which denotes a counted step number of [30] is supplied to one of the input terminals of an AND gate 49-1. Signals showing the counted step numbers of [0] and [33] are conducted to one of the input terminals of an AND gate 49-2. Signals inverted by an inverter 49-3 from the signals indicating the counted step numbers of [0] and [32] are delivered to the first input terminal of an AND gate 49-4. The second input terminal of this AND gate 49-4 is supplied with a coincidence detection signal issued from a comparator 47. One of the input terminals of each of AND gate 49-5, 49-6 is supplied with a signal denoting coincidence between the former half sections of two adjacent tone waveforms and a signal showing coincidence between the latter half sections thereof respectively, these coincidence signals being sent forth from said comparator 47.

The other input terminals of the AND gates 49-1, 49-2, 49-4, 49-5 are respectively supplied with an output signal from the inverter 42-6 as well as with an output signal from an OR gate 49-7 which is already supplied with an output signal from the decoder 38-1 (FIGS. 8D-1, 8D-2) denoting the 7th octave. The other input terminal of the AND gate 49-6 is supplied with a signal inverted by an inverter 49-8 from an output signal which has been sent forth from the OR gate 49-7. The AND gates 49-1, 49-2, 49-4, 49-5, 49-6 generate signals denoting a counted step number of [30], a counted step number of [0], full coincidence between two adjacent tone waveforms, dissidence between the former half sections of said two adjacent tone waveforms, and dissidence between the latter half sections thereof respectively. All these signals are transmitted to the addition control circuit 50.

Figure 5:
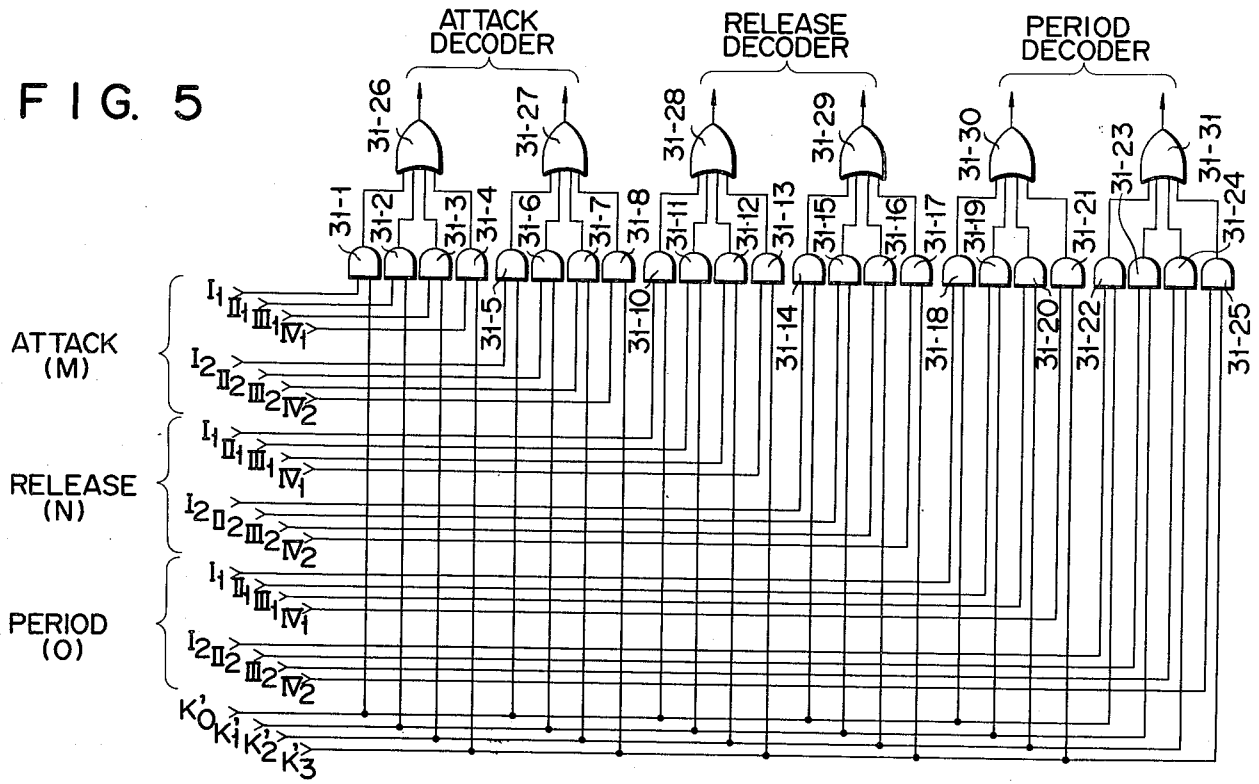
FIGS. 5, 6, 7 show the gates supplied with tone control signals from the ROM of FIG. 2.

Control signals $K_0'$, $K_1'$, $K_2'$, $K_3'$ produced from the matrix circuit 1-5 (FIGS. 8A-1, 8A-2) are delivered to the corresponding AND gates (FIGS. 5 and 6). Output signals from the OR gate 31-26, 31-27 are supplied to the decoder 31-72, providing decoded output signals indicated in Table 7 below. Output signals from the OR gates 31-28, 21-29 are carried to the decoder 31-73, producing decoded output signals shown in Table 8 below. Output signals from the OR gates 31-30, 31-31 are conducted to the decoder 31-74, generating decoded output signals set forth in Table 9 below.

TABLE 7

| MI 1 (II 1, III 1, IV 1) | MI 2 (II 2, III 2, IV 2) | Output from decoder | Attack clock pulse $\phi$A |
|---|---|---|---|
| Off | Off | 0 | — |
| On | Off | 1 | 16.384ms(≒16ms) |
| Off | On | 2 | 32.768ms(≒32ms) |
| On | On | 3 | 65.536ms(≒65ms) |

TABLE 8

| NI 1 (II 1, III 1, IV 1) | NI 2 (II 2, III 2, IV 2) | Output from decoder | Release clock pulse $\phi$R |
|---|---|---|---|
| Off | Off | 0 | 65.536ms(≒65ms) |
| On | Off | 1 | 0.131072s(≒0.1s) |
| Off | On | 2 | 0.262144s(≒0.26s) |
| On | On | 3 | 0.524288s(≒0.5s) |

TABLE 9

| OI 1 (II 1, III 1, IV 1) | OI 2 (II 2, III 2, IV 2) | Output from decoder | Period clock pulse $\phi$T |
|---|---|---|---|
| Off | Off | 0 | 0.262144s(≒0.26s) |
| On | Off | 1 | 2.524288s(≒0.5s) |
| Off | On | 2 | 1.048576s(≒1s) |
| On | On | 3 | 2.097152s(≒2s) |

An output signal of [0] from the decoder 31-72 is read out as an attack signal of [0]. Output signals of [1], [2] and [3] from said decoder 31-72 are respectively delivered to one of the input terminals of each of the AND gate 31-75, 31-76, 31-77. Output signals of [0], [1], [2], [3] are respectively conducted to one of the input terminals of each of the AND gates 31-78, 31-79, 31-80, 31-81. Output signals of [0], [1], [2], [3] are respectively sent forth to one of the input terminals of each of the AND gates 31-82, 31-83, 31-84, 31-85.

Referential numeral 37 (FIG. 1) denotes a time-measuring circuit formed of a 18-bit binary counter designed to count signals having a period of 8 microseconds. Numbers given in the respective counting stages of the binary counter 37 (FIGS. 8E-1, 8E-2) denote rough periods based on the binary counting (partly different from those actually measured). Referential numerals 31-86 to 31-92 denote delayed flip-flop circuits (referred to as "DFF"). The D terminal thereof is always applied with a signal of [1]. The C terminal thereof is supplied with output signals from the bit stages corresponding to counted lengths of time as 2 ms, 16 ms, 32 ms, 64 ms, 128 ms, 256 ms, 512 ms. The DFF is reset by an output signal from the first bit stage corresponding to a counted time of 16ms. Therefore, the Q output terminals of the DFF 31-86 to 31-92 generate a one-shot clock pulse having a period of 8 μs. A rising clock pulse $\phi$s is drawn off from the DFF 31-86. The Q output terminal of the DFF 31-87 is connected to the other input terminal of the AND gate 31-75; the Q output terminal of the DFF 31-88 to the other input terminal of the AND gate 31-76; the Q output terminal of the DFF 31-89 to the other input terminals of the AND gates 31-77, 31-78; the Q output terminal of the DFF 31-90 to the other input terminal of the AND gate 31-79; the Q output terminal of the DFF 31-91 to the other input terminal of the AND gate 31-80; and the Q output terminal of the DFF 31-92 to the other input terminal of the AND gate 31-82. The other input terminals of the AND gates 31-82 to 31-85 are supplied with output signals from the bit stages of the binary counter 37 corresponding to counted periods of 256 ms, 512 ms, 1 s, 2 s. Therefore, output signals from the AND gates 31-75 to 31-77 are sent forth to an OR gate 31-93, thereby providing an attack clock pulse $\phi$A corresponding to an output signal from the decoder 31-72 specified by the musical instrument type selecting ROM 26. Output signals from the AND gates 31-78 to 31-81 are conducted to an OR gate 31-94, thereby generating a release clock pulse $\phi$R corresponding to an output signal from the decoder 31-73 specified by the ROM 26, and also to an AND gate 31-95, thereby producing a period clock pulse $\phi T$ corresponding to an output signal from the decoder 31-74 specified by the ROM 26. The attack clock pulse $\phi A$, release clock pulse $\phi R$ and period clock pulse $\phi T$ have periods shown in Tables 7, 8 and 9 respectively, in accordance with the contents of output signals from the decoders.

The OR gate 31-64 generates an output signal upon receipt of a rise difference-instructing signal from the ROM 26 which determines whether a delay time t should be applied to the rise of a tone volume envelope stored in a line memory adjacent to said OR gate 31-64. In the absence of said instruction, an inverter 31-96 produces an output signal, OR gates 31-65, 31-66, 31-67 send forth output signals in accordance with the contents of a waveform-specifying instruction issued from the ROM 26. Output signals from said OR gates 31-66, 31-67 and output signals inverted therefrom by the corresponding inverters 31-97, 31-98 are supplied to a waveform-instructing matrix circuit 31-99 which sends forth instruction for specifying the 3 standard types of waveform, that is, a triangular wave, rectangular wave and sawtooth wave (in the absence of instructions for specifying triangular and rectangular waves), as shown in Table 10 below.

TABLE 10

| | | |
|---|---|---|
| QI 1 (II 1, III 1, IV 1) | Off | Floating |
| | On | Fixed |

| Waveform-instructing matrix circuit (31–99) | | |
|---|---|---|
| QI 2 (II 2, III 2, IV 2) | QI 3 (II 3, III 3, IV 3) | Name of waveform |
| Off | Off | Rectangular |
| On | Off | Sawtooth |
| Off | On | Triangular |

Output signals from the OR gates 31-68, 31-69 are respectively conducted to one of the input terminals of each of AND gates 31-100, 31-101. The other input terminals of said AND gates 31-100, 31-101 are supplied with output signals from the Fb memory 14 (FIGS. 8F-1, 8F-2). An output signal from the AND gate 31-100 is supplied as a $-1/64$ vibrato-specifying instruction to the AND gate 48-2 (FIGS. 8F-1, 8F-2) through an OR gate 31-102 (FIGS. 8E-1, 8E-2). This OR gate 31-102 issues an octave change signal instructing $+1$ to the 1 bit-shift up circuit 38-3 (FIG. 8D-1, 8D-2). An output signal from an OR gate 31-70 is supplied as a vibrato instruction specifying $-1/64$ to the AND gate 48-2 through the OR gate 31-102. In the case of a duet, two line memories are used for depression of any one of the performance keys 3. In the case of a quartet, four line memories are used for depression of any one of the performance keys 3. The selective application of the line memories k0 to k7 for the four tone types I, II, III, IV, changes in the vibrato based on a multi-performance minute difference-specifying instruction, combination of octaves based on a multi-performance octave-specifying instruction and rise delay time (t)-specifying instruction based on a rise time difference detection instruction are all carried out by instructions issued from the ROM 26.

Where the ROM 26 does not send forth a rise time difference-suppressing instruction, the inverter 31-96 delivers said rise time difference-suppressing instruction to the AND gate 8-69 (FIGS. 8F-1, 8F-2). This AND gate 8-69 is supplied with an output signal from the AND gate 4-5 (FIGS. 8B-1, 8B-2) which denotes the depression of a performance key and an output signal from the OR gate 22-21 (FIGS. 8C-1, 8C-2). Each time one of the performance keys 3 is operated, the AND gate 8-69 causes a signal of [1] to be successively written in the line memories of the Fd memory 17 through the OR gate 8-70. Where an instruction is issued for the performance of a duet or quartet, a plurality of line memories are specified for each key depression. The signal of [1] is stored in the Fd memory 17 in the form circulating through said memory 17 and the OR gate 39-1, AND gate 8-48, and OR gate 8-70, thereby indicating that section of the envelope memory 15 which is being operated. Where a rise time difference-specifying instruction is given from the ROM 26, then a delay instruction is sent forth to an AND gate 8-71 (FIGS. 8F-1, 8F-2), thereby suppressing the generation of an output signal from the AND gate 8-69. The AND gate 8-71 is also supplied with a signal denoting the depression of a performance key which is delivered from the AND gate 4-5 (FIGS. 8B-1, 8B-2) and a control signal $K_0$ issued from the AND gate 1-10 (FIGS. 8A-1, 8A-2). Where, therefore, a performance key is operated, the AND gate 8-71 is enabled by a control signal $K_0$ for only 1 microsecond corresponding to the length of time required for data to be read out of the foremost line memory $k_0$. At this time, a signal of [1] is stored in the Fd memory 17 through the OR gate 8-70 in the form circulating therethrough. The signal of [1] stored in the Fd memory 17 is read out of the last line memory thereof to a delay circuit 51-2 (FIGS. 8F-1, 8F-2) carrying out a delay of 1 microsecond. An output signal from said delay circuit 51-2 is conducted to an AND gate 51-3. This AND gate 51-3 is supplied through an OR gate 51-5 with a signal inverted by an inverter 51-4 from an output signal read out of the last line memory of the Fd memory 17 and a 3-bit output signal from the octave-specifying data memory 9, and further with a rise clock pulse $\phi S$ sent forth from the DFF 31-86 (FIGS. 8F-1, 8F-2). Where a signal of [1] is stored in the first line memory $k_0$ of the Fd memory 17 and said signal of [1] is not stored in the succeeding line memory $k_1$ of said Fd memory 17, then the AND gate 51-3 generates a rise clock pulse $\phi S$, which in turn is supplied to an adder 52 as a signal instructing an addition of $+1$ through an OR gate 51-6. Since, at this time, the line memory $k_1$ of the Fd memory 17 which corresponds to the line memory $k_1$ of the envelope memory 15 is not supplied with a signal of [1], the AND gate 51-7 is not opened. Therefore, a counted envelope value is not stored in the line memory $k_1$ of the envelope memory 15. Under this condition, the line memory $k_1$ of the envelope memory 15 is used to store an output count from the adder 52 which is designed to count the rise clock pulses $\phi S$ to determine a rise time different t. When the adder 52 successively adds up rise clock pulses $\phi S$ for each cycle (8 $\mu$s), then a carry signal sent forth from the adder 52 is stored as a signal of [1] in the line memory $k_1$ of the envelope memory 15. A length of time required for a carry signal to be issued from the adder 52 denotes the extent by which the rise time of an envelope is delayed in the line memory $k_1$ of the envelope memory 15 succeeding to the line memory $k_0$ thereof. In this case, said rise time is delayed by about 30 milliseconds. Where an instruction is given for the multi-performance, and the ROM 26 sends forth a rise time difference-specifying instruction, then the line memories of the Fd memory 17 are not immediately supplied with a signal of [1], but after a delay line t. Particularly where the ROM 26 issues a quartet instruction $\gamma$, a signal of [1] is stored in the line memory $k_1$ of the Fd memory 17 by being delayed for a period of t from the time at which said signal of [1] is stored in the line memory $k_0$ of said Fd memory 17, stored in the line memory $k_2$ after a delay time of 2 t, in the line memory $k_3$ after a delay time of 3 t, and in the following line memories by being delayed for a successive multiple of T each time.

Output signals from those of the line memories of the envelope memory 15 which are being operated are stored in the Fd memory 17. An output signal from the Fd memory 17 is supplied to the AND gates 51-7, 51-8 an AND gate 54-1 included in the later described addend number-determining circuit 54, which defines a number of addends being added to an augend at one time.

An attack clock pulse $\phi$A delivered from an OR gate 31-93 (FIGS. 8E-1, 8E-2) is supplied to one of the input terminals of the AND gate 8-72 (FIGS. 8F-1, 8F-2). A release clock pulse $\phi$R sent forth from an OR gate 31-9A is conducted to one of the input terminals of the AND gate 8-73. The AND gate 8-72 is further supplied with a signal inverted by an inverter 8-74 from an attack signal of [0] and a signal inverted by an inverter 8-75 from an output signal from an OR gate 51-9 supplied with an output signal from the later described Fe memory 18.

Where, therefore, the envelope is in an attacked condition shown in FIG. 3, and a certain length of time is required to produce any other attacked condition than that represented by the attack signal of [0], then the AND gate 8-72 generates an attack clock pulse $\phi$A. The other input terminal of the AND gate 8-73 is supplied with an output signal from the OR gate 51-9. Where the envelope is in a released condition (FIG. 3), then the AND gate 8-73 issues a release clock pulse $\phi$R. Output signals from the AND gates 8-72, 8-73 are delivered through an OR gate 8-76 to an OR gate 51-10, together with an output signal from the last line memory of the Fc memory 16. An output signal from the OR gate 51-10 is transmitted to one of the input terminals of each of AND gates 51-11, 51-12. The other input terminal of the AND gate 51-11 is supplied with a signal denoting the detection of a final counted step number of [63] of a tone waveform delivered from the address step counter 42. The AND gate 51-12 is supplied with a signal inverted by an inverter 51-13 from a signal denoting said counted step number of [63]. An output from an AND gate 39-12 is fed back to the Fc memory 16 through AND gates 8-47, 8-67. Namely, the attack clock pulse $\phi$A, and release clock pulse $\phi$R are drawn off through the AND gate 51-7 in synchronization with a signal allowing the final address step number of a tone waveform only to that of the line memories of the Fd memory 17 which is specified by the data stored in said Fd memory 17. The Fe memory 18 stores the attacked or released condition of the envelope shown in FIG. 3. Where the envelope is in an attacked condition, the Fe memory 18 is supplied with a signal of [1]. Where the envelope is in a released condition, the Fe memory 18 is supplied with a signal of [0]. In the initial attacked condition of the envelope, a signal of [0] is stored in the Fe memory 18. An output signal from the Fe memory 18 is delivered to the AND gate 51-8, 51-15 through the OR gate 51-9 and inverter 51-14. Where the envelope is in an attacked condition, an attack clock pulse $\phi$A sent forth from the AND gate 51-7 is supplied to the adder 52 as a signal instructing an addition of +1 through the AND gate 51-15 and OR gate 51-6. The adder 52 can make a maximum count of [15] (expressed by the binary code of "1111"). A 4-bit count output from the adder 52 is stored in the envelope memory 15 in the form circulating through said memory 15 and AND gates 8-43 to 8-46 and 8-63 to 8-66. A 4-bit output signal from the envelope memory 15 is supplied through the envelope value detection circuit 53 to the corresponding input terminals of the addend number-determining circuit 54 and adder 52, and also to the comparator 47. A 4-bit output signal from the envelope memory 15 is further conducted to the inverters 53-1 to 53-4 of the envelope value detection circuit 53. This envelope value detection circuit 53 detects counts of [15] and [0]. Where maximum 15 attack clock pulses $\phi$A are counted relative to the attacked condition of the envelope, then a signal denoting said maximum number causes a release signal of [1] to be written in the Fe memory 18 through the OR gate 51-9, and AND gates 8-49, 8-68. At this time, the inverter 51-4 ceases to send forth an output signal, suppressing the generation of an attack clock pulse $\phi$A from the inverter 51-15. When the Fe memory 18 is supplied with a signal of [1], the adder 52 receives an instruction specifying subtraction. Accordingly, a release clock pulse $\phi$R is sent forth from the AND gate 8-75. The release clock pulse $\phi$R is conducted to the adder 52 through the OR gates 8-76, 51-10, AND gates 51-11, 51-7, 51-16 and OR gate 51-6 in turn. Thus, the envelope of FIG. 3 is brought to a released condition in which subtraction begins to be made from a maximum envelope value of 15. The AND gate 51-16 ceases to generate an output signal upon receipt of an output signal from the inverter 51-17 when the released condition of [0] is detected. The AND gate 51-8 is also supplied with an attack instruction specifying the [0] step (FIGS. 8E-1, 8E-2). Since an attack instruction specifying the [0] step means that the attacked condition of the envelope is not actually required, an output signal from the AND gate 51-8 causes the adder 55 to be set for the counting of a maximum number of 15 and in consequence the envelope to be immediately brought into the released condition.

The tone waveforms of FIG. 4 are described here again. The comparator 47 makes a comparison between the binary codes representing the 4 bits of an output signal from the envelope memory 15 and the binary codes denoting the intermediate 4 bits of an output signal from the address memory 13, namely the bits weighted by 2, 4, 8, and 16 respectively. The comparator 47 generates a signal denoting coincidence between the binary codes of signals indicating the former half step numbers (0 to 31) and a signal representing coincidence between the binary codes of signals showing the latter half step numbers (32 to 63), and also produces a signal showing noncoincidence between the binary codes of signals indicating the former half step numbers and also a signal showing noncoincidence between the binary codes of signals denoting the latter half step numbers before the issue of an output signal representing the aforesaid coincidence. Namely, as seen from Table 11 of comparison below, each time an envelope value denoted by an output signal from the envelope memory 15 changes, the corresponding variation occurs in the state of comparison to determine coincidence between the binary codes of a 4-bit output signal from the envelope memory 15 and the binary codes of output address step number bit signals from the address memory 13 weighted by 2, 4, 8, and 16 respectively and also in the state of noncoincidence between the binary codes of signals denoting the former half step numbers as well as in the state of noncoincidence between the binary codes of signals representing the latter half step numbers. Thus, the waveforms of FIG. 4 including tone volumes change in the direction from (d) to (a) with respect to the attacked condition of the envelope and in the direction from (a) to (d) with respect to the released condition thereof.

TABLE 11

| Envelope value counter (15) | | | | | Address memory (13) | | | | | | |
|---|---|---|---|---|---|---|---|---|---|---|---|
| Envelope value | 1 | 2 | 4 | 8 | Counted step number | 1 | 2 | 4 | 8 | 16 | 32 |
| 0 | 0 | 0 | 0 | 0 | 0 | 0 | 0 | 0 | 0 | 0 | 0(1) |
| 1 | 1 | 0 | 0 | 0 | 2 | 0 | 1 | 0 | 0 | 0 | 0(1) |
| 2 | 0 | 1 | 0 | 0 | 4 | 0 | 0 | 1 | 0 | 0 | 0(1) |
| 3 | 1 | 1 | 0 | 0 | 6 | 0 | 1 | 1 | 0 | 0 | 0(1) |
| 4 | 0 | 0 | 1 | 0 | 8 | 0 | 0 | 0 | 1 | 0 | 0(1) |
| 5 | 1 | 0 | 1 | 0 | 10 | 0 | 1 | 0 | 1 | 0 | 0(1) |
| 6 | 0 | 1 | 1 | 0 | 12 | 0 | 0 | 1 | 1 | 0 | 0(1) |
| 7 | 1 | 1 | 1 | 0 | 14 | 0 | 1 | 1 | 1 | 0 | 0(1) |
| 8 | 0 | 0 | 0 | 1 | 16 | 0 | 0 | 0 | 0 | 1 | 0(1) |
| 9 | 1 | 0 | 0 | 1 | 18 | 0 | 1 | 0 | 0 | 1 | 0(1) |
| 10 | 0 | 1 | 0 | 1 | 20 | 0 | 0 | 1 | 0 | 1 | 0(1) |
| 11 | 1 | 1 | 0 | 1 | 22 | 0 | 1 | 1 | 0 | 1 | 0(1) |
| 12 | 0 | 0 | 1 | 1 | 24 | 0 | 0 | 0 | 1 | 1 | 0(1) |
| 13 | 1 | 0 | 1 | 1 | 26 | 0 | 1 | 0 | 1 | 1 | 0(1) |
| 14 | 0 | 1 | 1 | 1 | 28 | 0 | 0 | 1 | 1 | 1 | 0(1) |
| 15 | 1 | 1 | 1 | 1 | 30 | 0 | 1 | 1 | 1 | 1 | 0(1) |

Referring to FIGS. 8E-1, 8E-2, instructions specifying a fixed tone waveform, triangular tone waveform and rectangular tone waveform are supplied to one of the input terminals of each of the corresponding AND gates 50-1 to 50-3 of the addition control circuit 50 (FIGS. 8F-1, 8F-2). The other input terminal of the AND gates 50-1 to 50-3 are respectively supplied with a signal inverted by the inverter 50-4 from an output instruction specifying the type octave from the decoder 38-1 (FIGS. 8B-1, 8B-2). Output signals from the AND gates 50-1 to 50-3 and output signals inverted by the corresponding inverters 50-5 to 50-7 are conducted to the waveform-defining matrix circuit 50-8. Combinations of tone waveforms in the waveform-defining matrix circuit 50-8 provide five types of waveform (FIG. 4). Said combination is carried out on the basis of data given in Table 12 below.

TABLE 12

| State of address counter / Name of waveform | | 0 | Noncoincidence in the former half step numbers | Coincidence | 30 | Noncoincidence in the latter half step numbers |
|---|---|---|---|---|---|---|
| Sawtooth | Floating | / | + 1 | − E | / | / |
| | Fixed | / | + 1 | / | − E | / |
| Rectan- | Floating | + E | / | − E | / | / |
| gular | Fixed | + E | / | / | − E | / |
| Triangular | | / | + 1 | / | / | − 1 |
| | | Rectan-gular | Triangular | Floating triangular | Fixed trian-gular | Triangular |

Figure 8G:
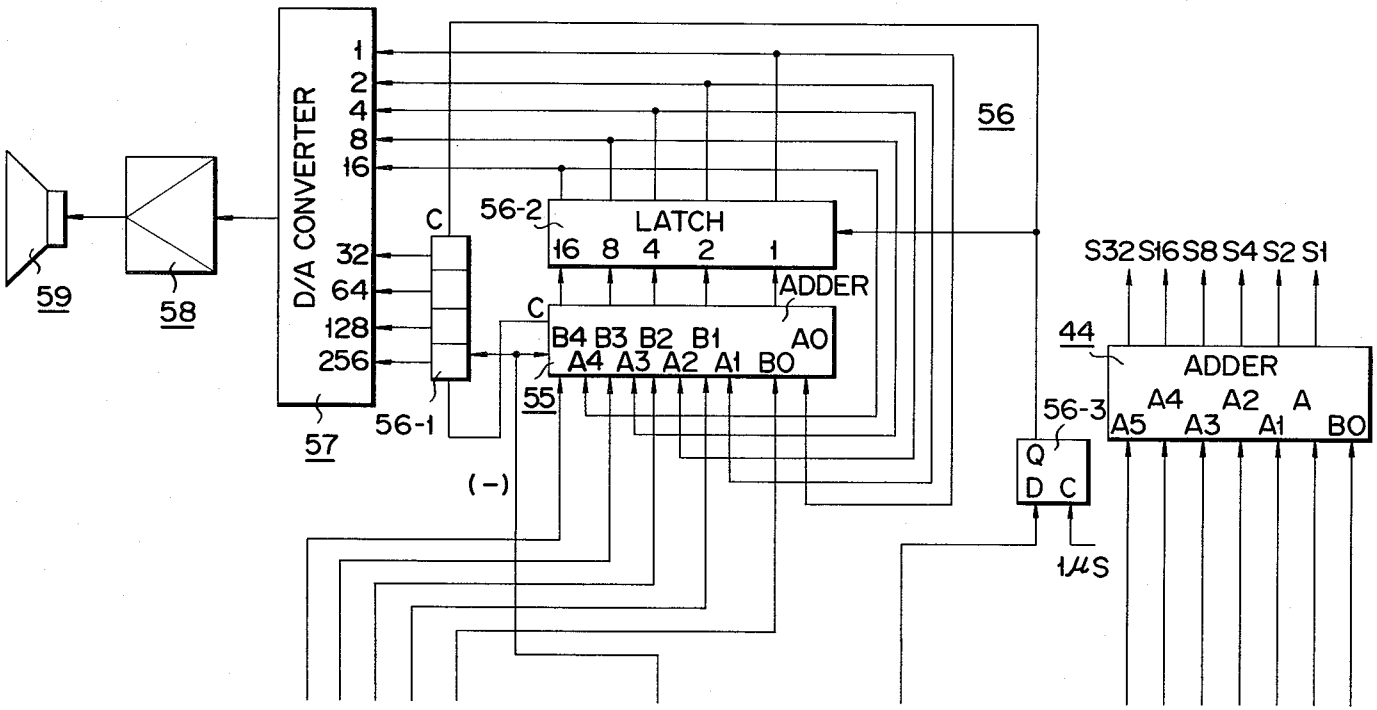

Where, as apparent from Table 12 above, the floating form of, for example, a sawtooth wave is specified, any of the former half address step numbers ([0] to [31]) is stored in a memory section of the address memory 13, and the comparator 47 sends forth the aforesaid noncoincidence signal, then an addition of +1 is made to each address step signal. Where coincidence is attained, the comparator 47 issues an instruction of −E. Thus, subtraction is made from the data stored in the memory section of the address memory 13 when said coincidence is attained. Where 5 output lines of the waveform-defining matrix circuit 50-8 are selectively connected in the OR form, then, for example, an [E] signal is issued from an output line 50-9; a [1] signal from an output line 50-10; and a subtraction (−) instruction from an output line 50-11. The character [E] denotes an envelope value stored in the envelope memory 15 when outputs are sent forth from the AND gate 49-1, 49-2, 49-4 of the waveform control circuit 49. The [E] signal is delivered to the AND gates 54-2 to 54-5 of the addend number-determining circuit 54. The [1] signal is sent forth to an AND gate 54-6, and the subtraction (−) instruction to an adder 55 (FIG. 8G) for counting output waves and also to a 4-bit binary up-down counter 56-1 (FIG. 8G).

A 4-parallel-bit output signal from the envelope memory 15 is supplied to the AND gates 54-2 to 54-5. Output signals from the AND gates 54-2 to 54-5 are supplied to the input terminals $B_1$, $B_2$, $B_3$, $B_4$ of an adder 55 (FIG. 8G). An output signal from the AND gate 54-6 is conducted to the input terminal $B_0$ of the adder 55.

An instruction specifying the 7th octave which is delivered from the decoder 38-1 (FIGS. 8D-1, 8D-2) suppresses the issue of an output signal from the AND gates 50-1, 50-2, 50-3 of the addition control circuit 50, only allowing the floating form of the sawtooth wave (FIG. 4) to be produced.

There will now be described the process of defining the periods of the respective waveforms. An output signal from the Fb memory 14 (FIGS. 8F-1, 8F-2) is supplied to one of the input terminals of exclusive OR gates 8-77, 8-78. A period clock pulse $\phi T$ of FIGS. 8E-1, 8E-2 is conducted to the other input terminal of the exclusive OR gate 8-78. An output signal from this exclusive OR gate 8-78 is transmitted to the other input terminal of the exclusive OR gate 8-77 through an AND gate 8-79 which is supplied with an output count signal from the address step counter 42 which denotes the last address step number of [63]. An output signal from the exclusive OR gate 8-77 is sent forth to the input terminal of the Fb memory 14 through the AND gates 8-42, 8-62.

The period is varied in accordance with a vibrato-specifying instruction, octave change-specifying instruction and a timing of the period clock pulse $\phi T$ in synchronization with the last address number [63] of a tone waveform of the address memory 13. The writing-in timing of an output signal from the AND gate 8-76 to the line memory of the Fb memory 14 varies with the output count signal [63] which is produced when the period clock pulse $\phi T$ is converted into a [0] or [1] signal.

An output signal from the adder 55 of FIG. 8G is fed back to the corresponding input terminal thereof through a latch circuit 56-2, output signals from which are respectively delivered to the input terminals of a digital-analog (D/A) converter 57 which receives bit signals weighted by 1, 2, 4, 8 and 16. The binary counter 56-1 carries out up- or down-counting according to the contents of a carry signal issued from the adder 55 and also according as the subtraction (−) instruction of FIGS. 8F-1, 8F-2 is generated or suppressed. A 4-bit output signal from the binary counter 56-1 is transmitted to the input terminals of the digital-analog converter 57 which are supplied with bit signals weighted 32, 64, 128, and 256. The binary counter 56-1 and latch circuit 56-2 receive a signal having a pitch clock pulse frequency from the AND gate 46-1 (FIGS. 8D-1, 8D-2), and generate an output signal in synchronization with the Q output signal of a DFF circuit 56-3 which is operated in the timing of a 1 μs period signal. An analog output signal from the digital-analog converter 57 is fed through an amplifier 58 to a loud-speaker 59, which produces a pitch tone.

There will now be described the process of generating sample tones from an electronic musical instrument arranged and operated according to the foregoing embodiment. Now let it be assumed that before playing a performance, a player operates a particular key included in the musical instrument type selection input device 32 to select that type which he prefers. To this end, a sample tone-specifying key 29 is depressed to cause the binary counter 30 to produce an output signal. An output signal from the address decoder 33 which selectively picks up a particular key included in said musical instrument type selection input device 32 specifies the corresponding address of the musical instrument type-selecting ROM 26. At this time, the condition is made ready to generate signals included in a program stored in the ROM 26, that is, instructions of M to T and a to p, q and r attack clock pulses $\phi A$, release clock pulses $\phi R$, delay detection specifying signal, waveform-specifying signal, vibrato-specifying signal, multiperformance minute difference-specifying signal, multiperformance specifying signal, scale data, octave data, etc.

A signal denoting the depression of a particular key included in the musical instrument type selection input device 32 is sent forth as an $\alpha$ signal from the AND gate 35 to the OR gates 7-1, 1-9 (FIGS. 8A-1, 8A-2). Accordingly, a control signal $K_0$ is issued from the AND gate 1-10. The control signal $K_0$ is conducted through the OR gate 22-21 (FIGS. 8C-1, 8C-2) to the AND gates 8-2 to 8-4, 8-11 to 8-13, 8-69 (FIGS. 8D-1, 8D-2). An output signal from the OR gate 8-2 is delivered to the AND gates 8-8 to 8-10, 8-19 to 8-22.

Particular scale data read out of the ROM 26 is written in the scale-specifying data memory 12 through the AND gates 27-1 to 27-4 and OR gates 21-1 to 21-4. Particular octave data read out of the ROM 26 is supplied to the octave-specifying data memory 9 through the AND gates 28-1 to 28-3 and OR gates 24-1 to 24-3. According to the scale data and octave data thus stored, the corresponding pitch clock pulse frequency signal is sent forth from the AND gate 46-1 of the clock pulse number control circuit 46. Control signals stored in the ROM 26 are supplied to the corresponding control circuit through the tone control circuit 31. Based on said control signals, tones represented by the pitch clock pulse frequency signals are drawn off from the loud-speaker 59 as sample tones. The process of generating musical tone according to the tone control signals delivered from the ROM 26 is carried out in the same manner as when musical tones are produced by performance keys, detailed description thereof being omitted.

Keys included in the musical instrument type selection input device 32 are depressed to produce sample tones for selection of the type of musical instrument which a player prefers. Upon completion of said selection, the sample tone generation-specifying key 29 is operated to suppress the issue of an output signal from the binary counter 30. At this time, the operation of the AND gates 27-1 to 27-4 and 28-1 to 28-3 is stopped. Accordingly, octave data and scale data cease to be read out of the ROM 26. Now, the player plays a piece by the operation of performance keys according to that type of musical instrument which is represented by the aforesaid sample tones. Now let it be assumed that a performance key corresponds to the scale G1. Then as seen from Table 3, signals resulting from the depression of performance keys are transmitted to the OR gate output line 4-3 in synchronization with a timing signal $t_9$ delivered from the 84-bit shift register 4-1. The timing signal $t_9$ is supplied to the shift register 4-4 and also to the AND gate 4-5. As shown in Table 4, a one-shot signal [FIG. 14*c*] having a width of 8 μs is produced to denote the depression of a performance key. Said one-shot signal is carried to the AND gate 1-10 through the OR gate 1-9 of the control signal-generating circuit 1 (FIGS. 8B-1, 8B-2). The shift register 1-11 receives a Kd signal [FIG. 14(*e*)] from the AND gate 1-5 through the AND gate 1-8 and OR gate 1-15. The Kd signal is sent forth from the-output terminal p 8 of the shift register 1-11. As is apparent from the description by reference to FIG. 15, a Kd signal (FIG. 14(*m*)] drawn off from the output terminal p8 of the shift register 1-11 is first produced as a control signal Ko having a width of 1 μs [FIG. 14(*n*)]. A signal synchronized with the control signal K0 issued from the AND gate 1-10 causes the referential first line memory ko of each of the octave-specifying data memory 9, scale-specifying data memory 12, and the Fd memory 17 (FIGS. 8F-1, 8F-2) to be supplied with an input signal in a prescribed timing. Now let it be assumed that an octave-specifying instruction (FIG. 7) represents the case where an $\alpha$ instruction is not issued to specify an multiperformance or a combination of octaves, but the normal octave is used. Therefore, an output signal from the AND gate 1-10 (FIGS. 8A-1, 8A-2) is supplied to the OR gate 8-1, any of the octave-specifying data input gates 8-2 to 8-4 of the octave-specifying data memory 9 and any of the scale-specifying data input gates 8-11 to 8-14 of the scale-specifying data memory 12 through the AND gate 22-1, OR gate 22-17, and OR gate 22-21 of the correction octave-generating circuit 22 (FIGS. 8C-1, 8C-2). An output signal from the OR gate 8-1 is conducted to any of the input gates 8-8 to 8-10 of the octave-specifying data memory 9 (FIGS. 8D-1, 8D-2) and also to any of the input gates 8-19 to 8-22 of the scale-specifying data memory 12. Consequently, count data of [100] sent forth from the octave counter 5-3 (FIGS. 8A-1, 8A-2) and count data of [0001] issued from the scale counter 5-1 (FIGS. 8A-1, 8A-2), both of which correspond to the depression of the G1 key when a signal is generated from the AND gate 1-10 (FIGS. 8A-1, 8A-2) in synchronization with the control signal $K_0$ are supplied as pitch data to the adder 25 and correction scale data-generating circuit 19 respectively both shown in FIGS. 8C-1, 8C-2. Since, in this case, octaves are not specified for multiperformance, nor is carried out any correction by the correction octave-generating circuit 22 and correction scale-generating circuit 19, the above-mentioned octave data of [100] obtained from the octave counter 5-3 is stored in the first line memory $k_0$ of the octave-specifying data memory 9 through the adder 25, AND gates 8-2 to 8-4, OR gates 8-5 to 8-7 and AND gates 8-9, 8-10 in turn. The scale data of [0001] issued from the scale counter 5-1 is supplied to the first line memory $k_0$ of the scale-specifying data memory 12 through the AND gates 19-6 to 19-9, OR gates 19-26 to 19-29, AND gates 20-1 to 20-4 and OR gates 21-1 to 21-4 and further, as shown in FIGS. 8D-1, 8D-2, through the AND gates 8-11 to 8-14, OR gates 8-15 to 8-18, AND gates 8-19 to 8-22. When a signal is generated from the AND gate 1-10 (FIGS. 8A-1, 8A-2), the control signal K1 indicated in FIG. 14 (O) read out of the shift register 13 is transmitted to the shift register 1-12 through the OR gate 1-15. In this case, the operation of the AND gate 1-6 is suspended by a signal inverted by the inverter 1-11 from a signal denoting the depression of a performance key. Accordingly, the signal Kd issued from the output terminal p8 of the shift register 1-11 is not fed back thereto. As shown in FIG. 14(*f*), therefore, a timing signal is issued to specify the second line memory kl of the scale-specifying data memory 12 with a delay of 1 μs from the point of time of which a timing signal is given to specify the first line memory k0 thereof. The above-mentioned signal Kd is stored in the second line memory k1 in the form circulating therethrough. A timing signal $t_9$ sent forth from the OR gate 4-3 upon depression of the performance key G1 (FIGS. 8B-1, 8B-2) is delayed by 8 μs by the delay circuit 7-2 (FIGS. 8A-1, 8A-2) to clear data counted by the counter 7-4 for detecting the nondepression of a performance key, and also reset the S-R flip-flop circuit 7-3. Accordingly, a signal denoting the depression of a performance key is sent forth from the $\overline{Q}$ output terminal of the flip-flop circuit 7-3. Said key depression-denoting signal is conducted through the OR gate 7-5 to the AND gates 8-50 to 8-68 used to control the supply of an input signal to the octave bit memory 10, Fa memory 11 (both of FIGS. 8D-1, 8D-2), address memory 13, Fb memory 14, envelope memory 15, Fc memory 16, Fe memory 18 (all of FIGS. 8F-1, 8F-2) and the AND gate 8-48 used to control the circularly shifting of data through the Fd memory 17 (FIG. 8F). Thus, data can be shifted through each of the above-mentioned memories 10, 11, 13, 15, 16, 17.

Octave-specifying data of [100] corresponding to the performance key G1 which is stored in the first line memory k0 of the octave-specifying data memory 9 is issued per cycle (8 μs) from the [1] output terminal of the decoder 38-1 as a signal for specifying the first octave. As seen from Table 6, the octave-specifying signal is supplied per cycle (8 μs) to the adder 39-1 as an instruction for addition of +1. The adder 39-1 generates a carry signal for each period of Tfb1 (256 μs). A carry signal delivered from the adder 39-1 (FIGS. 8D-1, 8D-2) which is used as an octave referential clock signal having a frequency of 3906.25 Hz causes a pitch clock signal (FIG. 20) having a frequency of Fx1 (48.828 Hz) to be sent forth from the AND gate 46-1 (FIGS. 8D-1, 8D-2), thereby effecting an addition of +1 in the adder 44 (FIG. 8G). Therefore, a signal showing the result of said addition is successively stored in the first line memory k0 of the address memory 13 as a signal denoting a progressively increased number of the address steps included in one cycle (64 steps) of a tone waveform.

An address step number of a tone waveform stored in the first line memory k0 of the address memory 13 is supplied to the step counter 42. The AND gate 49-5 supplied with a signal denoting the detection of the former half step number (0 to 31) of a tone waveform from the output terminal of the inverter 42-6 through the OR gate 49-7 delivers a signal denoting the detection of the noncoincidence between the binary codes representing the former half step numbers which is delivered from the comparator 47. The detection signal is sent forth through the AND gate 49-5 to the matrix circuit 50-8 of the addition control circuit 50. Where the ROM 26 (FIGS. 8E-1, 8E-2) issues a signal specifying the floating form of a sawtooth tone waveform, then the inverters 50-5, 50-6, 50-7 of the addition control circuit 50 get ready to generate an output signal of [1]. Where, therefore, the AND gate 49-5 produces an output signal, a signal of [+1] is issued from the matrix circuit 50-8. A signal of [1] is sent forth from the OR gate output line 50-10 to the AND gate 54-6. Where a coincidence detection signal is generated from the AND gate 49-4, a signal of [−E] is issued from the matrix circuit 50-8. As the result, a signal of [E] is supplied to the OR gate output line 50-9. A signal of subtraction (−) is conducted to the OR gate output line 50-11. The signal of [E1] is supplied to the AND gates 54-2 to 54-5. The signal of (−) is delivered as a subtraction instruction to the adder 55 and up-down counter 56-1 (both shown in FIG. 8G). As seen from FIG. 4 and the description of Table 12, an addition of +1 is successively made in the adder 55 in synchronization with an output signal from the AND gate 54-1, before the comparator 47 which makes a comparison between the binary codes of data stored in the address memory 13 and envelope memory 15 produces a coincidence detection signal. When, upon issue of said coincidence detection signal, the content of the envelope memory is subtracted from a total amount of addition, thereby producing the floating form of a sawtooth tone waveform including a tone volume. The operation of the memory sections of each of the memories 9 to 18 is separately controlled according to a tone waveform, envelope, and pitch programed in the ROM 26. Even when a performance key is released, a pitch tone corresponding to the specified line memory is sustained in accordance with the envelope, until the envelope is reduced from the attacked condition to the end of the released condition, namely, an attenuation line of a tone volume falls to zero. Where it is desired to change a selected type of musical tone while a piece based on said selected tone is played, a musical tone type control signal issued from the ROM 26 can be changed simply by operating a different key included in the musical tone type selection input device 32, without depressing the sample tone generation-specifying key 29.

In the case of a duet, an instruction q is issued from the ROM 26 through the inverter 1-19 (FIGS. 8A-1, 8A-2) to the matrix circuit 1-17. In the case of a quartet, an instruction r is sent forth from the ROM 26 through the inverter 1-18 (FIGS. 8A-1, 8A-2) to said matrix circuit 1-17. As the result, an instruction is given for the simultaneous operation of two or four line memories, and each line memory is supplied with a musical tone type control signal.

With the foregoing embodiment, the musical tone type-selecting key was formed of a touch switch. However, said key is not limited thereto, but may consist of any other type of switch, for example, a push button switch. Further, a number of musical tone type-selecting keys can be freely chosen. It is most preferred to arrange these keys in the same row or indicate them in the same color or set them in an easily distinguishable form for each type of musical instrument, such as a string instrument, percussion instrument or wind instrument. It is also possible to arrange the musical tone type-selecting keys with numerals or notations attached thereto or by any other method.

Part of the performance keys 3 may be concurrently used as the musical tone type selection input device 32 by providing proper changeover means.

This invention is not limited to the foregoing embodiment, but may be practised in many other modifications without changing the scope of the invention.

What is claimed is:

1. A sample tone-generating system for an electronic musical instrument for generating one sample tone corresponding to a selected musical tone color out of a plurality of different types of musical tone colors, comprising:

specifying means for selectively specifying a given one of said different types of musical tone colors, means for setting respective different types of said musical tone colors in response to said specifying means, performance keys for playing a musical performance in accordance with the specified type of musical tone color, tone producing means coupled to said setting means for producing said specified type of musical tone color which corresponds to the tone color specified by said specifying means by operation of said performance keys, and sample tone generating means coupled to said specifying means and responsive only to the operation of said specifying means for generating a sample tone having a prescribed pitch and period, said sample tone corresponding to the specified tone color which corresponds to said given one of the different types of musical tone colors and being generated without operating a performance key.

2. A sample tone-generating system according to claim 1 wherein said specifying means is a player operable specifying means.

3. A sample tone-generating system according to claim 2 wherein said player operable specifying means comprises a plurality of player operable tone selection keys, said sample tone generating means being responsive to operation of only a single one of said tone selection keys for generating said sample tone.

4. A sample tone-generating system according to claim 1 wherein said plurality of different musical tone colors corresponds to sounds produced from a plurality of different types of musical instruments.

5. A sample tone-generating system according to claim 1, further comprising control means coupled between said specifying means and said setting means for causing a musical tone color specified by said specifying means to selectively correspond to one of the plurality of different types of tone colors which are settable by said setting means.

* * * * *